US005295472A

United States Patent [19]

Otsuka et al.

[11] Patent Number: 5,295,472

[45] Date of Patent: Mar. 22, 1994

[54] APPARATUS FOR DETECTING MALFUNCTION IN EVAPORATED FUEL PURGE SYSTEM USED IN INTERNAL COMBUSTION ENGINE

[75] Inventors: Takayuki Otsuka; Kouichi Osawa, both of Susono; Tatsumasa Sugiyama, Kariya; Katsuhiko Teraoka, Aichi; Nobuyuki Kobayashi; Koji Okawa, both of Toyota, all of Japan

[73] Assignee: Toyota Jidosha Kabushiki Kaisha, Aichi, Japan

[21] Appl. No.: 998,191

[22] Filed: Dec. 29, 1992

[30] Foreign Application Priority Data

| | | | |
|---|---|---|---|
| Jan. 6, 1992 | [JP] | Japan | 4-000288 |
| Jan. 6, 1992 | [JP] | Japan | 4-000289 |
| Jan. 6, 1992 | [JP] | Japan | 4-000290 |
| Feb. 10, 1992 | [JP] | Japan | 4-023952 |
| Feb. 14, 1992 | [JP] | Japan | 4-028281 |
| Mar. 5, 1992 | [JP] | Japan | 4-048892 |
| Jul. 9, 1992 | [JP] | Japan | 4-182549 |
| Jul. 23, 1992 | [JP] | Japan | 4-197221 |
| Aug. 31, 1992 | [JP] | Japan | 4-232189 |
| Aug. 31, 1992 | [JP] | Japan | 4-232195 |
| Sep. 28, 1992 | [JP] | Japan | 4-258330 |
| Sep. 28, 1992 | [JP] | Japan | 4-258331 |
| Dec. 25, 1992 | [JP] | Japan | 4-346958 |

[51] Int. Cl.[5] ..... F02M 33/02

[52] U.S. Cl. ..... 123/520; 123/198 D

[58] Field of Search ..... 123/516, 518, 519, 520, 123/521, 198 D

[56] References Cited

U.S. PATENT DOCUMENTS 4,949,695 8/1990 Uranishi et al. ..... 123/520

(List continued on next page.)

FOREIGN PATENT DOCUMENTS 102360 4/1990 Japan .
130255 5/1990 Japan .
17169 2/1991 Japan .
26862 2/1991 Japan .
249364 11/1991 Japan .
503844 7/1992 Japan .

OTHER PUBLICATIONS

Ser. No. 895,102 filed Jun. 8, 1992 -copending application.

(List continued on next page.)

*Primary Examiner*—E. Rollins Cross
*Assistant Examiner*—Thomas Moulis
*Attorney, Agent, or Firm*—Kenyon & Kenyon

[57] ABSTRACT

A malfunction detecting apparatus for an evaporated fuel purge system includes a first control valve for controlling a flow of fuel vapor in a purge passage between a canister and an intake passage, a second control valve for controlling a flow of air from the atmosphere to the canister via an air inlet opening of the canister, a first control part for turning OFF the second control valve and for turning ON the first control valve during a first time period, so as to subject the purge passage, the canister, and a vapor passage to a negative pressure of the intake passage during the first time period, and a first discriminator for detecting whether or not a malfunction has occurred in the system, in accordance with a pressure change rate derived from pressures of the system sensed at a start of the first time period and at an end thereof. The apparatus further includes a second control part for detecting whether or not a pressure of the system reaches a prescribed negative pressure after it is detected that no malfunction has occurred in the system, and for turning OFF the first and second control valves during a second time period after the prescribed negative pressure is reached, and a second discriminator for detecting whether or not a malfunction has occurred in the system, in accordance with a pressure change rate derived from pressures of the system sensed at a start of the second time period and at an end thereof.

32 Claims, 33 Drawing Sheets

U.S. PATENT DOCUMENTS

| | | | |
|---|---|---|---|
| 5,027,780 | 7/1991 | Uranishi et al. | 123/520 |
| 5,123,459 | 6/1992 | Toshihiro | 123/520 |
| 5,143,035 | 9/1992 | Kayanuma | 123/520 |
| 5,146,902 | 9/1992 | Cook et al. | 123/520 |
| 5,158,054 | 10/1992 | Otsuka | 123/520 |
| 5,174,265 | 12/1992 | Sekine | 123/520 |
| 5,191,870 | 3/1993 | Cook | 123/520 |
| 5,193,511 | 3/1993 | Fujino | 123/520 |
| 5,193,512 | 3/1993 | Steinbrenner et al. | 123/520 |
| 5,197,442 | 3/1993 | Blumenstock et al. | 123/520 |
| 5,220,898 | 6/1993 | Kidokoro et al. | 123/520 |

OTHER PUBLICATIONS

Ser. No. 774,589 filed Oct. 10, 1991–copending application.

Ser No. 777,757 filed Oct. 10, 1991–copending application.

Ser.No. 867,148 filed Apr. 10, 1992–copending application.

WO 9112426 (PCT) Aug. 1991.
WO 9116216 (PCT) Oct. 1991.

APPARATUS FOR DETECTING MALFUNCTION IN EVAPORATED FUEL PURGE SYSTEM USED IN INTERNAL COMBUSTION ENGINE

BACKGROUND OF THE INVENTION (1) Field of the Invention

The present invention generally relates to malfunction detection in an evaporated fuel purge system, and more particularly to an apparatus for detecting a malfunction in an evaporated fuel purge system used in an internal combustion engine.

(2) Description of the Related Art

An evaporated fuel purge system is used in an internal combustion engine. In the evaporated fuel purge system, fuel vapor fed from a fuel tank is absorbed in an absorbent in a canister, and the fuel vapor is prevented from escaping to the atmosphere. This system functions to feed the absorbed fuel into an intake passage of the engine when the engine is in a prescribed operating condition and the intake passage is subjected to a negative pressure below the atmospheric pressure.

The evaporated fuel purge system (hereinafter called the system) includes a vapor passage for connecting the fuel tank to the canister and a purge passage for connecting the canister to the intake passage of the engine. There is provided a purge control valve for controlling a flow of fuel vapor within the system. When the vapor passage or the purge passage is damaged due to a certain problem, or when a connecting pipe is disconnected from either of the passages, the fuel vapor may escape from the system to the atmosphere and a serious problem may arise in the engine. When the purge passage between the canister and the intake passage clogs due to a certain problem, the fuel vapor in the canister may overflow, so that fuel vapor may leak from an air inlet hole of the canister to the atmosphere. Thus, it is necessary to diagnose malfunctions in the evaporated fuel purge system, in order to perform desired operations of the engine.

There have been proposed several malfunction detecting devices for diagnosing the system used in the engine. One of the devices is disclosed in U.S. patent application Ser. No. 895,102 filed on Jun. 8, 1992 (assigned to the applicant of the present invention). This malfunction detecting device includes a first control valve for controlling a flow of fuel vapor in the purge passage between the canister and the intake passage, and a second control valve for opening and closing the air inlet hole of the canister, the hole communicating with the atmosphere. When the system is diagnosed, the second control valve is closed, and the first control valve is also closed when a prescribed negative pressure level is sensed in the fuel tank. The level of the negative pressure in the fuel tank is maintained for a prescribed time period. It is detected whether a malfunction occurs in the system in response to a level of pressure change in the fuel tank during the time the level of the negative pressure is maintained.

However, in the above mentioned device, when a relatively large leakage occurs in the system, it takes a long time for the level of tank internal pressure to reach a prescribed initial negative pressure level. If the initial negative pressure level is not reached due to occurrence of a considerable leakage, the system is not correctly diagnosed.

In the prior art, there is another malfunction detection device for diagnosing the system. This device has the construction similar to that of the aforementioned device. The malfunction detection device mentioned above merely checks whether or not a reference level of negative pressure is reached in the system after the second control valve is closed. It is detected whether a leakage occurs in the system depending on whether the reference level of the negative pressure is sensed. In a case of the above mentioned device, it is difficult to correctly detect a slight leakage in the system by sensing the reference level of negative pressure, because the flow of fuel vapor in the system varies somewhat considerably and the fuel within the fuel tank always evaporates.

Other disadvantages or problems of the above mentioned devices and other conventional devices will become more apparent from the detailed description of preferred embodiments of the present invention when read in conjunction with the accompanying drawings.

SUMMARY OF THE INVENTION

Accordingly, it is a general object of the present invention to provide an improved malfunction detecting apparatus in which the above described problems are eliminated.

Another, more specific object of the present invention is to provide a malfunction detecting apparatus which reliably and correctly detects a malfunction in the system not only when a considerable leakage occurs in the system but also when a slight leakage occurs in the system. The above mentioned object of the present invention is achieved by a malfunction detecting apparatus which includes a first control valve for controlling a flow of fuel vapor in a purge passage between a canister and an intake passage, a second control valve for controlling a flow of air from the atmosphere into the canister via an air inlet opening of the canister, a first control part for turning OFF the second control valve and for simultaneously turning ON the first control valve during a first time period, so as to subject the purge passage, the canister, and a vapor passage to a negative pressure of the intake passage during the first time period, a first discriminator for detecting whether or not a malfunction occurs in the system, in accordance with a pressure change rate derived from pressures of the system sensed at a start of the first time period and at an end thereof, a second control part for detecting whether or not a pressure of the system reaches a prescribed negative pressure after the first discriminator detects that no malfunction occurs in the system, and for turning OFF both the first control valve and the second control valve during a second time period after the prescribed negative pressure is reached in the system, and a second discriminator for detecting whether or not a malfunction occurs in the system, in accordance with a pressure change rate derived from pressures of the system sensed at a start of the second time period and at an end thereof. According to the present invention, a considerable leakage can be detected in the system from a pressure change rate derived from pressures of the system sensed within a first time period, and a slight leakage can be detected in the system from a pressure change rate derived from pressures of the system sensed within a second time period.

Still another object of the present invention is to provide a malfunction detecting apparatus in which a first portion of the system between the first control valve, the canister and a pressure control check valve, and a second portion of the system between the check valve, the vapor passage and the fuel tank are separately diagnosed so that the system is reliably and correctly diagnosed without making worse the exhaust emission during the malfunction detecting process. The above mentioned object of the present invention is achieved by a malfunction detecting apparatus which includes a purge control valve which is turned ON and OFF to control a flow of fuel vapor in a purge passage between a canister and an intake passage, a control valve which is turned ON and OFF to control a flow of fuel vapor from a fuel tank to the canister via a bypass passage connected to a vapor passage to pass around the pressure control check valve, a pressure detecting part for separately sensing a pressure of a first portion of the system between the purge control valve, the canister and the pressure control check valve and a pressure of a second portion of the system between the pressure control check valve, the vapor passage and the fuel tank, a discrimination part for detecting a malfunction in the first portion and detecting a malfunction in the second portion, in accordance with the pressure of the first portion and the pressure of the second portion sensed by the pressure detecting part, and a valve control part for turning ON and OFF the purge control valve in accordance with the detection performed by the discrimination part, and for turning ON and OFF the control valve in accordance with the detection performed by the discrimination part. According to the present invention, the fuel tank is not subjected to a negative pressure of the intake passage when the system is diagnosed. Thus, a malfunction in the system can be reliably and correctly detected and the exhaust emission during the diagnostic process can be improved.

A further object of the present invention is to provide a malfunction detecting apparatus which correctly detect a malfunction in the system when the engine is in a cold starting condition or when the fuel temperature at the current engine start is lower than the fuel temperature at the preceding engine stop. Therefore, a malfunction in the system is correctly detected when the engine is in a cold starting condition or when a fuel temperature at a current engine start is lower than that at a preceding engine stop.

A further object of the present invention is to provide a malfunction detecting apparatus in which a control valve in the bypass passage is not turned OFF and remains in the open condition so as to subject the fuel tank to the atmospheric pressure via the bypass passage after a leakage in the system is detected. According to the present invention, it is possible to efficiently reduce the amount of fuel vapor escaping to the atmosphere.

Other objects and further features of the present invention will be more apparent from the following detailed description when read in conjunction with the accompanying drawings.

DESCRIPTION OF THE PREFERRED EMBODIMENTS

Figure 1:
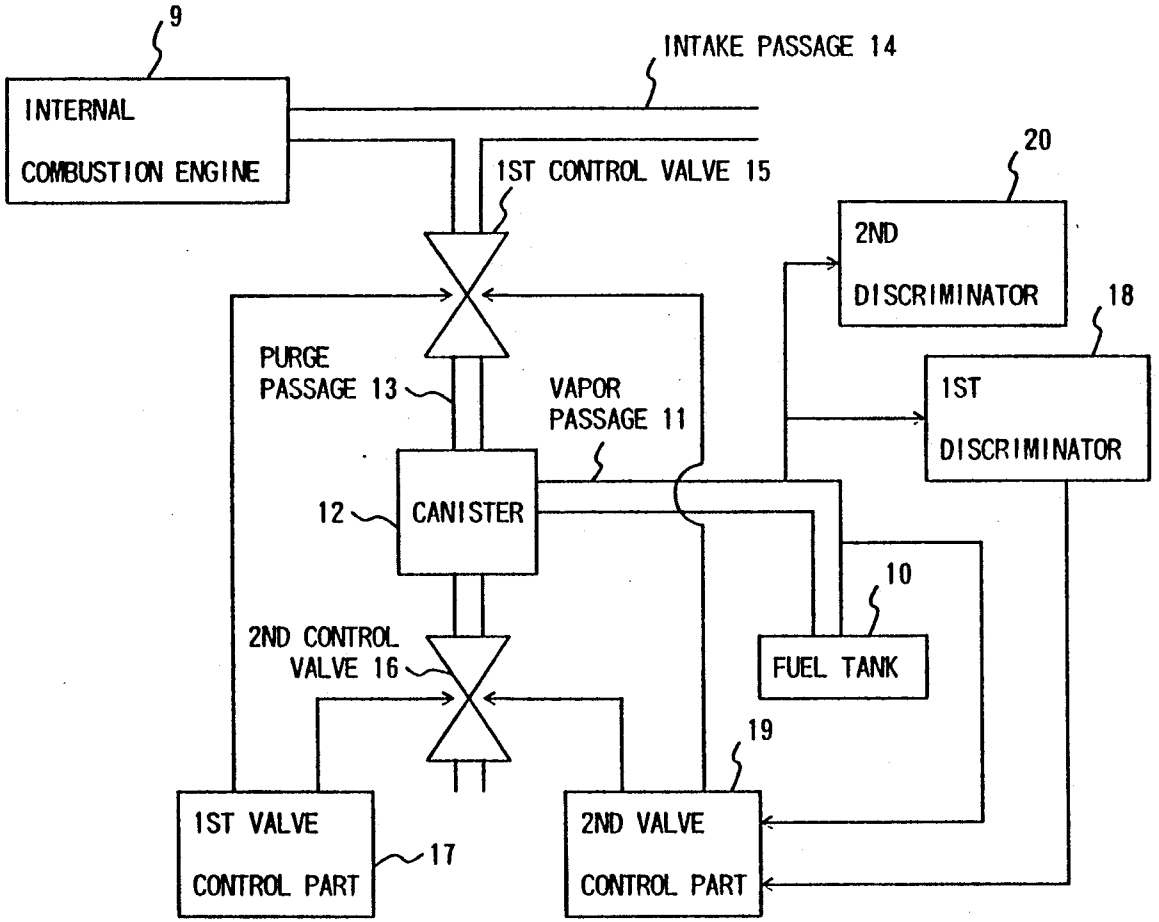
FIG. 1 is a block diagram showing a first embodiment of the malfunction detecting apparatus according to the present invention.

The following description will explain each of preferred embodiments of malfunction detecting apparatuses according to the present invention in conjunction with the accompanying drawings. In this part of the specification, a number of embodiments of the present invention which are applied to evaporated fuel purge systems are described. A first embodiment will be described with reference to FIGS. 1 through 9, a second embodiment will be described with reference to FIGS. 10 through 14, a third embodiment will be described with reference to FIGS. 15 through 20, a fourth embodiment will be described with reference to FIGS. 21 through 24, a fifth embodiment will be described with reference to FIGS. 25 through 27, and a sixth embodiment will be described with reference to FIGS. 28 through 30. In this part of the specification, the disadvantages or problems of some malfunction detecting devices will be explained in order to clarify the advantages and features of the preferred embodiments of the present invention in conjunction with the accompanying drawings.

A description will now be given of a first embodiment of a malfunction detecting apparatus according to the present invention, with reference to FIGS. 1 through 9. FIG. 1 shows the construction of the first embodiment of the malfunction detecting apparatus according to the present invention. As described above, the malfunction detecting apparatus detects a malfunction in an evaporated fuel purge system used in an internal combustion engine, in order to achieve desired operations of the engine and the system. In the apparatus shown in FIG. 1, fuel vapor from a fuel tank 10 is fed to a canister 12 via a vapor passage 11, and the fuel vapor is absorbed in an absorbent in the canister 12. When an internal combustion engine 9 is operating in a prescribed operating condition, an intake passage 14 of the engine 9 is subjected to a negative pressure. At this time, the fuel vapor, stored in the canister 12, is fed into the intake passage 14 via a purge passage 13 due to the negative pressure of the intake passage 14. In the present specification, the evaporated fuel purge system to which several preferred embodiments of the present invention are applied, includes at least the fuel tank 9, the vapor passage 11, the canister 12, the purge passage 13, the intake passage 14, the first control valve 15, and a control part such as a microcomputer.

The malfunction detecting apparatus of the present invention shown in FIG. 1 includes a first control valve 15 provided in the vapor passage 11 between the canister 12 and the intake passage 14, a second control valve 16 provided at an air inlet hole of the canister 12 leading to the atmosphere, a first valve control part 17 for turning ON and OFF the valves 15 and 16, a first discriminator 18, a second valve control part 19 for turning ON and OFF the valves 15 and 16, and a second discriminator 20.

The first control valve 15 is opened and closed to control a flow of fuel vapor in the purge passage 13 from the canister 12 to the intake passage 14. The second control valve 16 is opened to make the canister 12 open to the atmosphere via the air inlet hole, and closed so as to close the air inlet hole from the atmosphere.

The first valve control part 17 turns OFF the second control valve 16 to close the air inlet hole of the canister 12, and simultaneously turns ON the first control valve 15 to open the purge passage 13 for a first time period, so that the purge passage 13, the canister 12, and the vapor passage 11 (included in the system) are subjected to the negative pressure of the intake passage 14 until the first time period has elapsed since the first control valve 15 was turned ON. The first discriminator 18 detects whether or not a malfunction occurs in the system, in accordance with the pressure change rate derived from pressures of the system sensed at the start of the first time period and at the end thereof.

Only when no malfunction is detected in the system by the first discriminator 18, the second valve control part 19 and the second discriminator 20 carry out a secondary diagnostic process. In the secondary diagnostic process, the second valve control part 19 turns OFF the first control valve 15 and the second control valve 16 together, so that the valves 15 and 16 are closed to place the system in a closed condition for a second time period. When the second time period has elapsed since the first and second control valves 15 and 16 are turned OFF by the second valve control part 19, the second discriminator 20 senses pressures of the system during the second time period, and detects whether or not a malfunction occurs in the system, in accordance with the pressure change rate derived from pressures of the system sensed at the start of the second time period and at the end thereof.

Figure 2:
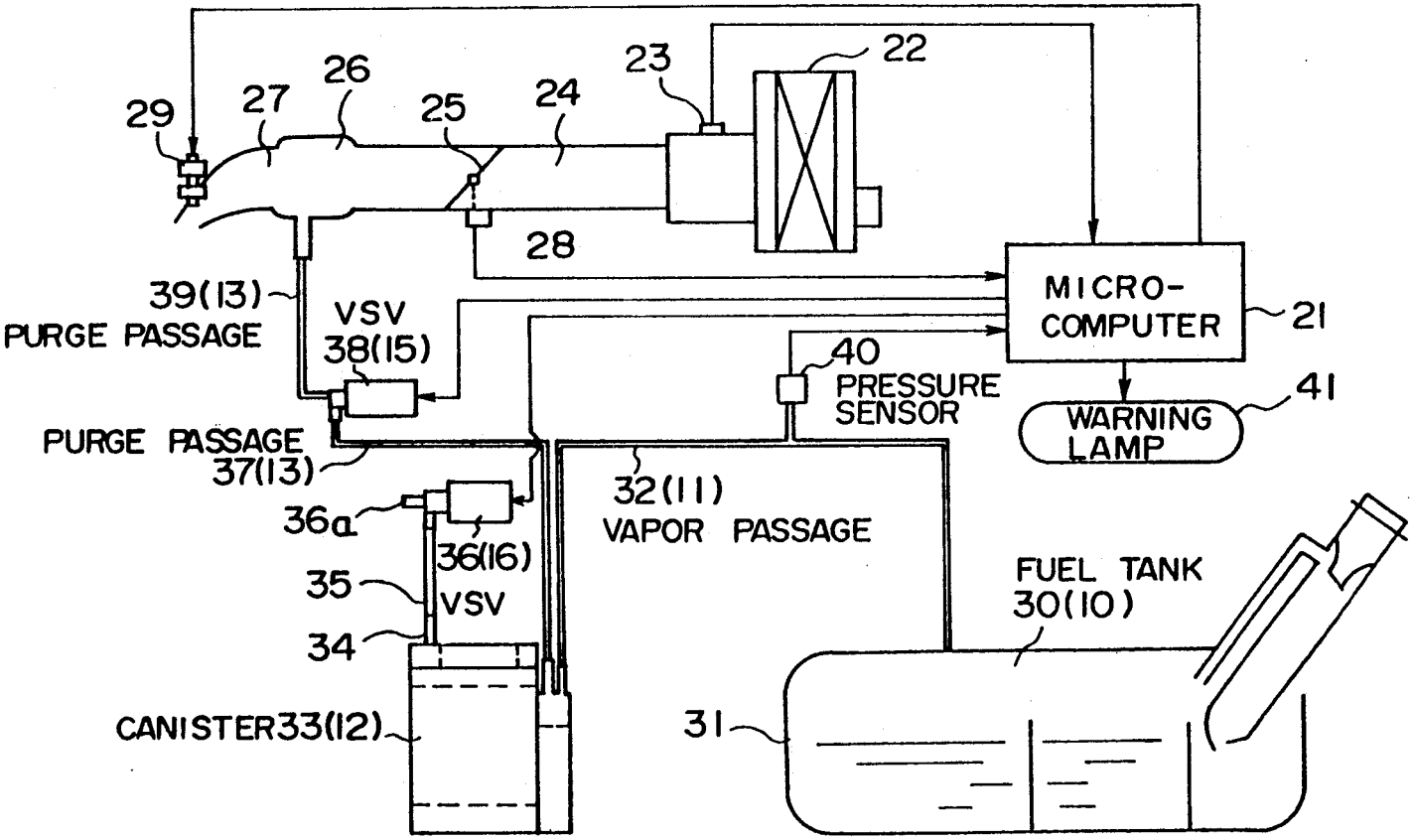
FIG. 2 is a diagram showing an evaporated fuel purge system to which the first embodiment of the present invention is applied.

FIG. 2 shows the construction of the evaporated fuel purge system to which the first embodiment of the present invention is applied.

In the evaporated fuel purge system shown in FIG. 2, external air enters an intake pipe 24 of the engine through an air cleaner 22 At the air cleaner 22, dust or other undesired matter is removed from the external air. An air flow meter 23 measures a flow rate of the air in the intake pipe 24. The flow rate of the air in the intake pipe 24 is adjusted by means of a throttle valve 25 in conjunction with the measured flow rate. When an intake valve (not shown) of one of cylinders of the engine is opened, the air in the intake pipe 24 is passed through a surge tank 26 and an intake manifold 27, and fed to a combustion chamber of that cylinder of the engine. The intake passage 14 shown in FIG. 1 is formed by the intake pipe 24 and the intake manifold 27.

The throttle position of the throttle valve 25 is adjusted in accordance with a position of an accelerator pedal (not shown) operated by a vehicle driver. The throttle position of the throttle valve 25 is sensed by a throttle position sensor 28. A fuel injection valve 29 is provided in the intake manifold 27 for each of the cylinders of the engine. The fuel injection valve 29 supplies fuel 31, being fed from a fuel tank 30 (corresponding to the fuel tank 10), to each of combustion chambers of the engine in a fuel injection time so as to be mixed with intake air from the intake manifold 27. The fuel injection time the fuel is supplied to the engine is instructed and controlled by a microcomputer 21.

In the system shown in FIG. 2, fuel vapor being fed from the fuel tank 30 is sent to a canister 33 (corresponding to the canister 12) via a vapor passage 32 (corresponding to the vapor passage 11). The canister 33 contains an absorbent such as active carbon for absorbing the fuel vapor. The canister 33 has an air inlet hole 34 communicating with the atmosphere.

An air passage 35 is connected to the air inlet hole 34 of the canister 33. At an end of the air passage 35, a vacuum switching valve (VSV) 36 is mounted, and this valve 36 is connected to an air inlet 36*a* communicating with the atmosphere. The VSV 36 corresponds to the second control valve 16, and it is switched ON and OFF in accordance with a signal from the microcomputer 21, to control a flow of air between the canister 33 and the atmosphere. However, it is a matter of course that a mechanical check valve accomplishing the same function as that of the VSV can be used in the apparatus.

The canister 33 is connected to a vacuum switching valve (VSV) 38 via a purge passage 37. The VSV 38 is connected to the surge tank 26 of the intake passage by a purge passage 39. The VSV 38 corresponds to the first control valve 15, and it is opened or closed in accordance with a control signal from the microcomputer 21, so as to control a flow of fuel vapor from the canister 33 to the intake passage. However, it is a matter of course that a solenoid valve accomplishing the same function as that of the VSV can be used in the apparatus.

In the system shown in FIG. 2, a pressure sensor 40 is mounted at an intermediate portion of the vapor passage 32 to sense a pressure of the vapor passage 32. An internal pressure of the fuel tank 30 is substantially measured by the pressure sensor 40. A warning lamp 41 is provided to inform a vehicle driver whether or not a malfunction occurs in the system, and it is detected through the malfunction detection process performed by the microcomputer 21. The ON/OFF state of the warning lamp 41 is instructed by a control signal from the microcomputer 21.

In the system shown in FIG. 2, the fuel vapor from the fuel tank 30 is sent to the canister 33 via the vapor passage 32, and it is absorbed in the absorbent of the canister 33, thereby preventing the fuel vapor from being escaping to the atmosphere. The VSV 36 provided at the canister 33 is normally opened, and the VSV 38 provided in the purge passage 37 is normally opened when the system is operating. Therefore, by making use of a negative pressure occurring in the intake manifold 27 when the engine is operating, external air can enter the canister 33 from the air inlet 36*a* via the VSV 36, the air passage 35 and the air inlet hole 34.

The fuel vapor is desorbed from the absorbent of the canister 33 when the external air enters the canister, and this fuel vapor is fed from the canister 33 to the surge tank 26 of the intake passage via the purge passages 37 and 39 and the VSV 38. The absorbent of the canister 33 is again activated due to the desorption of fuel vapor mentioned above, and it is ready for the use in the subsequent absorption of fuel vapor.

Figure 3:
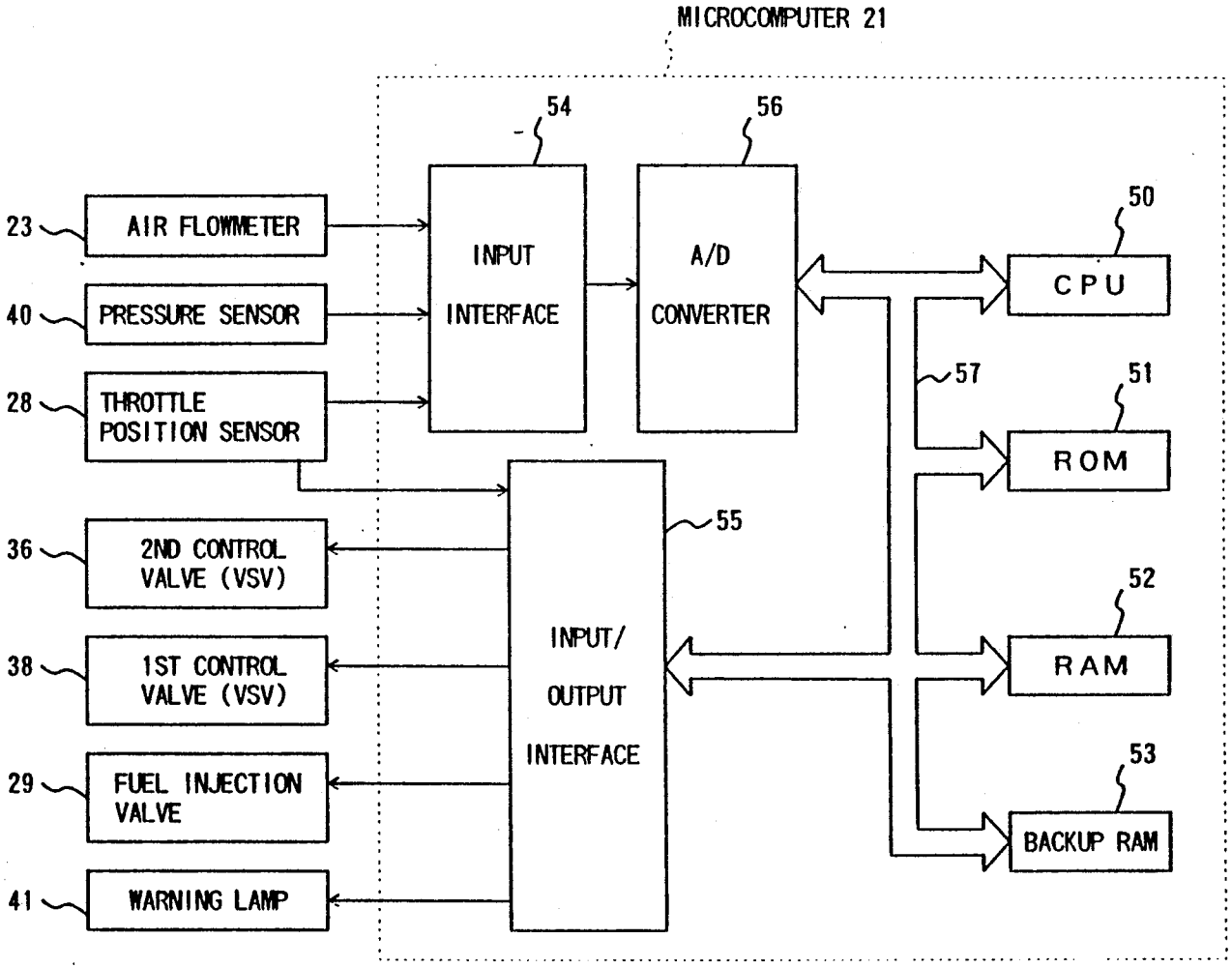
FIG. 3 is a block diagram showing the construction of a microcomputer provided in the malfunction detecting apparatus shown in FIG. 2.

Next, a description will be given of the microcomputer used in the malfunction detecting apparatus according to the present invention, with reference to FIG. 3. The first valve controller 17, first discriminator 18, second valve controller 19, and second discriminator 20 of the first embodiment described above are realized by performing a malfunction detection process by means of the microcomputer 21 in accordance with a control program (software). In accordance with the control program, the malfunction detecting procedure is carried out by the malfunction detecting apparatus of the present invention. FIG. 3 shows the construction of the microcomputer 21. In FIG. 3, the parts which are the same as those corresponding parts in FIG. 2 are designated by the same reference numerals, and a description thereof will be omitted.

The microcomputer 21 shown in FIG. 3 includes a CPU (central processing unit) 50, a ROM (read only memory) 51 for storing the above mentioned control program, a RAM (random access memory) 52 used as working areas when the control program is executed, and a backup RAM 53 in which stored data that is necessary is retained even after the ignition switch if OFF and the engine stops operating.

The microcomputer 21 further includes an input interface unit 54 having a multiplexer, an input/output interface unit 55, an A/D (analog-to-digital) converter 56, and a system bus 57 interconnecting the above mentioned units of the microcomputer 21.

The input interface unit 54 receives an air intake signal from the air flow meter 23, a pressure signal from the pressure sensor 40, and a throttle position signal from the throttle position sensor 28. The input interface unit 54 sequentially transforms the received signals into a sequence of analog signals, and sends the signals to the A/D converter 56. The A/D converter 56 converts the input analog signals into digital signals, and sends the digital signals to the CPU 50 via the bus 57.

The input/output interface unit 55 receives a throttle position signal from the throttle position sensor 28, and sends the signal to the CPU 50 via the bus 57. The input/output interface unit 55 receives control signals from the CPU 50 via the bus 57, and selectively sends the control signals to the VSV 36, the VSV 38, the fuel injection valve 29, and the warning lamp 41, in order to control the operations of the respective units mentioned above.

The malfunction detecting procedure is carried out by the CPU 50 of the microcomputer 21 in accordance with the control program stored in the ROM 51. FIG. 4 shows the malfunction detecting process performed by the apparatus shown in FIG. 2 using the microcomputer 21. This process is periodically re-started by the CPU 50 by making interrupts at prescribed time intervals (e.g., 65 msec.).

Figure 4A:
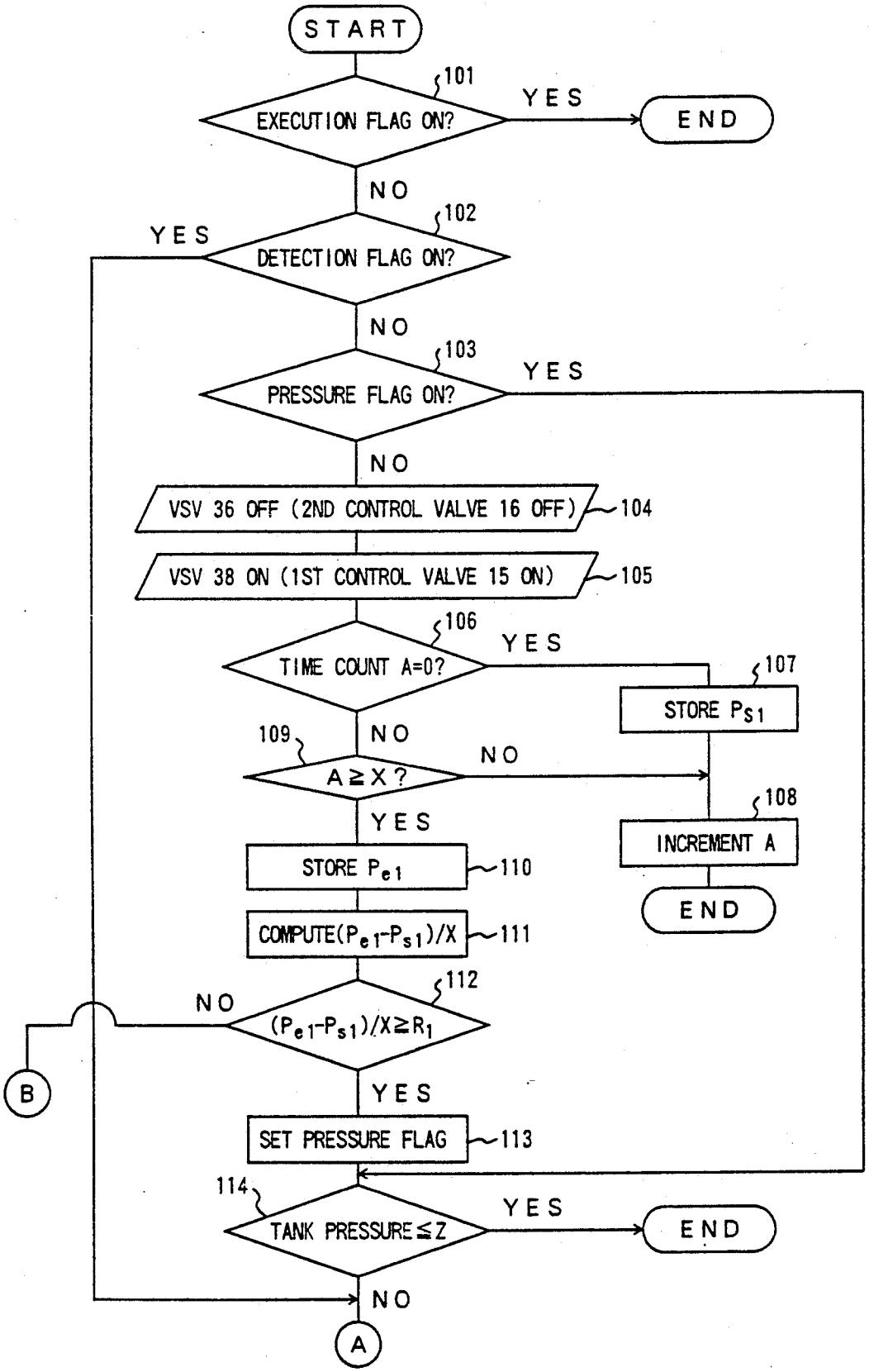
FIGS. 4A and 4B are a flow chart for explaining a malfunction detecting process performed by the apparatus shown in FIG. 2.

In the flow chart shown in FIGS. 4A, step 101 detects whether or not an execution flag is ON (the value "1"). In an initial routine performed at the starting of the engine, the execution flag is reset to zero (the value "0"). Thus, at the first attempt of step 101 in the malfunction detecting procedure, it is detected that the execution flag is OFF, and the next step is taken.

Step 102 detects whether or not a detection flag is ON (the value "1"). In the initial routine performed upon the starting of the engine, the detection flag is reset to zero (the value "0"), and therefore, at the first attempt of step 102, it is detected that the detection flag is OFF, and the next step is taken. Step 103 detects whether or not a pressure flag is ON (the value "1"). In the initial routine mentioned above, the pressure flag is reset to zero (the value "0"), and therefore, at the first attempt of step 103, it is detected that the pressure flag is OFF, and the next step is taken.

Step 104 switches OFF the VSV 36 (the second control valve 16) to close the air passage 35 so that the air inlet hole 34 of the canister 33 is in a closed state. Step 105 switches ON the VSV 38 (the first control valve 15), so that the canister 33 is open to the intake passage of the engine via the purge passage 39, the VSV 38, and the purge passage 37.

Figure 5:
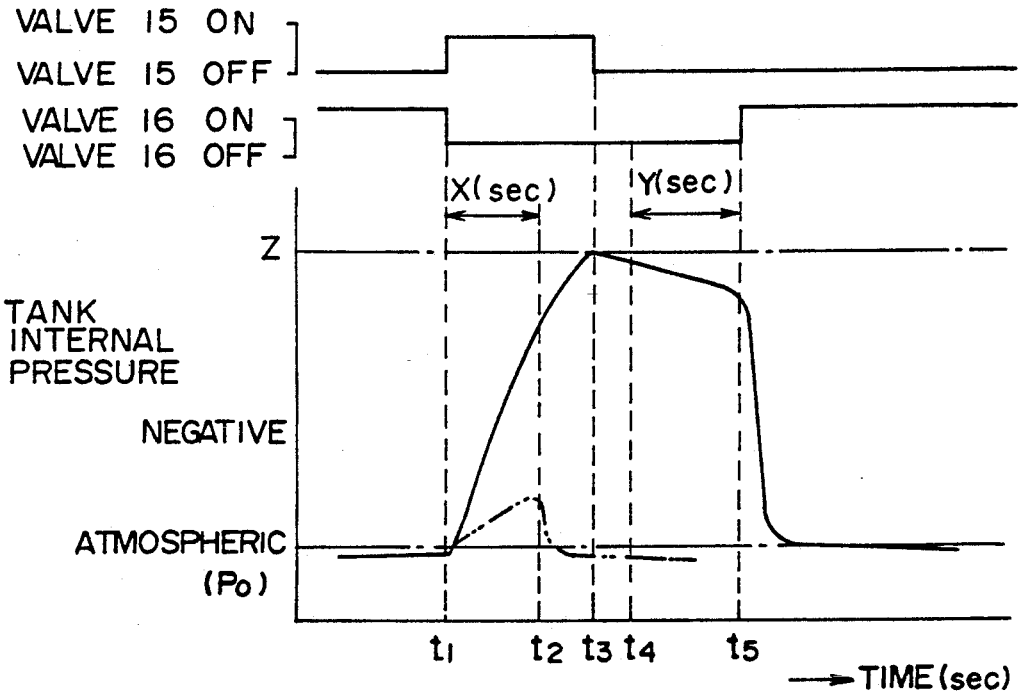
FIG. 5 is a time chart for explaining the change of the tank internal pressure when the malfunction detecting process is performed.

FIG. 5 shows changes of internal pressure of the fuel tank 30 when the malfunction detecting process is performed according to the present invention. The VSV 38 provided in the purge passage is switched ON at a time point "t1" indicated in FIG. 5. The VSV 36 provided at the canister 33 is switched OFF substantially at the same time as the time point "t1" for the VSV 38. Through the purge passage 39, the VSV 38, the purge passage 37, the canister 33, and the vapor passage 32 in the evaporated fuel purge system, the fuel tank 30 is subjected to the negative pressure of the intake passage connected to the engine (leading to the combustion chamber of the engine). During a period between the time points t1 and t2, the internal pressure of the fuel tank 30 rapidly decreases from the atmospheric pressure to a negative pressure, as indicated by a solid line in FIG. 5, if a considerable leakage does not occur in the system.

Step 106 shown in FIG. 4A detects whether or not a time count A is the value "0" (zero sec.). In the initial routine mentioned above, the time count A is reset to the value "0", and therefore, at the first attempt of step 106, it is detected that the time count A is the value "0", and the next step 107 is taken.

Step 107 stores a pressure value Ps1, indicated by the pressure signal from the pressure sensor 40, into the RAM 52 of the microcomputer 21 shown in FIG. 3. This pressure value Ps1 is obtained from the pressure sensor 40 which senses a pressure of the system when the malfunction detecting process has started. Step 108 increments the time count A, and the malfunction detecting process ends.

Step 109 detects whether or not the time count A is greater than a predetermined first time period X seconds (corresponding to the period between the time points t1 and t2 shown in FIG. 5). The malfunction detecting process is periodically re-started at the time intervals of 65 msec. The steps 101–106, 109 and 108 are repeated until the time count A becomes greater than the first time period X.

If step 109 detects that the time count A exceeds the first time period X, step 110 stores a pressure value Pe1, indicated by the pressure signal from the pressure sensor 40, into the RAM 52 shown in FIG. 3. This pressure value Pe1 is obtained from the pressure sensor 40 which senses a pressure of the system at the end of the first time period X. Step 111 computes a rate of pressure change of the system during the first time period, the rate of pressure change being represented by a formula: $(Pe1-Ps1)/X$. From the stored pressure values Ps1 and Pe1 and the predetermined first time period X, the rate of pressure change is determined in accordance with the formula.

Step 112 detects whether or not the value of the computed pressure change rate is greater than a predetermined reference value R1. If no leakage or a very slight leakage occurs in the system, the pressure of the system rapidly changes to a negative pressure during the first time period X (as indicated by the solid line in FIG. 5), and the computed pressure change rate of the system becomes greater than the reference value R1. In contrast, if a considerable leakage occurs in the system, the pressure of the system gradually changes to a negative pressure during the first time period X (as indicated by a two-dot dash line in FIG. 5), and the computed pressure change rate of the system does not reach the reference value R1.

When step 112 detects that the computed rate is greater than the reference value R1, step 113 sets the pressure flag to the value "1". In other words, it is roughly determined that no considerable leakage occurs in the evaporated fuel purge system. The first valve control part 17 of the first embodiment described above is realized by performing the steps 103–109 shown in FIG. 4A, and the first discriminator 18 is realized by performing the steps 110–112 shown in FIG. 4A.

Step 114 shown in FIG. 4A detects whether or not the internal pressure of the fuel tank 30 is smaller than a predetermined negative pressure Z (Pa), in accordance with the pressure signal from the pressure sensor 40. It should be noted that the above comparison of the negative pressures is made by using the absolute values thereof. If the internal pressure of the fuel tank 30 is smaller than the negative pressure Z, then the process ends. The malfunction detecting process is periodically re-started at the time intervals of 65 msec. The steps 101–103 and 114 are repeated until the internal pressure of the fuel tank reaches the negative pressure Z.

Figure 4B:
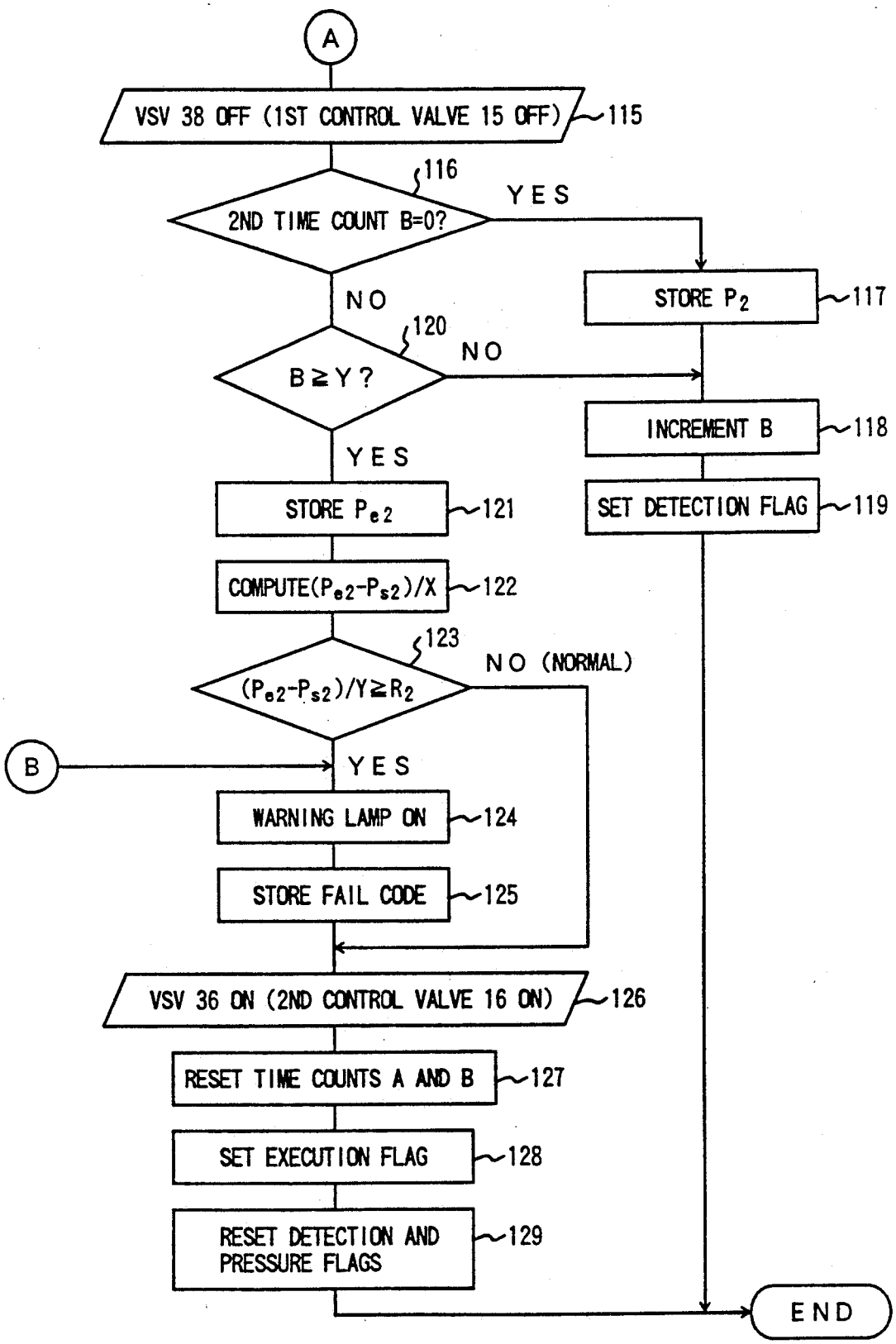

If step 114 detects that the internal pressure of the fuel tank 30 is not smaller than the negative pressure Z, step 115 shown in FIG. 4B switches OFF the VSV 38 to close the purge passage 37. This action is indicated by a time point t3 in FIG. 5. At the time point t3, both the VSV 36 and the VSV 38 are OFF, and the system between the VSV 38 and the fuel tank 30 is entirely enclosed. If no malfunction occurs in the system, the pressure of the system gradually increases from the negative pressure Z and approaches the atmospheric pressure, as shown in FIG. 5.

After the VSV 38 is switched OFF, step 116 detects whether or not a second time count B is the value "0". In the initial routine described above, the second time count B is reset to zero (the value "0"), and, at the first attempt of step 116, it is detected that the second time count B is the value "0", and the next step 117 is taken.

Step 117 stores a pressure value Ps2, indicated by the pressure signal from the pressure sensor 40, into the RAM 52 of the microcomputer 21. This pressure value Ps2 is obtained from the pressure sensor 40 which senses a pressure of the system when a secondary malfunction detecting process has started (corresponding to a time point t4 shown in FIG. 5) since the VSV 38 was turned OFF. Step 118 increments the second time count B, step 119 sets the detection flag ON (the value "1"), and the process ends. At the subsequent attempt of the process, which is periodically re-started at the time intervals of 65 msec, it is detected in step 102 that the detection flag is ON. Only the steps 101–102 and 115–116 are taken, and it is detected in step 116 that the second time count B is not the value "0", and the next step 120 is taken.

Step 120 detects whether or not the second time count B is greater than a predetermined second time period Y in seconds (corresponding to the period between the time points t4 and t5 shown in FIG. 5). If it is detected that the second time count B is not greater than the second time period Y, the steps 118–119 are taken and the process ends. The malfunction detecting process is periodically re-started at the time intervals of 65 msec. The steps 101–102, 115–116, 120, and 118–119 are repeated until the second time count B exceeds the second time period Y.

If step 120 detects that the second time count B exceeds the second time period Y, step 121 stores a pressure value Pe2, indicated by the pressure signal from the pressure sensor 40, into the RAM 52 shown in FIG. 3. This pressure value Pe2 is obtained from the pressure sensor 40 which senses a pressure of the system at the end of the second time period Y. Step 122 computes the rate of pressure change of the system during the second time period, the rate of pressure change being represented by a formula: (Pe2−Ps2)/Y. From the stored pressure values Ps2 and Pe2 and the second time period Y, the rate of pressure change is determined in accordance with the formula mentioned above.

Step 123 detects whether or not the value of the pressure change rate (Pe2−Ps2)/Y of the system is greater than a predetermined reference value R2. If step 123 detects that the pressure change rate is greater than the reference value R2, step 124 switches ON the warning lamp 41 so that a vehicle driver is informed of a malfunction occurring in the system. The pressure change rate of the system is too great due to a malfunction such as a leakage having occurred in the system. Step 125 stores a fail code that is useful to fix the cause of the malfunction in the system, in the backup RAM 53 of the microcomputer 21. This fail code will be read out from the backup RAM 53 and used to repair the system later.

If step 123 detects that the pressure change rate of the system is not greater than the reference value R2, it is determined that no malfunction occurs in the system. At this time, the next step 126 is taken without performing the steps 124–125. Step 126 switches ON the VSV 36 (the second control valve 16) to make the air inlet hole of the canister 33 open to the atmosphere. Step 127 resets the time count A and the second time count B to the value "0". Step 128 sets the execution flag to the value "1". Step 129 resets the detection flag and the pressure flag to the value "0", and the malfunction detecting process ends. Once step 129 is performed, the process is periodically re-started and step 101 detects the execution flag to be the value "1". The process immediately ends without performing other steps.

As shown in FIG. 5, if the VSV 36 is switched ON in step 126 at the time point t5, the internal pressure of the fuel tank 30 rapidly increases to the atmospheric pressure due to a flow of external air from the air inlet of the canister 33.

The second valve control part 19 of the present invention is realized by performing the steps 114 and 115 described above, and the second discriminator 20 of the invention is realized by performing the steps 116 through 123 described above. By performing the steps 114 through 123, the negative pressure to which the purge passage 37, the vapor passage 32 and the fuel tank 30 are subjected is maintained during the second time period Y, and changes of pressures in the system are detected. Thus, it is possible to detect whether or not a leakage occurs in the system, even if the leakage is slight.

If it is detected in step 112 that the pressure change rate is not greater than the value Y, it is determined that a considerable leakage occurs in the system, and the step 124 is taken without performing the steps 113–123. The step 124 switches ON the warning lamp 41, and the step 125 stores the fail code in the backup RAM 53.

In the first embodiment described above, the first valve control part 17 turns OFF the second control valve 16 and turns ON the first control valve 15, so that the purge passage 13, the canister 12, and the vapor passage 11 are subjected to a negative pressure of the intake passage 14 during the first time period. The first discriminator 18 senses pressures of the system during the first time period, and detects whether or not a malfunction occurs in the system, in accordance with the pressure change rate derived from the pressures sensed at the start of the first time period and sensed at the end of the first time period.

When no leakage occurs or a slight leakage occurs in the system, the pressure change rate of the system during the first time period is greater than a prescribed reference value. However, when a considerable leakage occurs in the system, the pressure change rate of the system during the first time period is smaller than the reference value. Thus, the first discriminator 18 determines that a malfunction occurs in the system, if the pressure change rate is smaller than the reference value. If it is greater than the reference value, it is determined that no malfunction occurs and the system is normally operating.

Only when no malfunction occurs in the system, the second valve control part 19 and the second discriminator 20 carries out the secondary diagnostic process described above. In the secondary diagnostic process, the system is placed in a closed condition and the negative pressure of the system is maintained during the second time period. It is detected whether or not a malfunction occurs in the system, in accordance with the pressure change rate derived from the pressures of the system sensed at the start of the second time period and at the end thereof. Even when a malfunction such as a slight leakage has occurred in the system, the apparatus according to the present invention can reliably diagnose the system.

In the apparatus shown in FIG. 2, the purge passage 39 from the VSV 38 is connected to the surge tank 26 of the intake passage. However, the present invention is not limited to this embodiment, and it is possible that the purge passage 39 be connected to the intake pipe 24 near the throttle valve 25.

Figure 6:
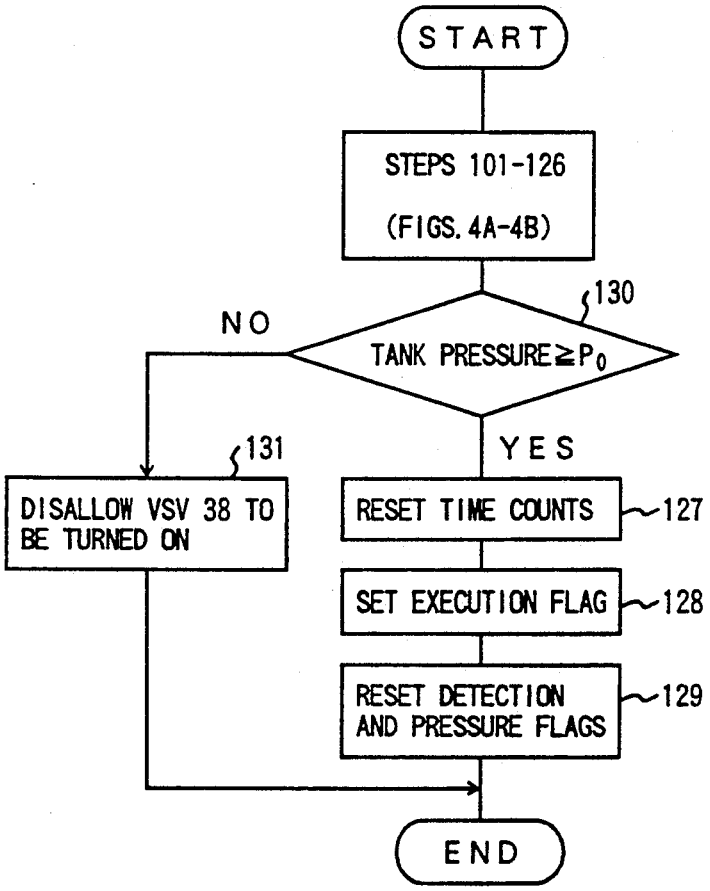
FIG. 6 is a flow chart for explaining a modified malfunction detecting process performed by the apparatus shown in FIG. 2.

Next, some modifications of the above described first embodiment according to the present invention will be described, with reference to FIGS. 6 through 9. FIG. 6 shows a modified malfunction detecting process performed by the apparatus shown in FIG. 2. In FIG. 6, the steps which are the same as those corresponding steps shown in FIGS. 4A–4B are omitted. In the malfunction detecting device disclosed in U.S. patent application No. 895,102 mentioned above, there is a problem in that, after the malfunction detecting process for diagnosing the system has ended and the system is returned to normal operations, the second control valve is turned ON, and the first control valve is occasionally turned ON or controlled according to an evaporated fuel purging procedure.

At this time, if the second control valve is opened after (or at the same time as) the first control valve is opened, the fuel vapor stored in the canister is additionally fed into the intake passage. For this reason, the air-fuel mixture of the intake passage, leading to the combustion chamber of the engine, may become excessively rich. Thus, in order to realize desired operations of the system, it is necessary to disallow the first control valve to be turned ON until it is detected that the second control valve is ON after the secondary malfunction detecting process is finished.

In the flow chart shown in FIG. 6, after the VSV 36 is turned ON in the step 126, step 130 detects whether or not the internal pressure of the fuel tank 30 is equal to or higher than the atmospheric pressure Po. If the tank internal pressure is lower than the atmospheric pressure Po, step 131 disallows the VSV 38 (the first control valve 15) to be turned ON, and the process ends.

Since the process is periodically re-started at the time intervals of 65 msec., it is detected at the subsequent attempt of step 130 that the internal pressure of the fuel tank is equal to or higher than the atmospheric pressure Po. After it is detected that the atmospheric pressure Po is reached in the fuel tank 30, step 127 resets both the time counts A and B to the value "0". Step 128 sets the execution flag to the value "1". Step 129 resets the detection flag and the pressure flag to the value "0", and the malfunction detecting process ends.

In the modified malfunction detecting process shown in FIG. 6, the switching ON of the VSV 38 is disallowed until the internal pressure of the fuel tank 30 is equal to or higher than the atmospheric pressure Po, even if the VSV 36 is turned ON after the secondary malfunction detecting process is finished. It is possible to prevent the air-fuel mixture of the intake passage from being too rich.

Figure 7:
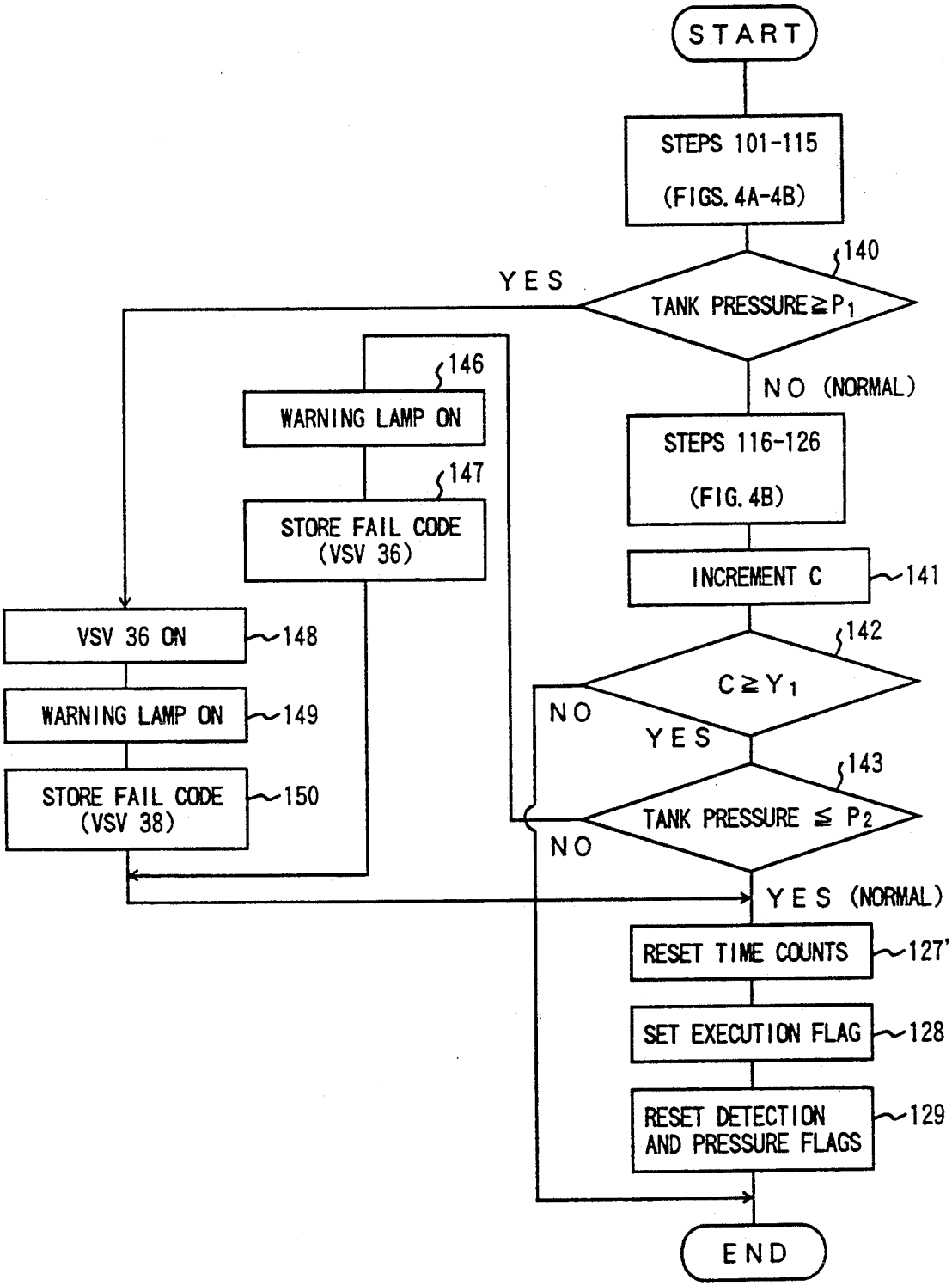
FIG. 7 is a flow chart for explaining another modified malfunction detecting process performed by the apparatus shown in FIG. 2.

FIG. 7 shows another modified malfunction detecting process performed by the apparatus shown in FIG. 2. In FIG. 7, the steps which are the same as the corresponding steps shown in FIGS. 4A and 4B are omitted. In the malfunction detecting device disclosed in U.S. patent application No. 895,102 mentioned above, there is a problem in that the negative pressure of the system between the first control valve and the fuel tank becomes excessively low when a malfunction occurs in the first control valve having the opened condition. The fuel tank may crack due to the excessively low pressure occurring in the system. Also, in the above mentioned device, there is a problem in that, if a malfunction occurs in the second control valve having the closed condition, the fuel vapor in the canister overflows due to the clogging of the air inlet hole of the canister. The air-fuel mixture in the intake passage may become too rich due to the overflowing of the fuel vapor from the canister, thereby making the driveability and the exhaust emission worse.

In order to realize desired operations of the system, it is necessary to detects whether or not a malfunction occurs in the first control valve having the opened condition when the system is diagnosed by turning OFF the first and second control valves. Also, it is necessary to detect whether or not a malfunction occurs in the second control valve having the closed condition after the system has been diagnosed.

In the flow chart shown in FIG. 7, after the VSV 38 is turned OFF in step 115, step 140 detects whether or not the internal pressure of the fuel tank 30 is greater than a prescribed first pressure P1 ($P1<Z<Po$), (this comparison is made by using the absolute values). If step 140 detects that the internal pressure of the fuel tank 30 is not greater than the first pressure Pl, it is determined that the system is normally operating and no malfunction occurs in the first control valve. The steps 117–126 which are the same as the corresponding steps in FIG. 4B are performed.

When a malfunction occurs in the VSV 38 (the first control valve) having the opened condition, the internal pressure of the fuel tank 30 decreases to a negative pressure below the first pressure Pl after the step 115 is performed. Thus, if it is detected in step 140 that the internal pressure of the fuel tank 30 is greater than the first pressure Pl, it is determined that the VSV 38 malfunctions. Step 148 turns ON the VSV 36 (the first control valve). Step 149 turns ON the warning lamp 41 to inform a vehicle driver of the malfunction having occurred in the VSV 38. Step 150 stores a fail code (regarding the malfunction of the VSV 38) in the backup RAM 53.

In the step 148, the VSV 36 is turned ON to open the air inlet 36*a* of the canister 33. The canister 33, the vapor passage 32, and the fuel tank 30 are subjected to the atmospheric pressure via the opened air inlet 36*a* of the canister 33. It is possible to prevent the internal pressure of the fuel tank 30 from being excessively low, thus preventing the fuel tank 30 from cracking due to the excessively low pressure in the fuel tank 30.

In the step 126, the second control valve (the VSV 36) is turned ON. When the second control valve is normally operating, the second control valve is opened, and the system is subjected to the atmospheric pressure Po via the air inlet 36*a* of the canister 33 so that the internal pressure of the fuel tank 30 rapidly increases to a positive pressure above the atmospheric pressure Po. Step 141 increments a time count C. Step 142 detects whether or not the time count C is greater than a prescribed time period Y1 (in seconds). If it is detected in step 142 that the time count C is not greater than the time Y1, the process ends.

The process is periodically re-started, and it is detected at the subsequent attempt of step 142 that the time count C is greater than the time period Y1. After the time count C is greater than the time period Y1, step 143 detects whether or not the internal pressure of the fuel tank 30 is smaller than a prescribed second pressure P2 ($Z<P2<Po$), (the comparison of the negative pressures is made using the absolute values).

When the first and second control valves are normally operating, the internal pressure of the fuel tank 30 after the time period Y1 has elapsed since the second control valve is opened is smaller than the second pressure P2. Thus, if no malfunction occurs in the second control valve, it is detected in step 143 that the internal pressure of the fuel tank 30 is smaller than the second pressure P2. Step 127′ resets the time counts A and C to the value "0". Step 128 sets the execution flag to the value "1". Step 129 resets the detection and pressure flags to the value "0", and the process ends. After the step 128 is performed, step 101 always detects that the execution flag is the value "1" and the process immediately ends, even if the process is re-started. So far as the operation of the engine is stopped and again started, the modified malfunction detecting process shown in FIG. 7 is not executed.

In the modified malfunction detecting process shown in FIG. 7, the step 126 switches ON the VSV 36 (the second control valve). When a malfunction occurs in the VSV 36 having the closed condition, the fuel tank 30 is not subjected to the atmospheric pressure via the air inlet 36*a* of the canister 33 due to the closed condition of the VSV 36. The internal pressure of the fuel tank 30 gradually increases to the atmospheric pressure Po. Thus, the internal pressure of the fuel tank 30 after the time period Y1 has elapsed since the VSV 36 is turned ON is not smaller than the second pressure P2.

If it is detected in step 143 that the internal pressure of the fuel tank 30 is not smaller than the second pressure P2, it is determined that a malfunction occurs in the VSV 36 having the closed condition. Step 146 turns ON the warning lamp 41 to inform a vehicle driver of the malfunction having occurred in the second control valve. Step 147 stores a fail code (regarding the malfunction of the VSV 36) in the backup RAM 53, and the process ends.

Figure 8:
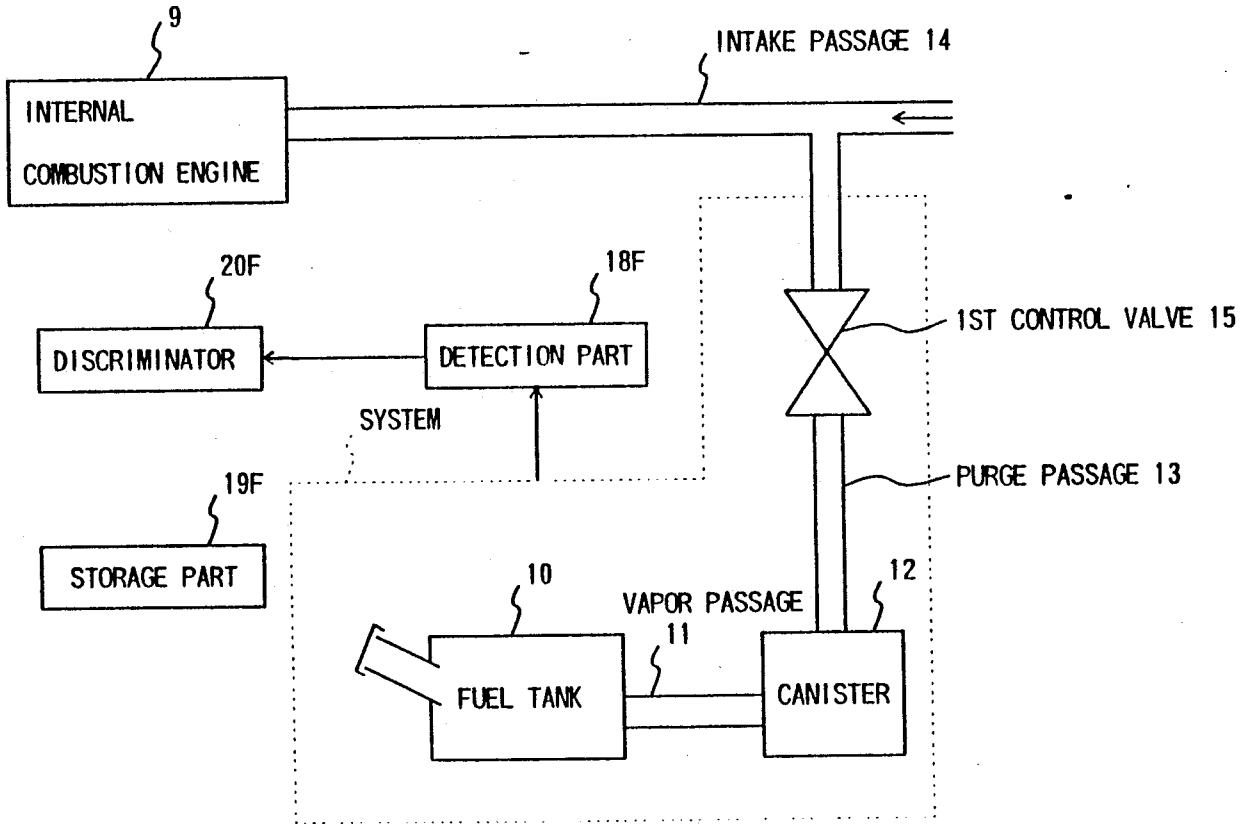
FIG. 8 is a block diagram showing a modified malfunction detecting apparatus according to the present invention.

FIG. 8 shows a modified malfunction detecting apparatus according to the present invention. In FIG. 8, the parts which are the same as the corresponding parts shown in FIG. 2 are designated by the same reference numerals, and a description thereof will be omitted.

In the device disclosed in U.S. patent application Ser. No. 895,102 mentioned above, it is possible to detect whether or not a malfunction occurs in the evaporated fuel purge system between the first control valve and the fuel tank. However, it is difficult to locate a specific portion of the system where the malfunction actually occurs. Therefore, relatively long time is required to repair the system after the malfunction is detected. In the malfunction detecting apparatus shown in FIG. 8, a set of standard pressure values used in the malfunction detecting process performed for each of specified portions of the system is stored, in order to eliminate the problem of the device mentioned above.

In the apparatus shown in FIG. 8, a detection part 18F detects a pressure of the system including the fuel tank 10, the vapor passage 11, the canister 12, the purge passage 13, and the first control valve 15 when the system is diagnosed. A set of standard pressure values used in the malfunction detecting process performed for each of specified portions of the system is stored in a storage part 19F. When a malfunction occurs in the system, a discriminator 20F locates a portion of the system where the malfunction has occurred, by comparing the detected pressure from the detection part 18F with corresponding one of the standard pressure values stored in the storage part 19F. Each of the standard pressure values is predetermined in accordance with a value of the pressure of the system sensed by the detection part 18F when it is detected that a malfunction occurs at a corresponding portion of the system.

Figure 9:
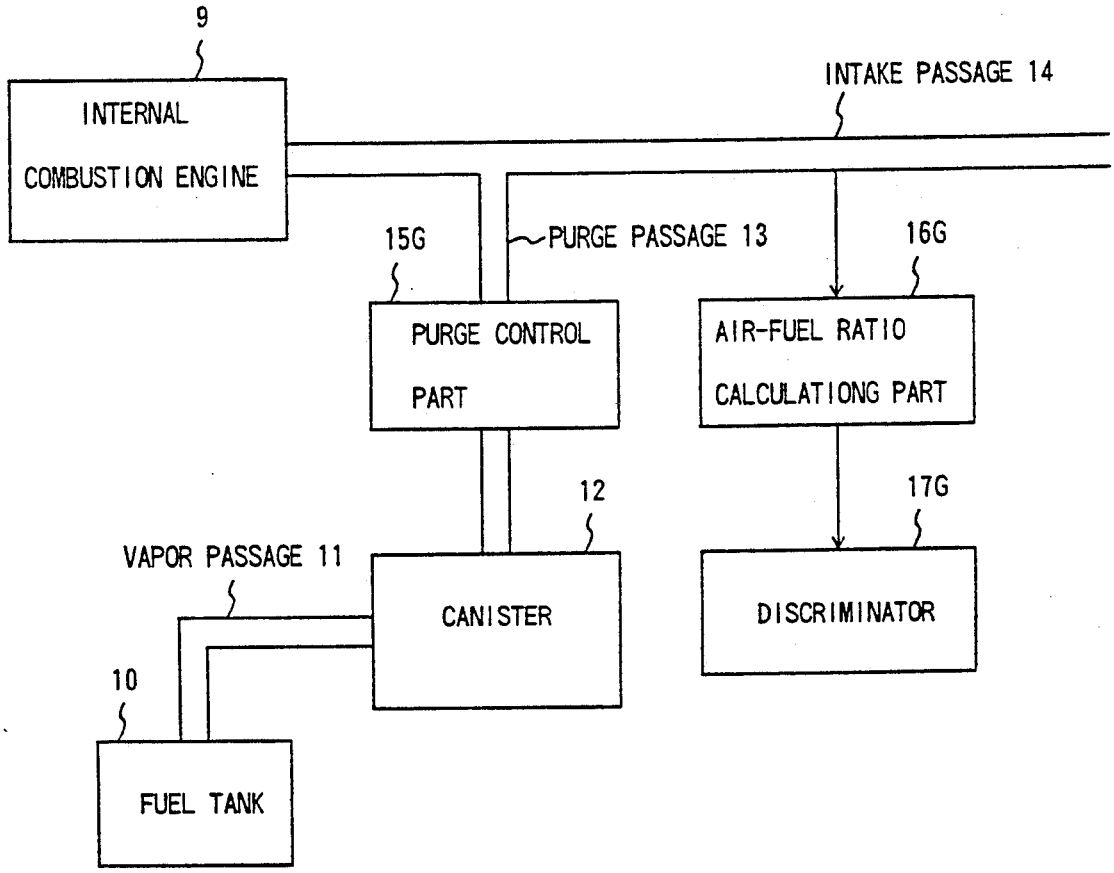
FIG. 9 is a block diagram showing another modified malfunction detecting apparatus according to the present invention.

FIG. 9 shows another modified malfunction detecting apparatus according to the present invention. In FIG. 9, the parts which are the same as the corresponding parts shown in FIG. 2 are designated by the same reference numerals, and a description thereof will be omitted.

In the device disclosed in U.S. patent application Ser. No. 895,102 mentioned above, it is difficult to correctly detect whether or not a malfunction occurs in the first control valve which is opened and closed to control a flow of fuel vapor from the canister to the intake passage of the engine. When a malfunction occurs in the first control valve due to inclusion of foreign matter, the above mentioned device cannot correctly detect such a malfunction.

In the malfunction detecting apparatus shown in FIG. 9, more than three different flows of fuel vapor fed from the canister 12 to the intake passage 14 are set, and an air-fuel ratio of the intake passage 14 is sensed for each flow of the fuel vapor, in order to correctly detect whether or not a malfunction occurs in the first control valve.

In the apparatus shown in FIG. 9, a purge control part 15G changes a flow of fuel vapor, fed from the canister 12 to the intake passage 14, to one of at least three different flows of the fuel vapor. An air-fuel ratio calculating part 16G calculates an air-fuel ratio of the mixture of the intake passage 14 for each flow of the fuel vapor produced by the purge control part 15G. A discriminator 17G detects whether or not a malfunction occurs in the first control valve of the purge control part 15G in accordance with the results of comparisons performed with the air-fuel ratios of the mixture of the intake passage 14 calculated by the air-fuel ratio calculating part 16G. The air-fuel ratios of the mixture of the intake passage 14 are varied depending on whether or not the purge flow control is normally performed. Thus, it is possible to correctly detect whether or not a malfunction occurs in the first control valve in the purge control part 15G.

Next, a description will be given of a second embodiment of the malfunction detecting apparatus according to the present invention, with reference to FIGS. 10–14.

In the malfunction detecting device disclosed in U.S. patent application Ser. No. 895,102 mentioned above, the system is diagnosed by turning OFF the second control valve and by turning OFF the first control valve after the system is subjected to a negative pressure. It is detected whether or not a malfunction occurs in the system, in accordance with the change of the pressure during the prescribed time period since the first control valve was OFF. However, the pressure of the system for a certain time after the second control valve is turned OFF is not stable due to the resistance to fuel flow in the system. Therefore, the pressure of the system sensed immediately after the second control valve is turned OFF and the first control valve is turned OFF is not reliable. Hence, the above mentioned device has a disadvantage in that it may erroneously detect a malfunction in the system due to the use of the pressure of the system sensed immediately after the first and second control valves are turned OFF.

Figure 10:
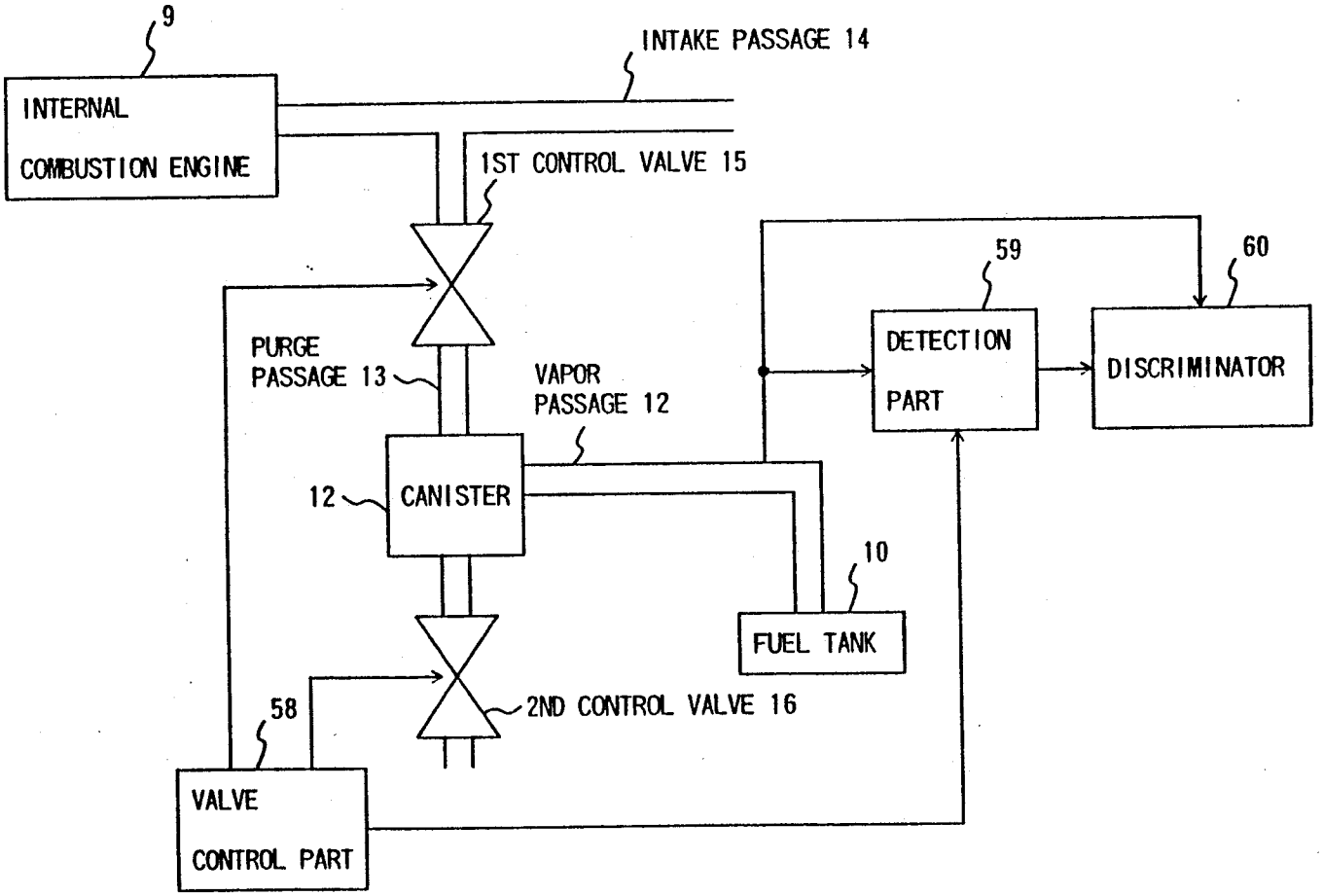
FIG. 10 is a block diagram showing a second embodiment of the malfunction detecting apparatus according to the present invention.

In order to eliminate the above mentioned disadvantage of the conventional device, the present invention proposes the second embodiment of the malfunction detecting apparatus. FIG. 10 shows the construction of this malfunction detecting apparatus. In FIG. 10, the parts which are the same as those corresponding parts shown in FIG. 2 are designated by the same reference numerals, and a description thereof will be omitted.

In the malfunction detecting apparatus shown in FIG. 10, a valve control part 58 turns OFF the second control valve 16 (or the VSV 36) to close the air inlet hole of the canister 12, and simultaneously turns ON the first control valve 15 (or the VSV 38) to open the purge passage 13, so that the purge passage 13, the canister 12, and the vapor passage 11 (included in the system) are subjected to the negative pressure of the intake passage 14 of the engine. After the pressure of the system reaches a prescribed reference pressure since the system was subjected to the negative pressure of the intake passage 14, the valve control part 58 turns OFF the first control valve 15.

A detection part 59 shown in FIG. 10 detects whether or not the pressure of the system is substantially stable after the first and second control valves 15 and 16 are closed by the valve control part 58. During a predetermined time period after the pressure of the system is detected as being substantially stable, a discriminator 60 detects whether or not a malfunction occurs in the system, in accordance with the pressure change rate derived from pressures of the system sensed at the start of the predetermined time period and at the end thereof.

Figure 11:
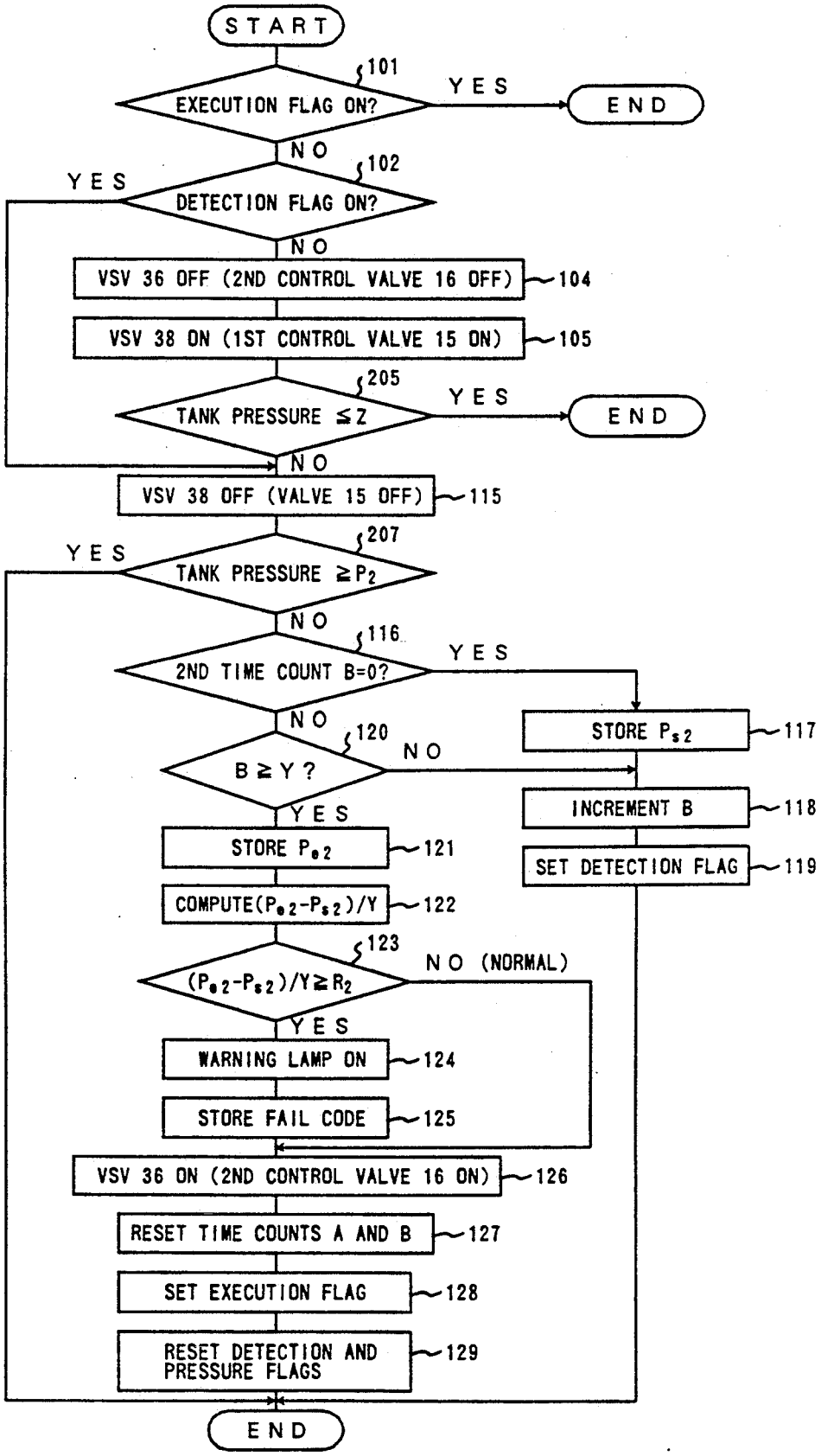
FIG. 11 is a flow chart for explaining a malfunction detecting process performed by the apparatus shown in FIG. 10.

FIG. 11 shows a malfunction detecting process performed by the apparatus of the second embodiment shown in FIG. 10. In FIG. 11, the steps which are the same as the corresponding steps shown in FIGS. 4A and 4B are designated by the same reference numerals.

In the malfunction detecting process shown in FIG. 11, the steps 101–105 are the same as the corresponding steps shown in FIG. 4A, and a description thereof will be omitted. After the second control valve 16 is turned OFF and the first control valve 15 is turned ON, step 205 detects whether or not the tank internal pressure, sensed by the pressure sensor 40, is smaller than a predetermined negative pressure Z (Pa). It should be noted that the above comparison of negative pressures is made using the absolute values. If the tank internal pressure is smaller than the negative pressure Z, the process ends without performing other steps. The process is periodically re-started at the time intervals of 65 msec. The steps 101–105 and 205 are thus repeated until the tank internal pressure reaches or is greater than the negative pressure Z, as shown in FIG. 5.

If step 205 detects the tank internal pressure (the absolute value) as being greater than the negative pressure Z (the absolute value), step 115 switches OFF the VSV 38 (the first control valve 15) to close the purge passage. At this time, if no malfunction occurs in the system, the tank internal pressure gradually changes from the negative pressure Z and approaches the atmospheric pressure Po, as shown in FIG. 5.

After the first control valve 15 is switched OFF, step 207 detects whether or not the tank internal pressure, sensed by the pressure sensor 40, is greater than a predetermined reference pressure P2 (Pa) ($Z<P2<Po$). The valve control part 58 of the second embodiment is realized by performing steps 104–105 and 205 shown in FIG. 11, and the detection part 59 is realized by performing step 207 shown in FIG. 11.

The reference pressure P2 is predetermined so as to be a negative pressure at which the pressure of the system is substantially stable if the tank internal pressure is greater than that pressure after the first and second control valves are turned OFF. If step 207 detects that the tank internal pressure is not greater than the reference pressure P2, the process ends without performing other steps. The process is periodically re-started at the time intervals of 65 msec., and the steps 101–105, 205, 115, and 207 are repeated until the tank internal pressure is greater than the reference pressure P2.

After the tank internal pressure is greater than the reference pressure P2, steps 116–129 which are the same as the corresponding steps in FIG. 4B are performed. The discriminator 60 of the second embodiment described above is realized by performing the steps 116–129 shown in FIG. 11. Step 116 detects whether or not the time count B is the value "0". In the initial routine described above, the time count B is reset to zero (the value "0"), and, at the first attempt of step 116, it is detected that the time count B is the value "0", and the next step 117 is taken.

Step 117 stores a pressure value Ps2, indicated by the pressure signal from the pressure sensor 40, in the memory of the microcomputer. This pressure value Ps2 is obtained from the pressure sensor 40 which senses a pressure of the system when a malfunction detecting process has started (corresponding to a time point t4 shown in FIG. 5) since the first control valve 15 was turned OFF. Step 118 increments the time count B, step 119 sets the detection flag ON (the value "1"), and the process ends. The process is periodically re-started at the time intervals of 65 msec, but step 102 detects, at the subsequent attempt, that the detection flag is ON. Only the steps 115, 207 and 116 are taken, and step 116 detects that the time count B is not the value "0", so that the next step 120 is taken.

Step 120 shown in FIG. 11 detects whether or not the time count B is greater than a predetermined time period Y (corresponding to the period between the time points t4 and t5 shown in FIG. 5). If the time count B is not greater than the time period Y, the steps 118–119 are taken and the process ends. The process is periodically re-started at the time intervals of 65 msec. The steps 101–102, 115–116, 205, 207, 120, and 118–119 are repeated until the time count B is greater than the time period Y.

If it is detected that the time count B is greater than the time period Y, step 121 stores a pressure value Pe2, indicated by the pressure signal from the pressure sensor 40, in the memory of the microcomputer. This pressure value Pe2 is obtained from the pressure sensor 40 which senses a pressure of the system at the end of the time period Y. Step 122 computes the pressure change rate of the system during the time period, the rate of pressure change being represented by a formula: $(Pe2-Ps2)/Y$. From the stored pressure values Ps2 and Pe2 and the time period Y, the pressure change rate is calculated in accordance with the formula mentioned above.

Step 123 detects whether or not the value of the pressure change rate $(Pe2-Ps2)/Y$ of the system is greater than a predetermined reference value R2. If the pressure change rate is greater than the reference value R2, step 124 switches ON the warning lamp so that a vehicle driver is informed of a malfunction occurring in the system. The pressure change rate of the system is too great due to the malfunction such as a leakage having occurred in the system. Step 125 stores a fail code that is used to fix the cause of the malfunction, in the memory of the microcomputer.

If step 123 detects that the pressure change rate of the system is not greater than the reference value R2, it is determined that no malfunction occurs in the system. At this time, the next step 126 is taken without performing the steps 124–125. Step 126 turns ON the VSV 36 (the second control valve 16) to make the air inlet of the canister open to the atmosphere. Step 127 resets the time count B to the value "0". Step 128 sets the execution flag to the value "1". Step 129 resets the detection flag to the value "0", and the process ends. If step 128 is performed, even when the process is re-started, step 101 detects the execution flag as being the value "1", so that the process immediately ends without performing other steps.

If the second control valve 16 is turned ON, in step 126, at the time point t5 shown in FIG. 5, the tank internal pressure rapidly changes to the atmospheric pressure due to the external air entering from the air inlet of the canister to the system. In the second embodiment described above, the malfunction detecting process is performed during the time period Y (sec.) after the tank internal pressure reaches the reference pressure P2 (which is substantially stable) since the first and second control valves 15 and 15 are turned OFF. It is detected whether or not a malfunction occurs in the system, in accordance with the pressure change rate derived from pressures of the system sensed at the start of the time period Y and at the end thereof. Therefore, it is possible to reliably and correctly detect a malfunction in the system.

In the apparatus shown in FIG. 10, the pressure sensor for sensing a pressure of the system can be mounted on the fuel tank, or at the intermediate portion of the vapor passage (as shown in FIG. 2). If the pressure sensor is mounted in the vapor passage, the pressure of the system sensed by the pressure sensor varies depending on the resistance of the vapor passage to fuel flow. Generally, when the system is subjected to a negative pressure and the pressure of the system is decreasing, the negative pressure (the absolute value) of the vapor passage (indicated by a dotted line in FIG. 12) becomes somewhat higher than the tank internal pressure (the absolute value) indicated by a solid line in FIG. 12. Taking into account the point of the above mentioned view, the malfunction detecting process of the second embodiment is modified as described below, in order to increase the accuracy of malfunction detection.

Figure 12:
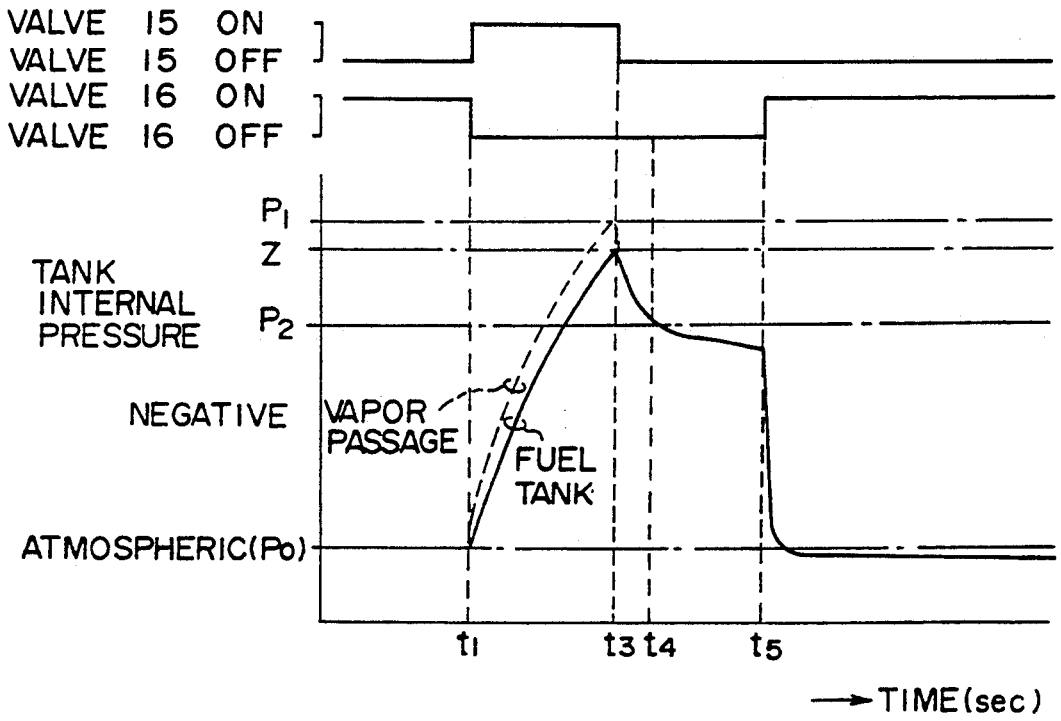
FIG. 12 is a time chart for explaining the change of the tank internal pressure when the malfunction detecting process is performed.

As shown in FIG. 12, immediately when a pressure of the vapor passage sensed by the pressure sensor 40 reaches a predetermined reference pressure P1 (Pa) ($P1<Z$) in a condition in which the VSV 38 (the first control valve 15) is ON and the VSV 36 (the second control valve 16) is OFF, the first control valve 15 is turned OFF. Once the first control valve 15 is turned OFF, the vapor passage pressure rapidly changes to a pressure substantially equal to the tank internal pressure. Thus, the malfunction in the system can be more correctly detected by performing the malfunction detecting process described above.

Figure 13:
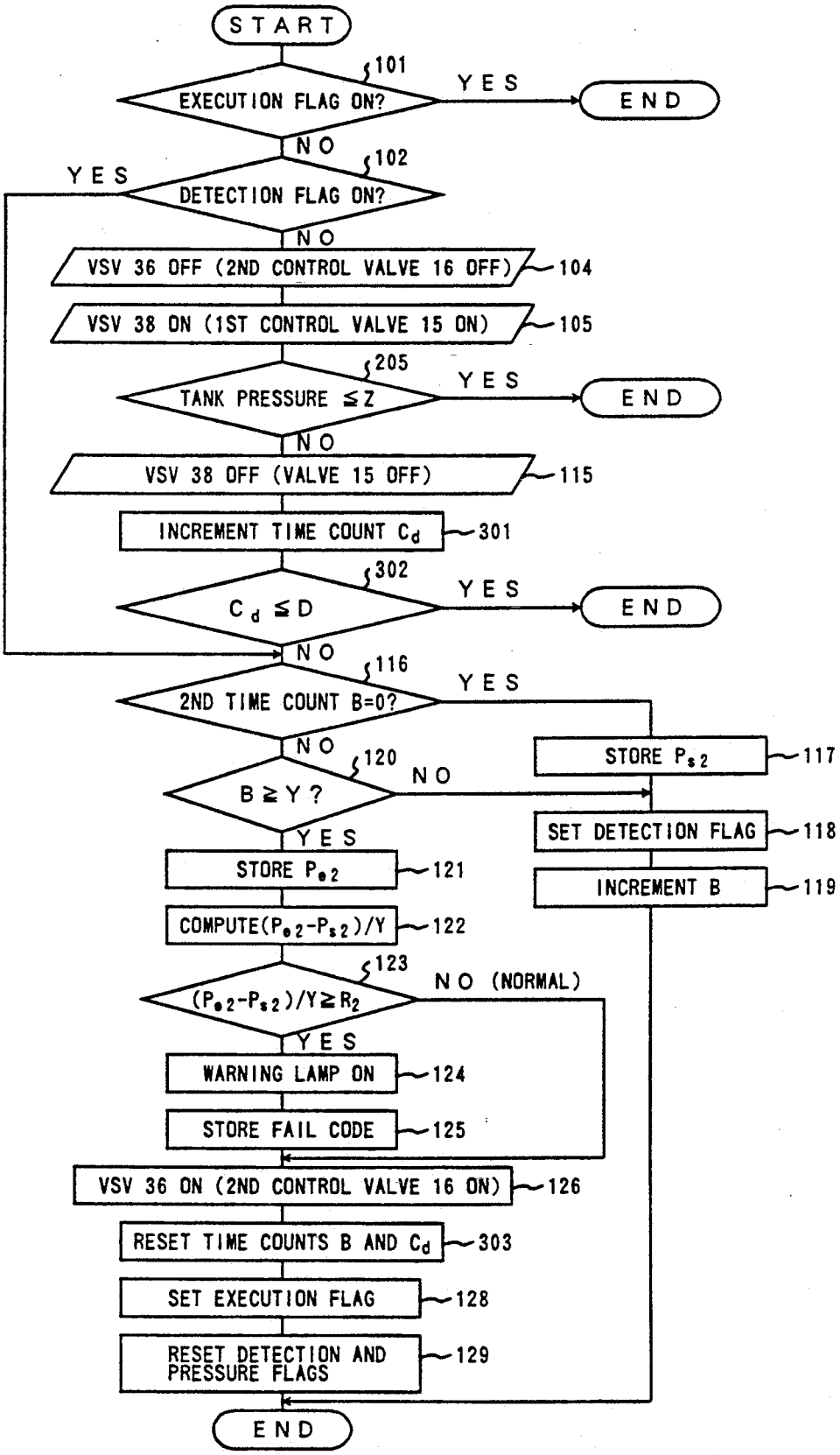
FIG. 13 is a flow chart for explaining a modified malfunction detecting process performed by the apparatus shown in FIG. 10.
Figure 14:
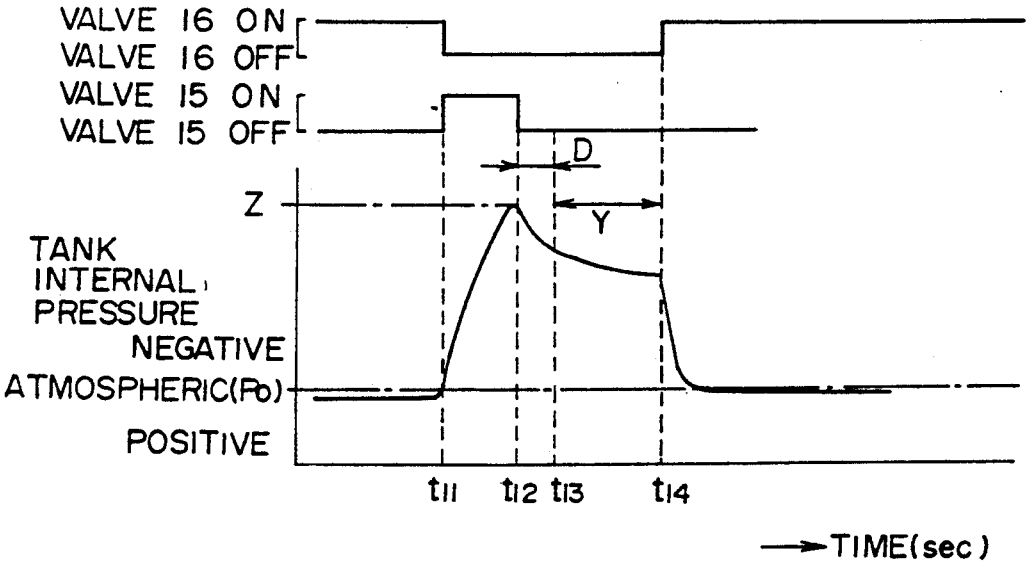
FIG. 14 is a time chart for explaining the change of the tank internal pressure when the modified malfunction detecting process is performed.

FIG. 13 shows a modified malfunction detecting process performed by the apparatus shown in FIG. 10. In FIG. 13, the steps which are the same as the corresponding steps shown in FIG. 11 are designated by the same reference numerals, and a description thereof will be omitted. FIG. 14 shows the change of the tank internal pressure when the process shown in FIG. 13 is performed.

As shown in FIG. 14, at a time point t11, the VSV 36 (the second control valve 16) is turned OFF and simultaneously the VSV 38 (the first control valve 15) is turned ON. The tank internal pressure rapidly changes to a negative pressure from the atmospheric pressure. When the tank internal pressure reaches the predetermined negative pressure Z, the VSV 38 is turned OFF at a time point t12 as shown in FIG. 14. At this time point t12, both the first and second control valves 15 and 16 (the VSVs 36 and 38) are OFF. The above mentioned steps are the same as the corresponding steps shown in FIG. 11.

In the process shown in FIG. 13, step 301 increments a delay time count Cd, and step 302 detects whether or not the delay time count Cd is smaller than a prescribed time period D (in seconds). This time period D is predetermined to be a time period required for the tank internal pressure to be a substantially stable pressure since the time point t12 the first and second control valves 15 and 16 are OFF.

When the delay time count Cd is smaller than the time period D, the process ends without performing other steps. The process is periodically re-started at the time intervals of 65 msec, and the steps 101–105, 205, 115, 301–1032 are repeated until the delay time count Cd reaches the time period D. At a time point t13 shown in FIG. 14, the delay time count Cd reaches the time period D. Then, the steps 116–119 shown in FIG. 13 are performed to start the malfunction detecting process. In step 117, a pressure Ps2 of the system sensed by the pressure sensor at the start of the time period Y of the malfunction detection is stored in the memory of the microcomputer.

The steps 120–122 shown in FIG. 13 which are the same as the corresponding steps in FIG. 11 are performed. In step 121, a pressure Pe2 of the system sensed by the pressure sensor when the time period Y has elapsed since the time period t13, is stored in the memory of the microcomputer. At a time point t14 shown in FIG. 14, a pressure change rate $(Pe2-Ps2)/Y$ of the system is computed from the stored pressures Ps2 and Pe2 of the system and the time period Y. Step 123 detect whether or not the pressure change rate thus computed is greater than a predetermined reference value R2.

When step 123 detects that the pressure change rate is not greater than the reference value R2, it is determined that no malfunction occurs in the system. When step 123 detects that the pressure change rate is greater than the reference value R2, it is determined that a malfunction occurs in the system. If the malfunction occurs in the system, the warning lamp is turned ON and a fail code is stored in the system.

Step 126 shown in FIG. 13 turns ON the second control valve 16 to open the air inlet of the canister. Step 303 resets the time count B and the delay time count Cd to the value "0" (OFF). Step 128 sets the execution flag to the value "1" (ON). Step 129 resets the detection flag to the value "0" (OFF).

In the modified malfunction detecting process described above, when the time period D has elapsed since the valves 15 and 16 are OFF, it is confirmed that the pressure of the system (including the purge passage and the fuel tank) reaches a substantially stable pressure. After the confirmation is made, the tank internal pressure is sensed and the pressure change rate is computed from the sensed pressures. Thus, it is possible to reliably and correctly detect a malfunction in the system.

Next, a description will be given of a third embodiment of the malfunction detecting apparatus according to the present invention, with reference to FIGS. 15–20.

There has been proposed a malfunction detecting device which is disclosed in Japanese Patent Application No. 3-323364. This malfunction detecting device includes a vapor passage connecting a fuel tank and a canister, a purge passage connecting the canister and an intake passage of an engine, and a bypass passage connecting the vapor passage and the purge passage. A purge control valve is provided in the purge passage to control a flow of fuel vapor from the canister to the intake passage. A pressure control check valve is provided at the canister to supply fuel vapor from the fuel tank to the canister only when an internal pressure of the fuel tank is higher than a reference pressure. A control valve is provided at an intermediate portion of the bypass passage to control a flow of fuel vapor in the bypass passage. A pressure sensor is provided at an intermediate portion of the vapor passage to sense a pressure of the vapor passage. Operations of the purge control valve, the pressure control check valve and the control valve are controlled by an engine control unit (ECU).

In the above mentioned device, when the system is diagnosed, the control valve in the bypass passage is opened so as to subject the purge passage, the bypass passage, and the vapor passage to a negative pressure of the intake passage. In this condition, when a pressure of the system sensed by the pressure sensor does not reach a prescribed negative pressure, it is determined that a malfunction occurs in the system.

However, in the above mentioned device, the fuel tank is subjected to the negative pressure of the intake passage when the system is diagnosed. The internal pressure of the fuel tank at this time decreases, and fuel vapor within the fuel tank is fed to the vapor passage and the bypass passage so that the fuel vapor is supplied from the purge passage to the intake passage. Thus, the exhaust emission when the system is diagnosed deteriorates due to the supply of additional fuel vapor to the intake passage.

In the third embodiment of the present invention, a first portion of the system including the purge passage, the first control valve, the canister and the vapor passage from the canister to a check valve, and a second portion of the system including the fuel tank and the vapor passage from the check valve to the fuel tank are separately diagnosed by sensing a pressure of one of the first and second portions, in order to reliably and correctly diagnose the system and improve the exhaust emission during the diagnostic process.

Figure 15:
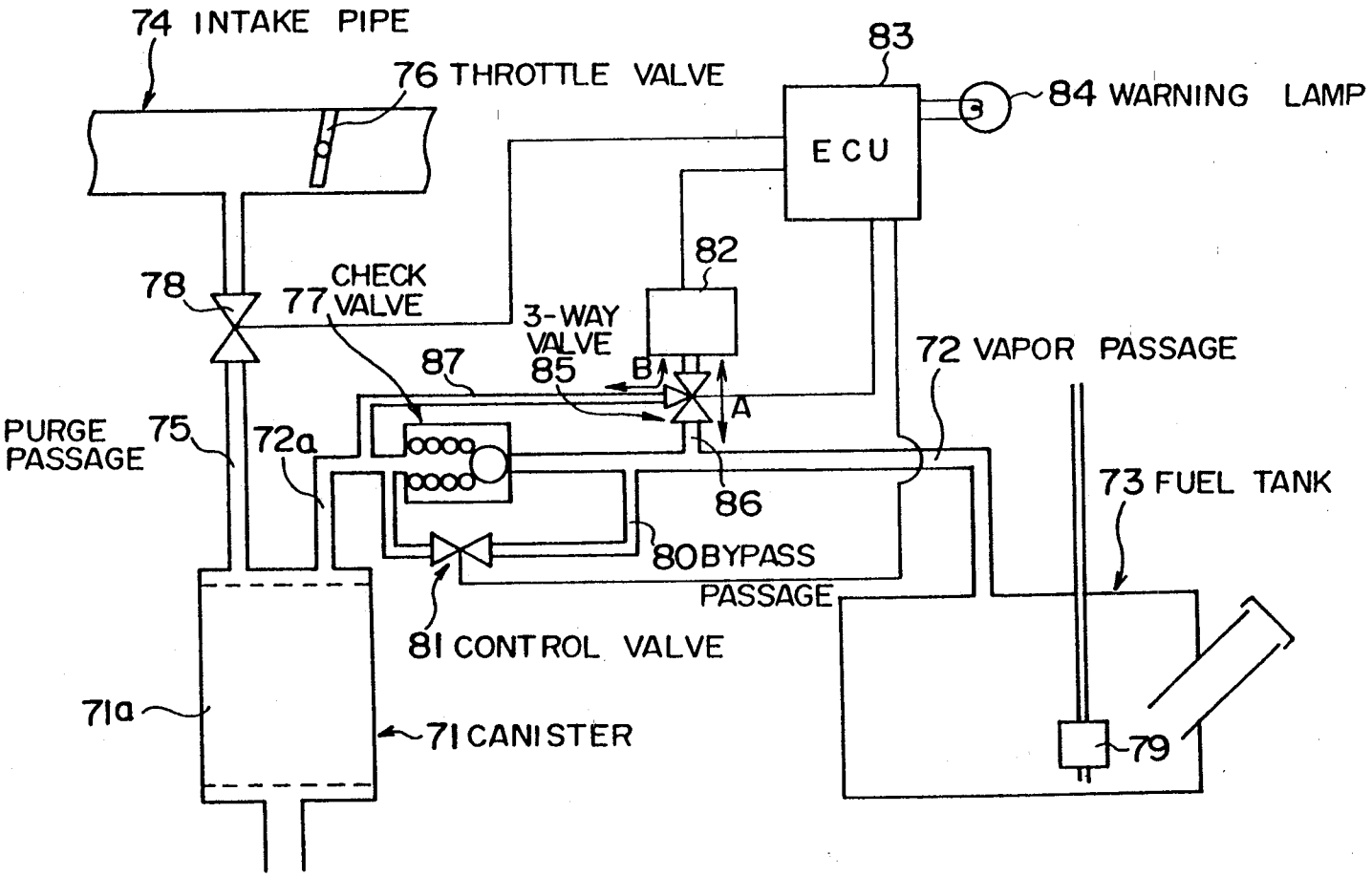
FIG. 15 is a diagram showing a third embodiment of the malfunction detecting apparatus according to the present invention.

FIG. 15 shows the construction of the third embodiment of the malfunction detecting apparatus according to the present invention. In the apparatus shown in FIG. 15, fuel vapor from a fuel tank 73 is fed to a canister 71 via a vapor passage 72, and the fuel vapor is absorbed in an absorbent 71*a* such as active carbon in the canister 71. At a portion of the vapor passage 72, a pressure control check valve 77 to control a flow of fuel vapor from the fuel tank to the canister. Fuel vapor from the fuel tank 73 is stored in the absorbent 71*a* of the canister 71.

The pressure control check valve 77 is opened so as to feed the fuel vapor from the fuel tank to the canister, when an internal pressure of the vapor passage 72 and the fuel tank 73 reaches a prescribed negative pressure. When the internal pressure does not reach the prescribed negative pressure, the check valve 77 is closed, and it is possible to prevent the canister 71 from storing too much fuel vapor fed from the fuel tank 73.

When an engine is operating in a prescribed operating condition, an intake pipe 74 of the engine is subjected to a negative pressure. The operating condition of the engine is controlled in accordance with a position of a throttle valve 76 in the intake pipe 74. The fuel vapor, stored in the canister 71, is fed into the intake pipe 74 via a purge passage 75 due to the negative pressure of the intake pipe 74. A vacuum switching valve (VSV) 78 which is a type of a solenoid valve is provided in the purge passage 75 to control a flow of fuel vapor from the canister 71 to the intake pipe 74.

The evaporated fuel purge system to which the third embodiment of the present invention is applied includes the canister 71, the vapor passage 72, the fuel tank 73, the intake pipe 74, the purge passage 75, the pressure control check valve 77, and the VSV 78. The fuel tank 73 shown in FIG. 15 includes a fuel pump 79 for supplying fuel of the fuel tank to the engine.

The malfunction detecting apparatus further includes a bypass passage 80, a control valve 81 (a solenoid valve) provided in the bypass passage 80, a pressure sensor 82, an engine control unit 83, and a three-way valve 85. The bypass passage 80 is provided in the vapor passage 72 so as to passes around the pressure control check valve 77, and the bypass passage 80 is an alternative passage connecting the fuel tank 73 and the canister 71.

The control valve 81 is switched ON and OFF to open and close the bypass passage 80, so as to control a flow of fuel vapor in the bypass passage 80. More specifically, when the control valve 81 is switched OFF (closed), the fuel vapor from the fuel tank 73 is fed to the canister 71 via the check valve 77 in the vapor passage 72. When the control valve 81 is switched ON (opened), the fuel vapor from the fuel tank 73 passes around the check valve 77 and is fed to the canister 71 via the bypass passage 80.

As shown in FIG. 15, the pressure sensor 82 is connected to the three-way valve 85. One end of the three-way valve 85 is connected by a connecting pipe 86 to an intermediate portion of the vapor passage 72 between the check valve 77 and the fuel tank 73. The other end of the three-way valve 85 is connected by a connecting pipe 87 to the vapor passage 72 between the check valve 77 and the canister 71. According to the present invention, a first portion of the vapor passage 72 (designated by a reference numeral 72*a* in FIG. 15) between the canister 71 and the check valve 77, and a second portion of the vapor passage 72 between the check valve 77 and the fuel tank 73 are separately diagnosed by sensing a pressure of the first portion and a pressure of the second portion so that the system is correctly diagnosed and the exhaust emission during the diagnostic process is improved.

The switching of the three-way valve 85 to connect the pressure sensor 82 to either the first portion or the second portion is controlled by a control signal sent from the ECU 83. In other words, the pressure sensor 82 can be connected to one of the two portions of the vapor passage 72 by switching the three-way valve 86 according to the present invention. Therefore, the apparatus has two connecting conditions: in one connecting condition, the pressure sensor 82 is connected to the second portion of the vapor passage 72 via the three-way valve 85 as indicated by an arrow A in FIG. 15, and, in the other connecting condition, the pressure sensor 82 is connected to the first portion 72*a* of the vapor passage 72 via the three-way valve 86 as indicated by an arrow B in FIG. 15.

Thus, by using the pressure sensor 82 connected to the three-way valve 85, it is possible to sense separately a pressure of the first portion of the vapor passage and a pressure of the second portion thereof.

As shown in FIG. 15, the VSV 78, the control valve 81, the pressure sensor 82, and the three-way valve 85 are electrically connected to the ECU 83. The ECU 83 which has a microcomputer having a construction as shown in FIG. 3 carries out several control operations of the engine, and the control operations include air-fuel ratio control and fuel injection control. The malfunction detecting process to diagnose the evaporated fuel purge system according to the present invention is carried out by the ECU 83. The ECU 83 is connected to a warning lamp 84, and the warning lamp 84 is turned ON when a malfunction is detected in the system through the malfunction detecting process.

Figure 16:
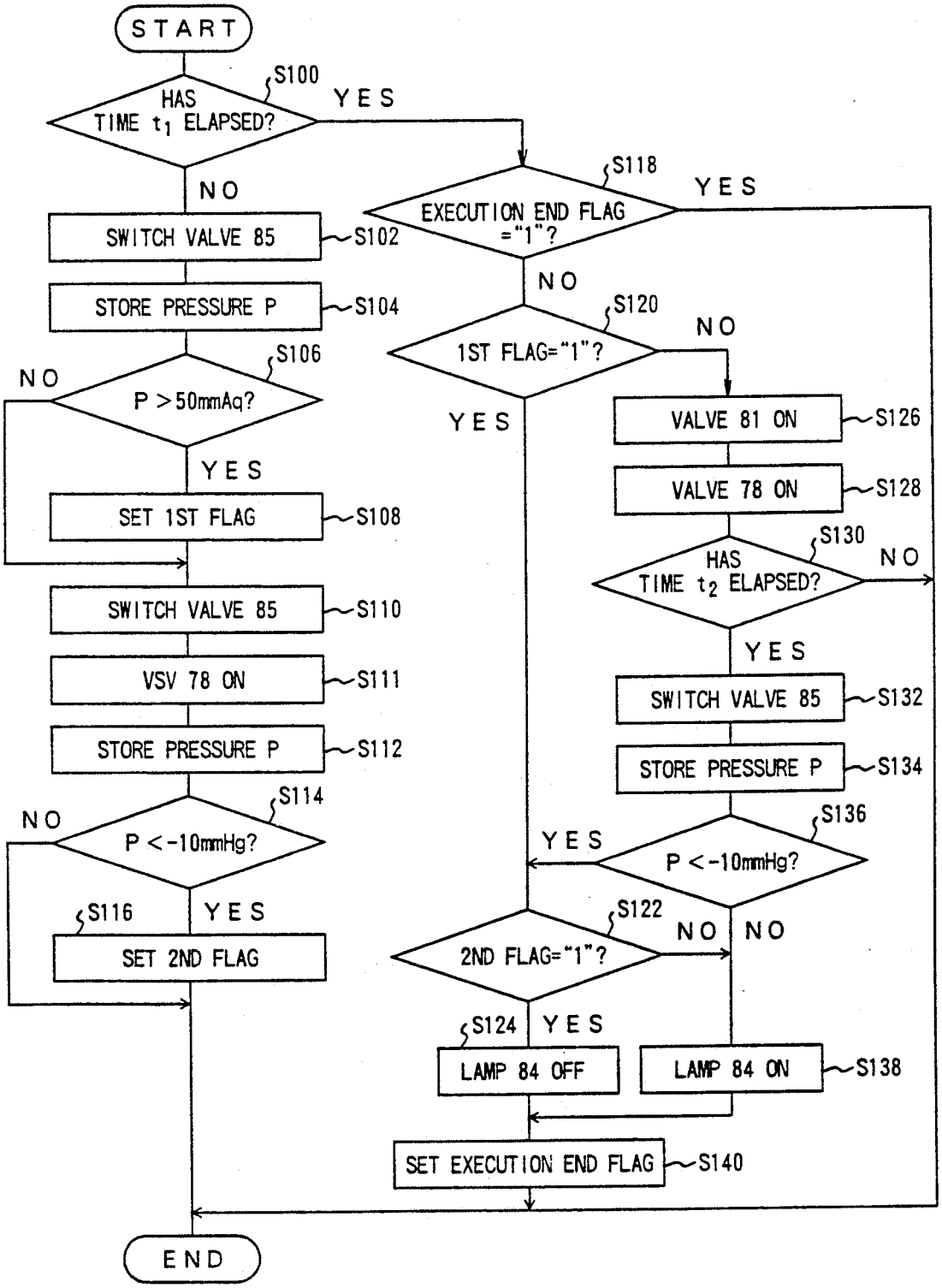
FIG. 16 is a flow chart for explaining a malfunction detecting process performed by the apparatus shown in FIG. 15.

FIG. 16 shows a malfunction detecting process performed by the apparatus shown in FIG. 15 using the ECU 83. This process is periodically executed at prescribed time intervals by making interrupts in a CPU of the ECU 83.

In the flow chart shown in FIGS. 16, step S100 detects whether or not a prescribed time t1 (e.g., 1 sec.) has elapsed since the engine starts operation. The reason for this waiting time is that a certain time is required until fuel is evaporated in the fuel tank. If it is detected that the prescribed time t1 has not elapsed, the next step S102 is taken. If it is detected that the prescribed time t1 has elapsed, the next step S118 is taken.

When the time t1 has not elapsed since the engine starts operating, the steps S102–S108 (hereinafter called a first diagnostic procedure) are performed to detect whether or not a malfunction occurs in the system, by sensing a pressure of the second portion of the vapor passage including the fuel tank. The steps S110–S116 (hereinafter called a second diagnostic procedure) are performed to detect whether or not a malfunction occurs in the system by sensing a pressure of the first portion of the vapor passage including the canister. These steps are repeatedly performed until the time t1 has elapsed.

The principle of the first diagnostic procedure which is performed using a sensed pressure of the second portion will be described. When the system is normally operating, the internal pressure of the system from the second portion of the vapor passage 72 to the fuel tank 73 is higher than a prescribed first pressure if the control valve 81 is switched OFF (closed). The fuel tank 73 contains a certain amount of fuel, and the fuel is evaporated from the fuel tank. However, when a malfunction such as a leakage occurs in the vapor passage 72, the internal pressure mentioned above does not reach the first pressure. Therefore, it is possible to detect whether or not a malfunction occurs in the system, by sensing a pressure of the second portion including the fuel tank 73.

The principle of the second diagnostic procedure which is performed using a sensed pressure of the first portion will be described. When the VSV 78 is switched ON and the system is normally operating, the purge passage 75, the canister 71, and the first portion 72*a* of the vapor passage 72 are subjected to a negative pressure of the intake pipe 74. If the control valve is switched OFF (closed), the internal pressure of the system from the purge passage 75 to the first portion 72*a* is lower than a prescribed second pressure. However, when a malfunction such as a leakage occurs in the purge passage 75, the internal pressure mentioned above is not lower than the second pressure. Therefore, it can be detected whether or not a malfunction occurs in the system, by sensing a pressure of the first portion including the canister 71.

In step S102 shown in FIG. 16, the three-way valve 85 is switched by a signal from the ECU 83 to connect the pressure sensor 82 to the second portion of the vapor passage 72 via the connecting pipe 86 (as indicated by the arrow A in FIG. 15). The control valve 81 is initially OFF to close the bypass passage 80. Step S104 stores a pressure P of the system, sensed by the pressure sensor 82, in a memory of the ECU 83. When the three-way valve 85 is in this condition, the connecting pipe 87 is disconnected from the vapor passage 72, preventing the fuel vapor of the fuel tank from being fed to the intake pipe 74 via the connecting pipe 87. It is possible to prevent the exhaust emission from becoming worse during the diagnostic process.

After the pressure P is stored in the ECU 83, step 106 detects whether or not the pressure P is higher than the prescribed first pressure (50 mm $H_2O$). If it is detected that the pressure P is higher than the first pressure, step S108 sets a first flag to the value "1". If it is detected that the pressure P is not higher than the first pressure, the next step S110 is taken without setting the first flag. Initially, the first flag is the value "0", and, when the first flag is not set in step S108, the first flag is the value "0".

Thus, when the first flag is the value "1", it is determined that no malfunction occurs in the system, and, when the first flag is the value "0", it is determined that a malfunction occurs in the system (the second portion).

After the first diagnostic procedure described above is finished, step S110 switches, by means of a signal from the ECU 83, the three-way valve 85 so as to connect the pressure sensor 82 to the first portion 72*a* of the vapor passage 72 via the connecting pipe 87 (as indicated by the arrow B in FIG. 15).

Step S111 switches ON the VSV 78 to open the purge passage 75. The system including the canister 71 is subjected to the negative pressure of the intake pipe 74. Step S112 stores a pressure P of the system, sensed by the pressure sensor 82, in the memory of the ECU 83. When the three-way valve 85 is in this condition, the connecting pipe 86 is disconnected from the connected pipe 87. The fuel tank 73 is not subjected to the negative pressure of the intake pipe 74 after the VSV 78 is switched ON, and the fuel vapor from the fuel tank 73 is not fed to the canister 71, preventing the fuel vapor of the fuel tank from being fed to the intake pipe 74 via the connecting pipe 87. It is possible to prevent the exhaust emission from becoming worse during the diagnostic process.

After the pressure P is stored in the ECU 83, step 114 detects whether or not the pressure P is lower than the prescribed second pressure (−10 mm Hg). If it is detected that the pressure P is lower than the second pressure, step S116 sets a second flag to the value "1". If it is detected that the pressure P is not lower than the second pressure, the second diagnostic procedure ends without setting the second flag. Initially, the second flag is the value "0".

Therefore, when the second flag is the value "1", it is determined that no malfunction occurs in the system, and, when the second flag is the value "0", it is determined that a malfunction occurs in the system (the first portion).

When the step S100 detects that the time t1 has elapsed since the engine starts operating, the next step S118 is taken. Step S118 detects whether or not an execution end flag is the value "1". If the execution end flag is the value "1", the process ends without performing other steps. Initially, the execution end flag is the value "0". After the steps S120–S138 are performed, the execution end flag is set to the value "1". Step S120 detects whether or not the first flag is the value "1". If the first flag is the value "1", step S122 detects whether or not the second flag is the value "1". If the second flag is the value "1", step S124 turns OFF the warning lamp 84 to inform a vehicle driver that no malfunction occurs in the system. Step S140 sets the execution end flag to the value "1".

When the step S120 detects that the first flag is not the value "1", the next step S126 is taken. At this time, it is determined that a malfunction occurs either in the system including the first portion 72*a* (the doubtful portion extending from the canister 71 to the intake pipe 74 or in the system including the second portion (the doubtful portion extending from the fuel tank 73 to the check valve 85). The steps S126–S136 are a confirmation procedure to check whether the malfunction actually occurs in the system. This procedure is performed by switching ON the control valve 81 to open the bypass passage 80 so that the second portion of the vapor passage 72 and the fuel tank 73 are subjected to the negative pressure of the intake pipe 74.

Step S126 switches ON the control valve 81 in the bypass passage so as to connect the canister 71 and the fuel tank 73 via the bypass passage 80. Step S128 switches ON the VSV 78 to open the purge passage 75, so that all the parts of the system are subjected to the negative pressure of the intake pipe 74. Step S130 whether or not a time period t2 has elapsed since the engine started operating. The reason for this waiting time is that a certain time period is required until all the parts of the system (the fuel tank 73) are subjected to the negative pressure of the intake pipe 74.

After the time period t2 has elapsed, step S312 switches, by a signal from the ECU 83, the three-way valve 85 so as to connect the pressure sensor 82 to the second portion of the vapor passage 72 via the connecting pipe 86 as indicated by the arrow A in FIG. 15. Step S134 stores a pressure of the system, sensed by the pressure sensor 82, in the memory of the ECU 83. Step S136 detects whether or not the pressure P is lower than the second pressure (−10 mm Hg).

If the pressure P is lower than the second pressure, it is finally determined that no malfunction occurs in the system. Step S122 detects whether or not the second flag is the value "1". If the second flag is the value "1", step S124 turns OFF the warning lamp 84 to inform a vehicle driver that no malfunction occurs in the system.

If the step S136 detects that the pressure P is not lower than the second pressure, it is determined that a malfunction occurs in the system. Step S138 turns ON the warning lamp 84 to inform a vehicle driver that the malfunction occurs in the system. After the steps S120–138 are performed, step S140 sets the execution end flag to the value "1", and the process ends.

In the above described third embodiment of the malfunction detecting apparatus, it is important that the fuel tank is not subjected to the negative pressure of the intake passage when the system is diagnosed. It is possible to correctly detect a malfunction in the system and it is possible to prevent the exhaust emission from deteriorating during the malfunction detecting process.

Figure 17:
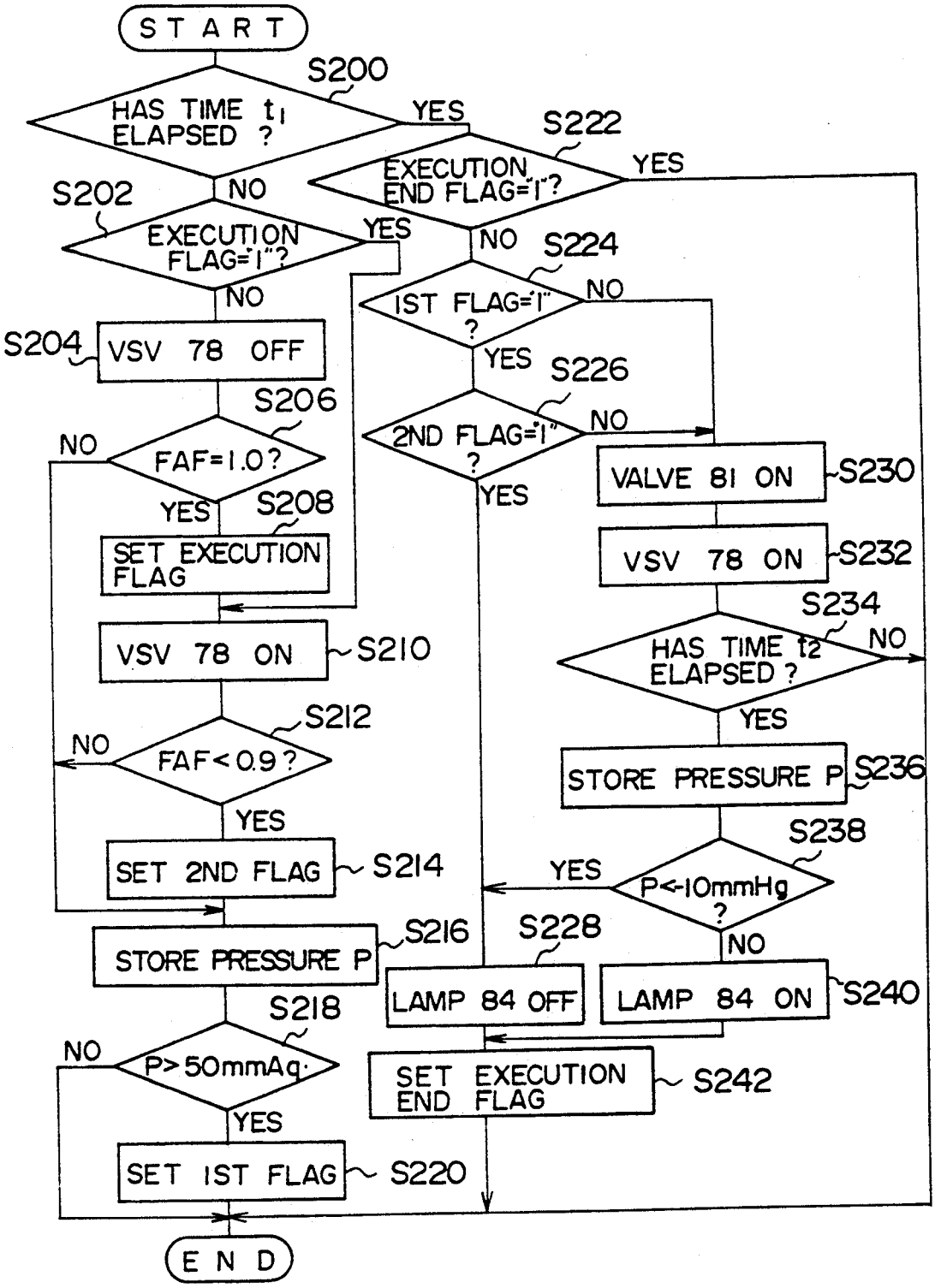
FIG. 17 is a flow chart for explaining a modified malfunction detecting process performed by the apparatus shown in FIG. 15.

By the malfunction detecting apparatus as shown in FIG. 15, which is applied to an evaporated fuel purge system having the pressure control check valve in the vapor passage, another malfunction detecting process can be performed for desired operations of the engine. FIG. 17 shows such a malfunction detecting process. In this process, a primary detection procedure (steps S202–214) to detect a malfunction in the first portion of the system, another primary detection procedure (steps 216–220) to detect a malfunction in the second portion of the system, and a secondary detection procedure (steps 230–240) to detect a malfunction in the system are performed.

In the flow chart shown in FIG. 17, step S200 detects whether or not a prescribed time t1 (e.g., 1 sec.) has elapsed since the engine starts operating. The reason for this waiting time is that a certain time is required until fuel is evaporated in the fuel tank. If it is detected that the prescribed time t1 has not elapsed, the next step S202 is taken. If it is detected that the prescribed time t1 has elapsed, the next step S222 is taken.

When the time t1 has not yet elapsed, the steps 202–214 are performed to detect whether or not a malfunction occurs in the first portion of the system, by sensing a change of a feedback correction factor FAF. The factor FAF is well known in the art and used in the air-fuel ratio control by the ECU 83.

Step S202 detects whether or not an execution flag is the value "1". This execution flag is, initially, set to the value "0". In the step S208 below, the execution flag is set to the value "1" if the requirement of the feedback correction factor FAF in step S206 is satisfied. Step S204 switches OFF the VSV 78 to close the purge passage 75. Fuel vapor fed from the canister 71 is not supplied to the intake pipe 74 via the purge passage 75, and the feedback correction factor FAF is not influenced by the fuel vapor from the canister 71.

Step S206 detects whether or not the feedback correction factor FAF from the ECU 83 is substantially stable around the average value "1.0". If the feedback correction factor FAF is not stable around the average value "1.0", it cannot be determined what is the cause of a change of the factor FAF in response to supply of fuel vapor from the canister to the intake pipe. In such a case, the next step S216 is taken without performing the subsequent steps S208–S214.

If the feedback correction factor FAF from the ECU 83 is substantially stable around the average value "1.0", step S208 sets the execution flag to the value "1". Step S210 switches ON the VSV 78 to open the purge passage 75. If the system, including the canister 71, the intake pipe 74, and the vapor passage between the canister and the pressure control check valve, is normally operating, fuel vapor from the canister 71 is supplied to the intake pipe 74 via the purge passage 75. In response to the supply of fuel vapor to the intake pipe, the feedback correction factor FAF changes (decreases) to a value lower than the average value "1.0" if no malfunction occurs in the system.

Step 212 detects whether or not the value of the feedback correction factor FAF is lower than a prescribed value (for example, 0.9). If the value of the factor FAF is lower than the prescribed value, step S214 sets the second flag to the value "1". If the value of the factor FAF is not lower than the prescribed value, the next step S216 is taken without performing the step S214.

Therefore, when the second flag is the value "1", it is determined that no malfunction occurs in the first portion of the system including the intake pipe 74, the purge passage 75, the canister 71, and the vapor passage **72*a*** between the canister and the check valve. Conversely, when the second flag is not the value "1", it is temporarily determined that a malfunction occurs in the first portion of the system.

After the step S214 is performed, another primary detection procedure (steps S216–S220) is performed to detect a malfunction in the second portion of the system (including the vapor passage between the fuel tank and the pressure control check valve, and the fuel tank). In step S216 shown in FIG. 17, a pressure P of the system sensed by the pressure sensor 82 is stored in the memory of the ECU 83. Step 218 detects whether or not the pressure P is higher than a prescribed first pressure (50 mm $H_2O$). If it is detected that the pressure P is higher than the first pressure, step S220 sets a first flag to the value "1". If it is detected that the pressure P is not higher than the first pressure, the process ends without performing other steps. Initially, the first flag is the value "0", and, when the first flag is not set in step S220, the first flag is the value "0". Therefore, if the first flag is the value "1", it is determined that no malfunction occurs in the second portion of the system. If the first flag is the value "0", it is determined that a malfunction occurs in the second portion of the system.

After the two primary detection procedures described above are finished, the process is periodically re-started at the time intervals of 65 msec.

When the step S200 detects that the time t1 has elapsed since the engine starts operating, the next step S222 is taken. Step S222 detects whether or not an execution end flag is the value "1". If the execution end flag is the value "1", the process ends without performing other steps. Initially, the execution end flag is the value "0". After the steps S230-S242 are performed, the execution end flag is set to the value "1". Step S224 detects whether or not the first flag is the value "1". If the first flag is the value "1", step S226 detects whether or not the second flag is the value "1". If the second flag is the value "1", step S228 turns OFF the warning lamp 84 to inform a vehicle driver that no malfunction occurs in the system. Step S242 sets the execution end flag to the value "1".

Either when the step S224 detects the first flag as OFF (the value "0") or when the step S226 detects the second flag as OFF (the value "0"), the next step S230 is taken. At this time, it is temporarily determined that a malfunction occurs either in the first portion of the system or in the second portion of the system. The steps S230-S240 are a secondary detection procedure to finally detect whether or not a malfunction in the system. This procedure is performed by switching ON the control valve 81 to open the bypass passage 80 so that the second portion of the vapor passage 72 and the fuel tank 73 are subjected to the negative pressure of the intake pipe 74.

Step S230 switches ON the control valve 81 in the bypass passage so as to connect the canister 71 and the fuel tank 73 via the bypass passage 80. Step S232 switches ON the VSV 78 to open the purge passage 75, so that the system are entirely subjected to the negative pressure of the intake pipe 74. Step S234 whether or not a time period t2 has elapsed since the engine started operating. The reason for this waiting time is that a certain time period is required until the system (especially, the fuel tank 73) is completely subjected to the negative pressure of the intake pipe 74.

After the time period t2 has elapsed, step S236 stores a pressure of the system, sensed by the pressure sensor 82, in the memory of the ECU 83. Step S238 detects whether or not the pressure P of the system is lower than the second pressure (−10 mm Hg).

If the pressure P is lower than the second pressure, it is finally determined that no malfunction occurs in the system. Step S228 turns OFF the warning lamp 84 to inform a vehicle driver that no malfunction occurs in the system.

If the pressure P is not lower than the second pressure, it is finally determined that a malfunction occurs in the system. Step S240 turns ON the warning lamp 84 to inform a vehicle driver that the malfunction occurs in the system.

In the secondary detection procedure described above, the fuel tank is subjected to the negative pressure of the intake pipe via the bypass passage. Thus, by means of a pressure sensor, it is possible to reliably and correctly detect a malfunction in an evaporated fuel purge system having a pressure control check valve in the vapor passage. Also, the canister is subjected to the negative pressure of the intake pipe during the secondary detection procedure, and it is possible to detect a malfunction in the canister. After the secondary detection procedure (steps S230-S240) is finished, step S242 sets the execution end flag to the value "1", and the process ends.

Figure 18:
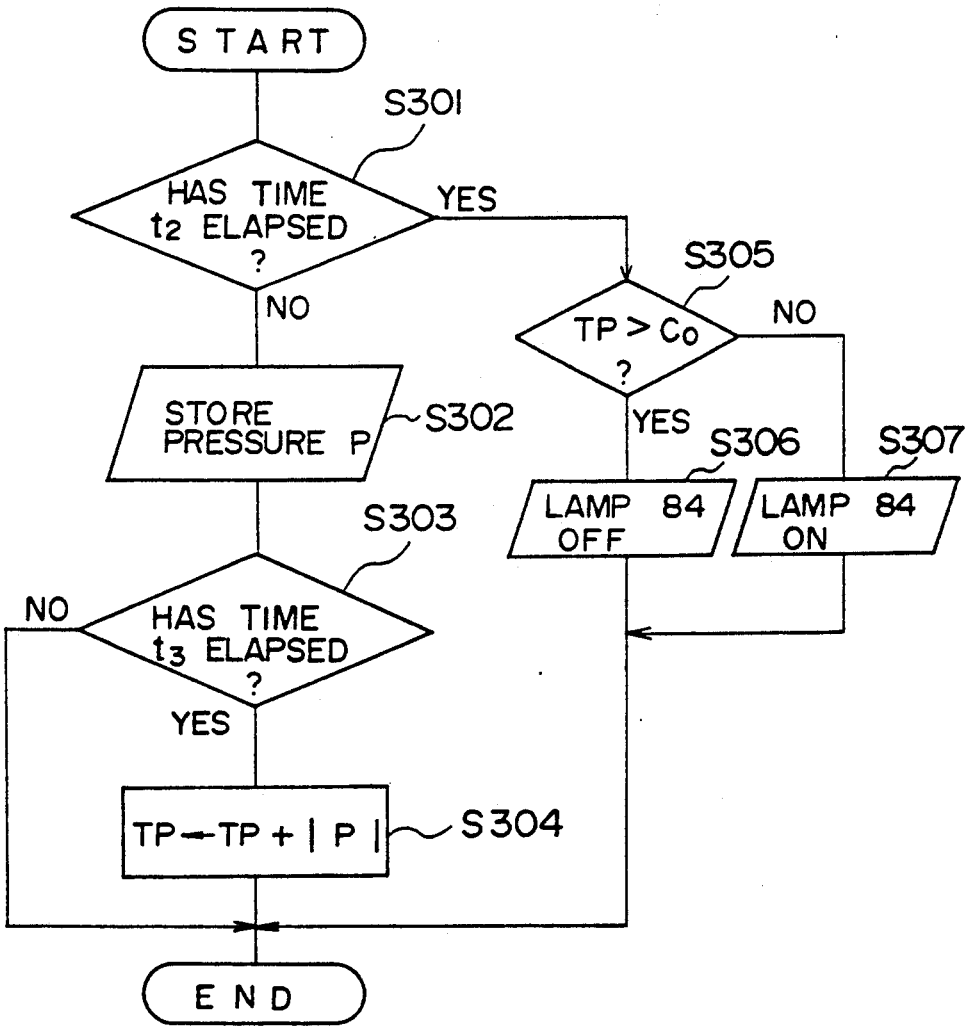
FIGS. 18 through 20 are flow charts for explaining other modified malfunction detecting processes performed by the apparatus shown in FIG. 15.
Figure 19:
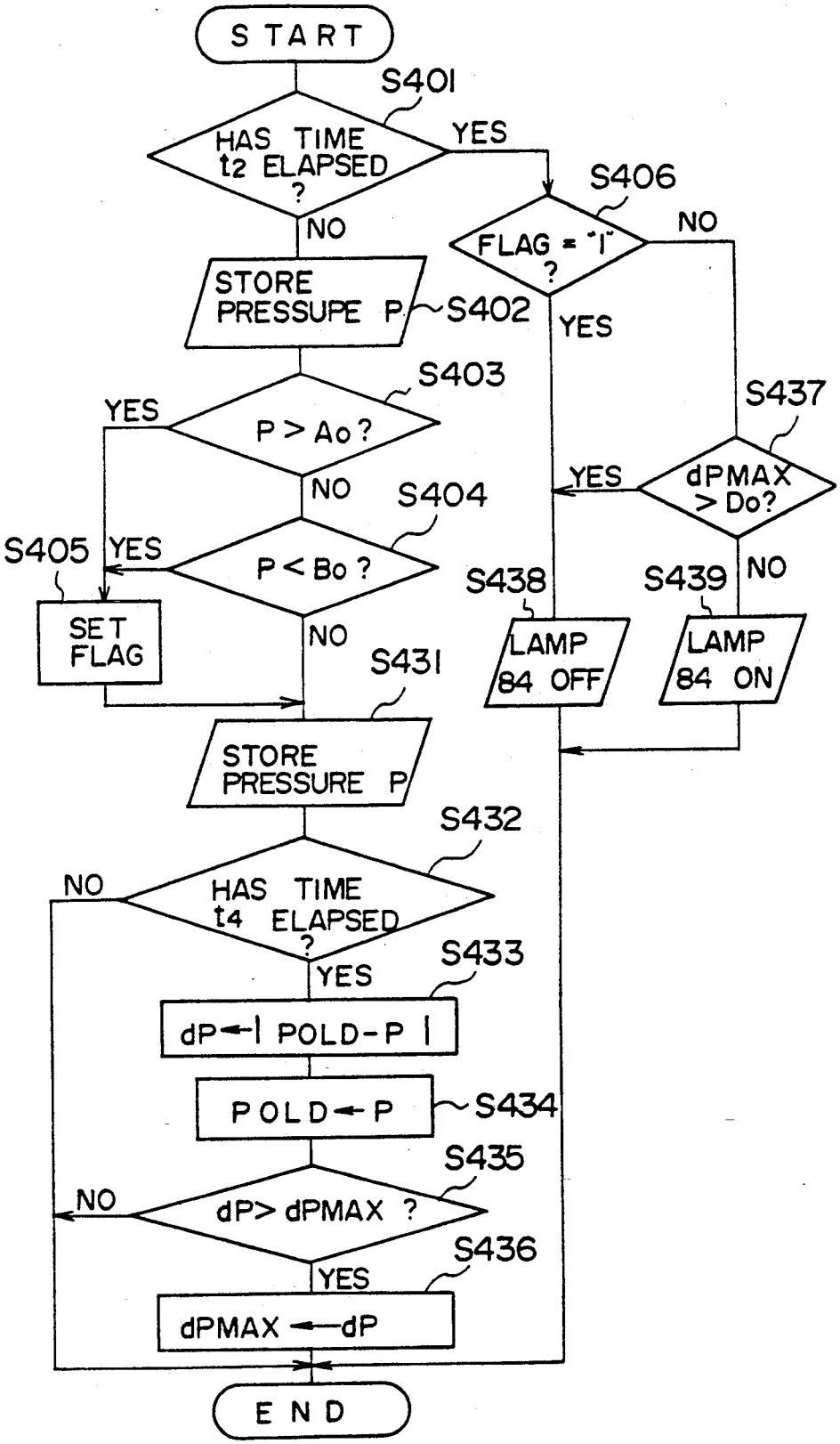
Figure 20:
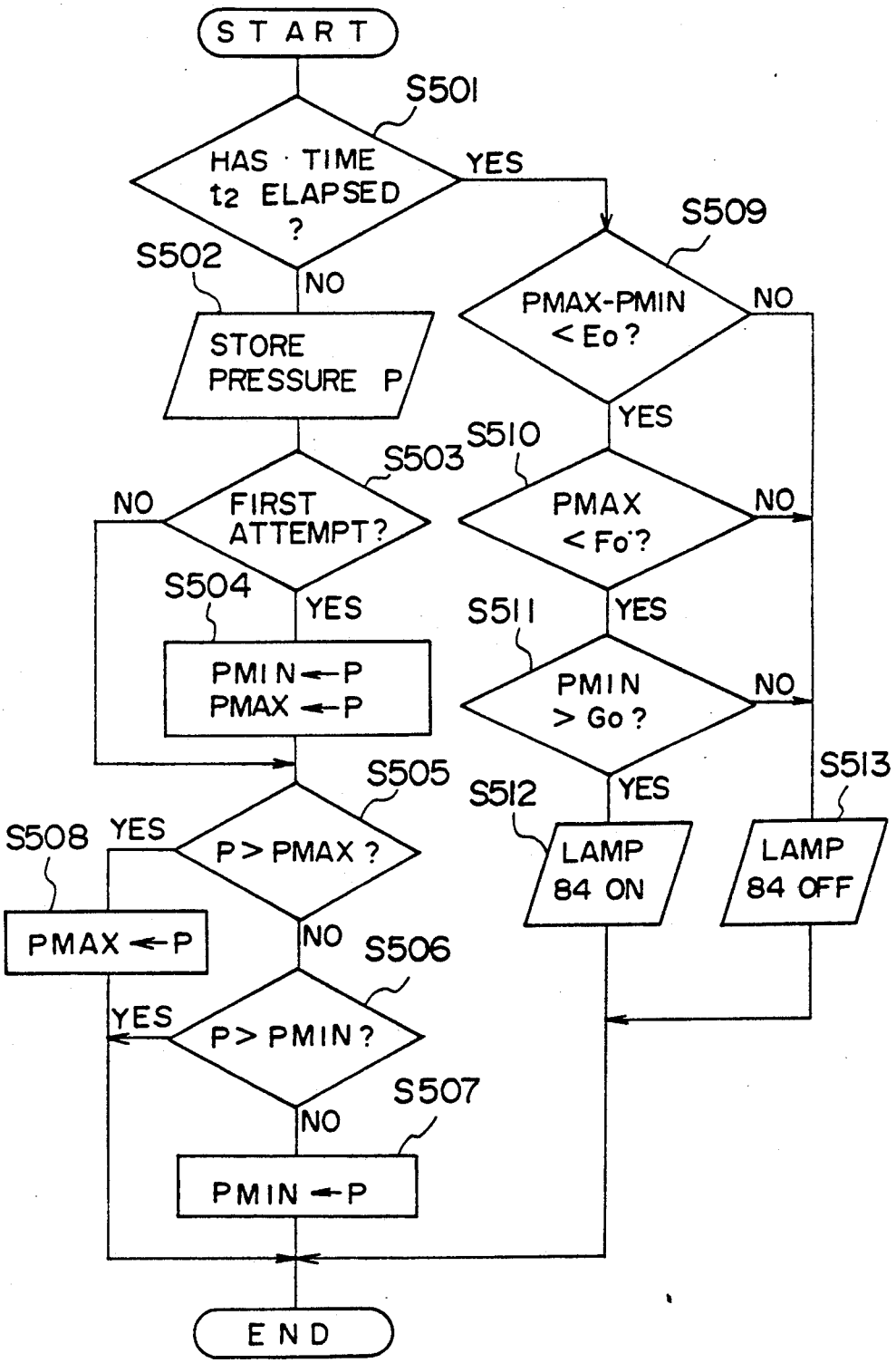

By the apparatus as shown in FIG. 15, applied to an evaporated fuel purge system having the pressure control check valve in the vapor passage, other malfunction detecting processes can be performed for desired operations of the engine and the system. FIGS. 18-20 show such malfunction detecting processes.

The malfunction detecting process shown in FIG. 18 is started when an ignition switch is turned ON. The process is periodically re-started at prescribed time intervals. In the process shown in FIG. 18, step S301 detects whether or not a prescribed time t2 (e.g., 5-20 minutes) has elapsed since the engine starts operating. If the prescribed time t2 has not elapsed, step S302 stores a pressure P of the fuel tank sensed by the pressure sensor 82, in a memory of the ECU 82. This pressure P is, actually, a difference between the tank internal pressure and the atmosphere.

Step S303 detects whether or not a prescribed time t3 (e.g., 1 second) has elapsed since the previous attempt to perform step S304 is made. If the prescribed time t3 has not elapsed, the process ends without performing step S304. If the prescribed time t3 has elapsed, step S304 compute a variable TP by adding the absolute value P of the tank internal pressure sensed by the pressure sensor 82 to the variable TP. Initially, the variable TP is the value "0". The steps S301-S304 are repeated until the time t2 has elapsed, and an integrated value of the variable TP indicating the sum of the absolute values of the tank internal pressures is obtained.

After the prescribed time t2 has elapsed since the engine starts operating, step S305 detects whether or not the integrated value of the variable TP is greater than a prescribed value Co. If the integrated value of TP is greater than the value Co, it is determined that no malfunction occurs in the system. Step S306 switches OFF the warning lamp 84 to inform a vehicle driver that no malfunction occurs in the system, and the process ends.

If the integrated value of TP is not greater than the value Co, the tank internal pressure is around the atmospheric pressure with no appreciable change, and it is determined that a malfunction occurs in the system. Step S307 switches ON the warning lamp 84 to inform a vehicle driver of the malfunction occurring in the system, and the process ends. Although the tank internal pressure varies depending on the fuel property, the fuel temperature, the evaporation amount and the fuel consumption, it is possible to reliably and correctly diagnose the system by performing the process shown in FIG. 18.

In the malfunction detecting process shown in FIG. 19, step S401 detects whether or not a prescribed time t2 (e.g., 5-20 minutes) has elapsed since the engine starts operating. If the prescribed time t2 has not elapsed, step S402 stores a pressure P of the fuel tank sensed by the pressure sensor 82, in the memory of the ECU 82. Step S403 detects whether or not the tank internal pressure P is greater than a prescribed value Ao. This value Ao is predetermined to a positive pressure slightly below the reference pressure of the pressure control check valve 77. Step S404 detects whether or not the tank internal pressure P is smaller than a prescribed value Bo. This value Bo is predetermined to be a negative pressure slightly below the atmospheric pressure.

Either when the tank internal pressure P is greater than the value Ao or when the tank internal pressure P is smaller than the value Bo, it is determined that no malfunction occurs in the system. Step S405 sets a flag to the value "1". However, if Bo≦P≦Ao, it is temporarily determined that a malfunction occurs in the system. The next step S431 is taken without performing step S405.

Step S431 stores a pressure of the fuel tank 73 sensed by the pressure sensor 82 in the memory of the ECU 83. Step S432 detects whether or not a prescribed time t4 (e.g., 10 seconds) has elapsed since the previous attempt of performing step S433 was made.

If the time t4 has not elapsed, the process ends without performing step S433. If the time t4 has elapsed, step S433 computes the absolute value dP of a pressure difference between the previous value POLD of the tank internal pressure and the current value P thereof. Step S434 sets the previous value POLD to the current value P.

Step S435 detects whether or not the absolute value dP of the pressure difference is greater than a prescribed maximum value dPMAX of the pressure difference. If dP≦dPMAX, the process ends without performing the next step S436. If dP>dPMAX, step S436 sets the maximum value dPMAX to the value dP, and the process ends.

After the time t2 has elapsed since the engine starts operating, step S406 detects whether or not the flag is the value "1". If the flag is the value "1", it is determined that no malfunction occurs in the system. Step S438 switches OFF the warning lamp 84, and the process ends.

If step S406 detects that the flag is not the value "1", step S437 detects whether or not the maximum value dPMAX of the pressure difference is greater than a prescribed value Do. If dPMAX>Do, the step S438 is performed and the process ends. If dPMAX≦Do, it is determined that a malfunction occurs in the system. Step S439 switches ON the warning lamp 84 to inform a vehicle driver of the malfunction in the system, and the process ends. Similar to the process shown in FIG. 18, it is possible to reliably and correctly diagnose the system by performing the process shown in FIG. 19.

In the malfunction detecting process shown in FIG. 20, step S501 detects whether or not a prescribed time t2 has elapsed since the ignition switch is turned ON to start the operation of the engine. If the prescribed t2 has not elapsed, step S502 stores a pressure P of the fuel tank sensed by the pressure sensor 82, in the memory of the ECU 82.

Step S503 detects whether or not it is the first attempt of step S503 since the ignition switch was turned ON. If it is the first attempt of step S503, step S504 substitutes the sensed pressure P for a minimum pressure PMIN and substitutes the sensed pressure P for a maximum pressure PMAX.

After the step S504 is performed, step S503, at the subsequent attempts, detects it is not the first attempt of step S503. Step S505 detects whether or not the sensed pressure P is greater than the maximum pressure PMAX. Immediately after the step S504 is performed, the sensed pressure P is the same as the maximum pressure PMAX. Step S506 detects whether or not the sensed pressure P is greater than the minimum pressure PMIN. Immediately after the step S504 is performed, the sensed pressure P is the same as the minimum pressure PMIN. Step S507 sets the minimum pressure PMIN to the sensed pressure P and stores it in the memory of the ECU 83, and the process ends. The pressure P at this time is a pressure sensed immediately after the engine started operating.

The process shown in FIG. 20 is periodically restarted, and the steps S502 and S505–S508 described above are repeated until the prescribed time t2 has elapsed. Step S505 detects whether or not the currently sensed pressure P is greater than the maximum pressure PMAX (the maximum tank pressure after the engine started operating). If P>PMAX, step S508 sets the maximum pressure PMAX to the sensed pressure P and stores it in the memory of the ECU 83, and the process ends. If P≦PMAX, step 506 detects whether or not the sensed pressure P is greater than the minimum pressure PMIN. If P>PMIN, the process ends. If P≦PMIN, step S507 sets the minimum pressure PMIN to the sensed pressure P and stores it in the memory, and the process ends. Thus, during the prescribed time t2 after the engine started operating, the PMAX is set to the maximum value of the tank internal pressure, and the PMIN is set to the minimum value of the tank internal pressure.

When the prescribed time t2 has elapsed in step S501, step S509 detects whether or not a pressure difference (PMAX−PMIN) between the maximum pressure and the minimum pressure is greater than a prescribed reference value Eo. If the pressure difference is greater than the reference value Eo, it is determined that no malfunction occurs in the system. Step S513 turns OFF the warning lamp 84 to inform a vehicle driver that no malfunction occurs in the system, and the process ends.

If the pressure difference is not greater than the reference value Eo, it is temporarily determined that a malfunction occurs in the system. In a case where the engine is in a warm starting condition or in a case where the fuel tank is located at a very low temperature and the engine is in an idling condition, it is possible to erroneously detect a malfunction in the system from the sensed pressure, if the malfunction detection is performed only after the step S509 is performed. In order to eliminate such problems, step S510 detects whether or not the maximum pressure PMAX is smaller than a prescribed value Fo (e.g., 200 mm $H_2O$) If the maximum pressure PMAX is not smaller than the value Fo, it is determined that the system is normally operating but the tank internal pressure does not change considerably. Step 513 is performed and the process ends.

If PMAX<Fo, step S511 detects whether or not the minimum pressure PMIN is greater than a prescribed value Go (e.g., −100 mm $H_2O$). If the minimum pressure PMIN is not greater than the value Go, it is determined that the system is normally operating but the tank internal pressure does not change considerably. If the minimum pressure PMIN is greater than the value Go, it is finally determined that a malfunction occurs in the system. Step S512 turns ON the warning lamp 84 to inform a vehicle driver that the malfunction occurs in the system, and the process ends.

Next, a description will be given, with reference to FIGS. 21 through 26, of fourth and fifth embodiments of the malfunction detecting apparatuses according to the present invention. Generally, it is difficult to predict the tank internal pressure because it varies depending on the fuel consumption amount, the fuel temperature and other factors. In a conventional malfunction detecting device, it is possible to erroneously detect a malfunction such as leakage in the system when the engine is in a cold starting operation, or when the fuel temperature at the current engine start is lower than the fuel temperature at the preceding engine stop. When the engine is in the cold starting operation, almost no fuel vapor is evaporated in the fuel tank. If no malfunction such as leakage occurs in the system, the tank internal pressure sensed by the pressure sensor changes to a negative pressure, and it then increases to a positive pressure in conjunction with the increase of the fuel temperature. However, if a malfunction such as leakage occurs in the system, the tank internal pressure sensed by the pressure sensor does not change from around the atmospheric pressure.

Figure 21:
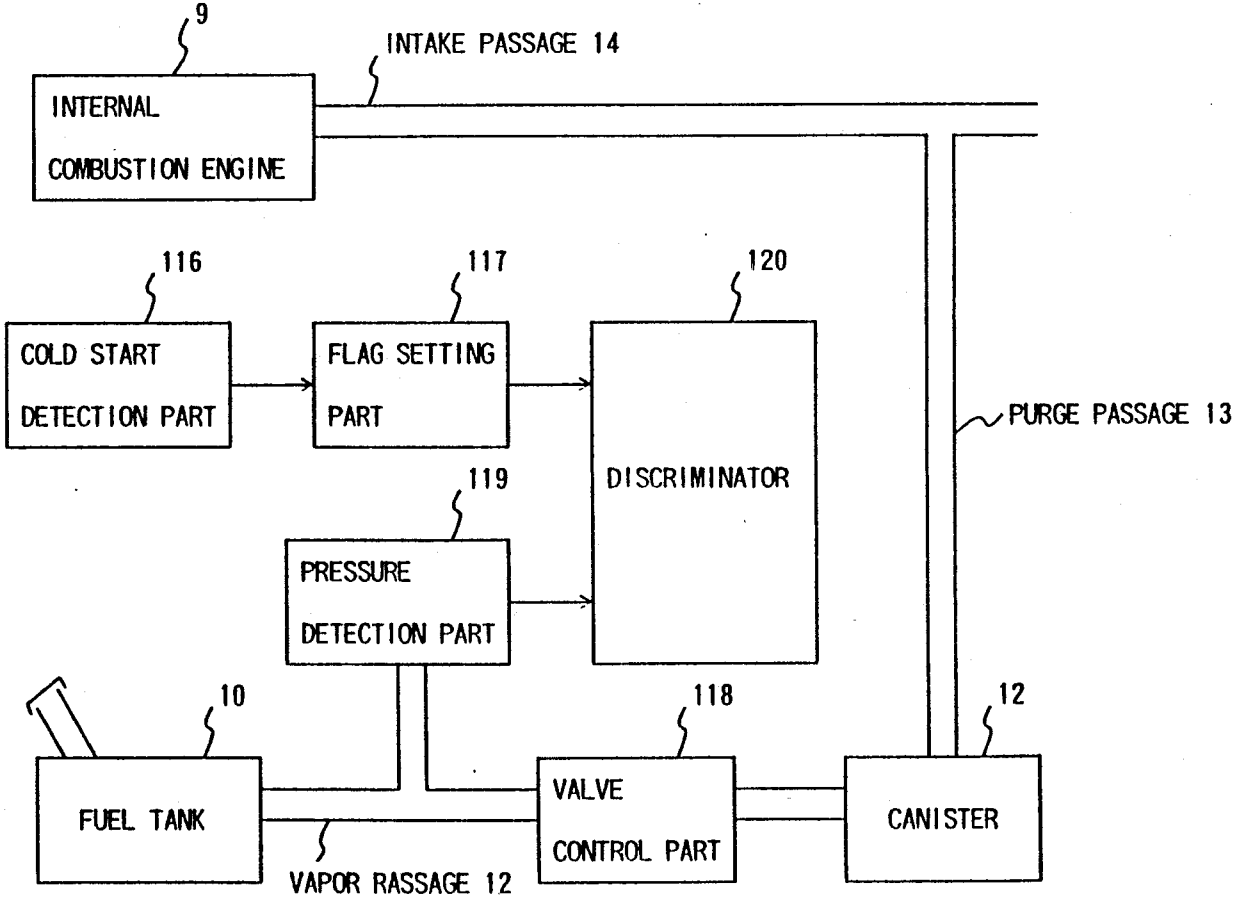
FIG. 21 is a block diagram showing a fourth embodiment of the malfunction detecting apparatus according to the present invention.

FIG. 21 shows the construction of the fourth embodiment of the malfunction detecting apparatus according to the present invention. In FIG. 21, the parts which are the same as the corresponding parts in FIG. 10 are designated by the same reference numerals, and a description thereof will be omitted.

The apparatus shown in FIG. 21 includes a cold start detection part 116, a flag setting part 117, a valve control part 118 in the vapor passage 12 between the fuel tank 10 and the canister 12, a pressure detection part 119, and a discriminator 120. The cold start detection part 116 detects whether or not the engine is in a cold start condition. When the cold start detection part 116 detects that the engine is in the cold start condition, the flag setting part 117 turns ON an enable flag (being set to the value "1"). The valve control part 118 turns OFF the pressure control check valve mounted in the vapor passage 12 to close the vapor passage 12 between the fuel tank 10 and the canister 12 when the enable flag is turned ON (the value "1"). The pressure detection part 119 senses a pressure of the system including the vapor passage from the fuel tank 10 to the pressure control check valve. When the enable flag is ON, the discriminator 120 detects whether or not a malfunction occurs in the system, in accordance with the sensed pressure of the system. If the pressure of the system sensed by the pressure detection part 119 is greater than a prescribed reference pressure after a prescribed time has elapsed, it is determined that a malfunction occurs in the system.

Figure 22:
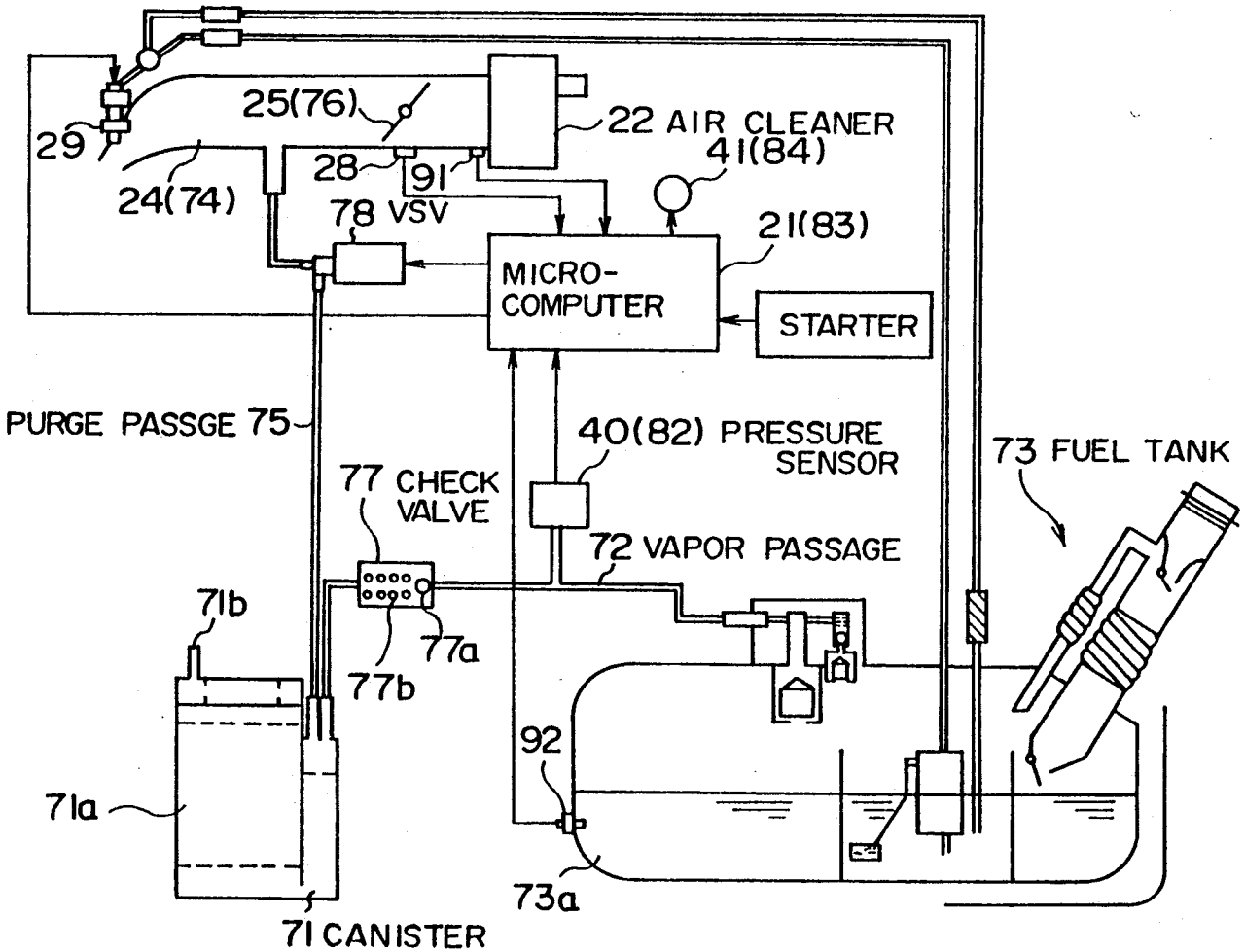
FIG. 22 is a diagram showing an evaporated fuel purge system to which the fourth embodiment of the apparatus shown in FIG. 21 is applied.

FIG. 22 shows an evaporated fuel purge system to which the fourth embodiment of the present invention is applied. In FIG. 22, the parts which are the same as the corresponding parts in FIGS. 2 and 15 are designated by the same reference numerals, and a description thereof will be omitted. The system shown in FIG. 22 includes a pressure control check valve 77 for controlling a flow of fuel vapor from the fuel tank to the canister. The pressure control check valve 77 has a valve body 77*a* and a spring 77*b*. The canister 71 has an absorbent 71*a* and an air inlet hole 71*b*.

Figure 23:
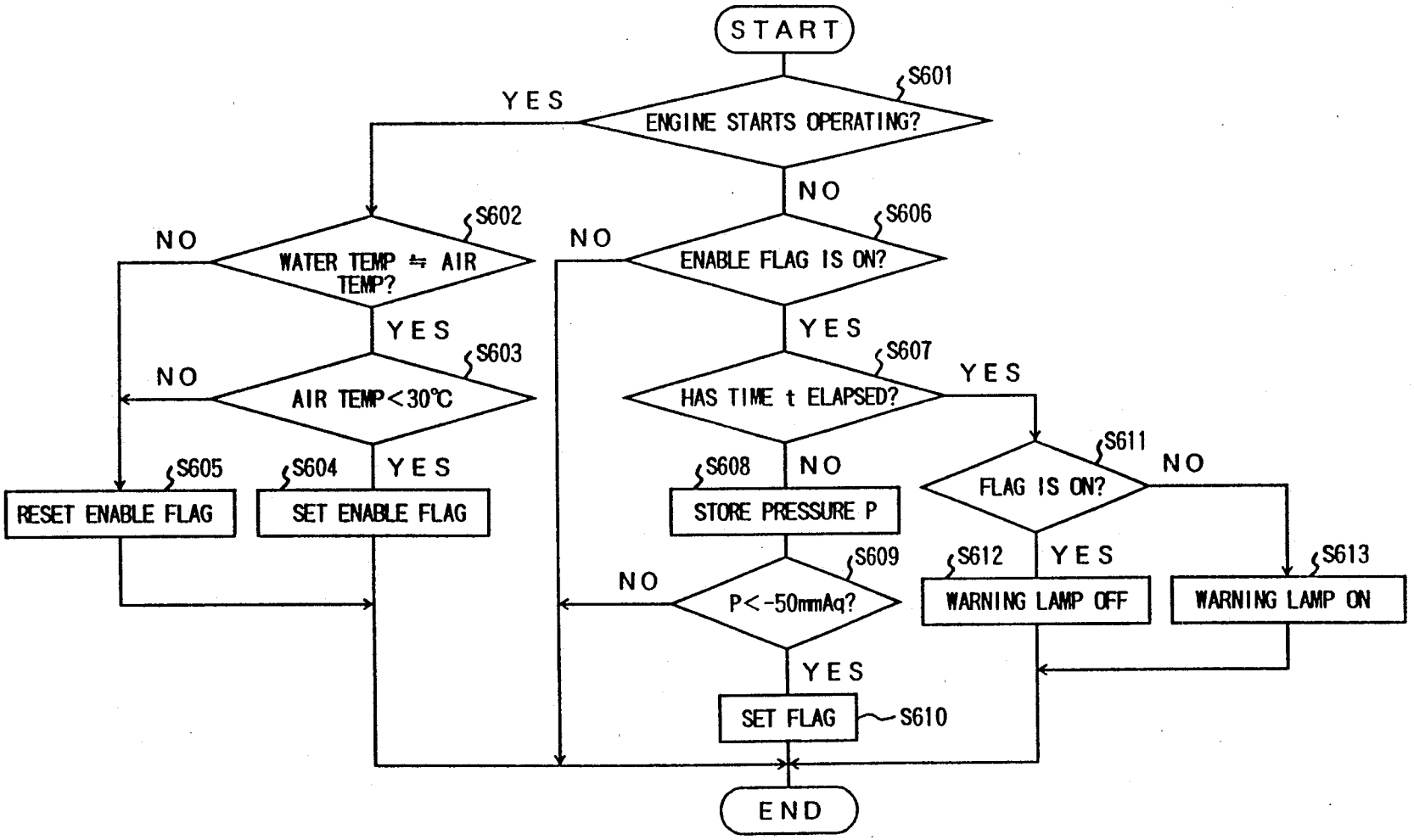
FIGS. 23 and 24 are flow charts for explaining a malfunction detecting process performed by the apparatus shown in FIG. 22.

FIG. 23 shows a malfunction detecting process performed by the apparatus shown in FIG. 22. This process is periodically re-started at prescribed time intervals. When the process shown in FIG. 23 is started, step S601 detects whether or not the engine starts operating, in accordance with a signal sent from the starter to the microcomputer 21 (83). When the engine starts operating, step S602 detects whether or not the temperature of engine cooling water sensed by a water temperature sensor (not shown in FIG. 22) mounted on the engine is substantially equal to the temperature of intake air sensed by an air temperature sensor 91 mounted on the intake passage 24 (74).

If step S602 detects that the water temperature is substantially equal to the intake air temperature, step S603 detects whether or not the intake air temperature sensed by the air temperature sensor 91 is lower than 30 deg.C. If step S603 detects that the intake air temperature is lower than 30 deg.C, it is determined that the engine is in a cold start condition. Step S604 sets the enable flag to the value "1", and the process ends.

If step S602 detects that the water temperature is not substantially equal to the intake air temperature, or if step S603 detects that the intake air temperature is not lower than 30 deg.C, it is determined that the engine is not in a cold start condition. Step S605 resets the enable flag to the value "0", and the process ends.

When step S601 detects that the engine is not in a starting condition, step S606 detects whether or not the enable flag is set to the value "1". If the enable flag is not set the value "1", the process ends without performing other steps. If the enable flag is set to the value "1", the next step S607 is taken.

Step S607 detects whether or not a prescribed time t has elapsed since the engine started operating. When the prescribed time t has not elapsed, step S608 stores a pressure P of the system sensed by the pressure sensor 82, in the memory of the microcomputer 83. Step S609 detects whether or not the pressure P is smaller than a prescribed negative pressure (e.g., $-50$ mm $H_2O$). If $P < -50$ mm $H_2O$, step S610 sets a detection flag to the value "1". It is determined that the system is normally operating. However, if $P \geqq -50$ mm $H_2O$, it is determined that am malfunction occurs in the system including the vapor passage 72 and the fuel tank 73, the process ends without setting the detection flag.

When step S607 detects that the prescribed time t has elapsed, step S611 detects whether or not the detection flag is set to the value "1" (ON). If the detection flag is the value "1", step S612 turns OFF the warning lamp 84 to inform a vehicle driver that no malfunction occurs in the system. In other words, when the tank internal pressure, immediately after the engine operation was started in a cold start, is smaller than $-50$ mm $H_2O$, it is determined that no malfunction such as leakage occurs in the vapor passage 72 or in the fuel tank 73.

When step S611 detects that the detection flag is not the value "1", step S613 turns ON the warning lamp 84 to inform a vehicle driver of the malfunction occurring in the system including the vapor passage from the pressure control check valve 77 to the fuel tank 73. According to the present invention, it is detected whether or not the tank internal pressure P is smaller than $-50$ mm $H_2O$ when the engine is in a cold start condition wherein the major factor influencing the tank internal pressure is the fuel consumption amount. Thus, it is possible to reliably and correctly detect a malfunction in the system.

Figure 24:
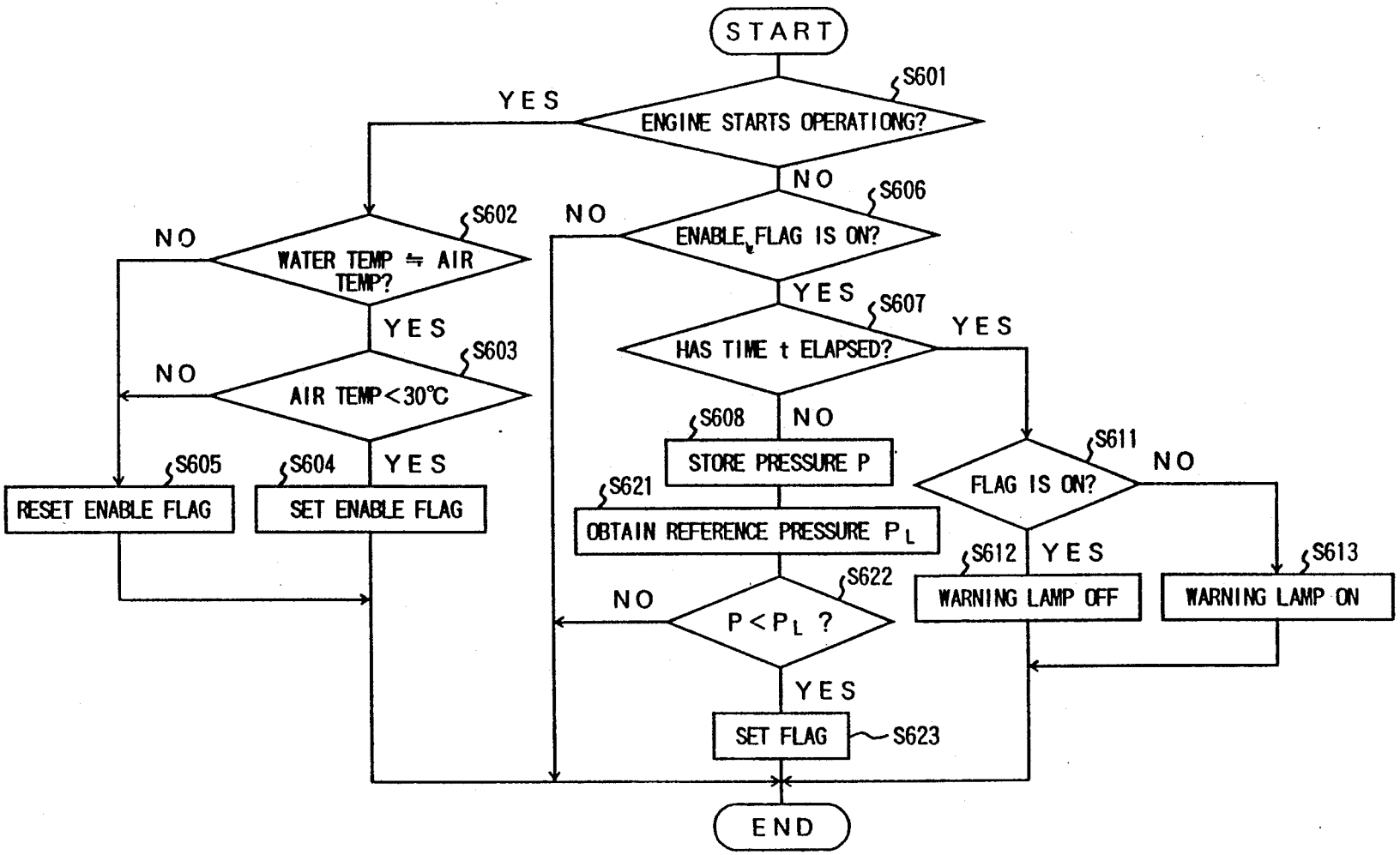

FIG. 24 shows a modified malfunction detecting process performed by the apparatus shown in FIG. 22. In FIG. 24, the steps which are the same as the corresponding steps in FIG. 23 are designated by the same reference numerals, and a description thereof will be omitted.

In the process shown in FIG. 24, step S608 stores a pressure P of the system sensed by the pressure sensor 82, in the memory of the microcomputer 83. Step S621 reads a map from the ROM of the microcomputer 83 and retrieves a predetermined reference pressure Pl from the map of the ROM in accordance with a fuel consumption amount QF computed from the operation of the engine.

Generally, this reference pressure Pl (=negative pressure) decreases when the fuel consumption amount P1 (in seconds) increases. The reference pressure is predetermined to be a pressure slightly above the actually measured fuel internal pressure in the system having no malfunction therein immediately after the engine is started in a cold start operation.

Step S622 detects whether or not the tank internal pressure P is smaller than the reference pressure P1. If $P<P1$, it is determined that the system is normally operating. Step S623 sets the detection flag to the value "1". If $P \geqq P1$, the tank internal pressure P is greater than the reference pressure P1; nevertheless the engine has the fuel consumption. It is thus determined that a malfunction such as leakage occurs in the system. The process ends without setting detection flag. The other steps in FIG. 24 are the same as the corresponding steps in FIG. 23, and a description thereof will be omitted.

Figure 25:
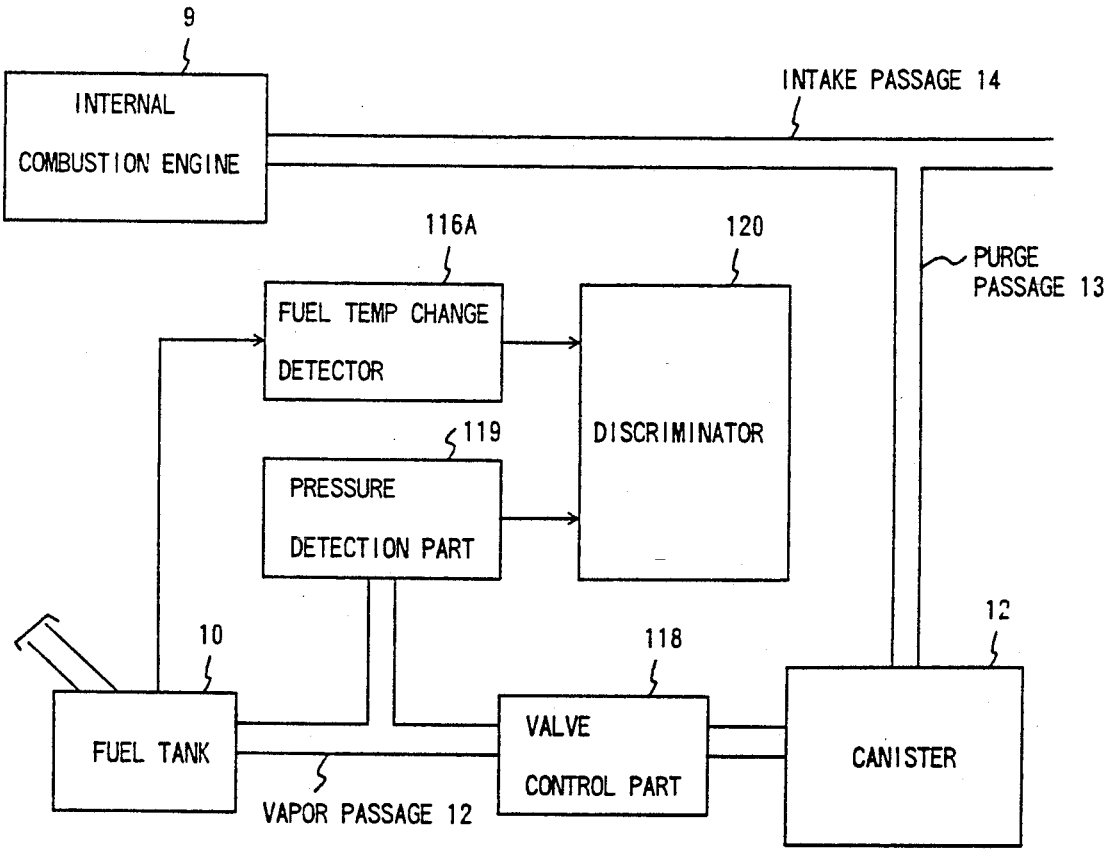
FIG. 25 is a block diagram showing a fifth embodiment of the malfunction detecting apparatus according to the present invention.

FIG. 25 shows the construction of the fifth embodiment of the malfunction detecting apparatus according to the present invention. In FIG. 25, the parts which are the same as the corresponding parts in FIG. 24 are designated by the same reference numerals, and a description thereof will be omitted.

The apparatus shown in FIG. 25 includes the pressure control check valve 118, the pressure detection part 119, the discriminator 120, and a fuel temperature change detector 116A. The pressure control check valve 118 is turned OFF to close the vapor passage 12 between the fuel tank 10 and the canister 12, until the required condition is satisfied during a time period from a preceding engine stop to a current engine start. The pressure detection part 119 senses a pressure of the system including the vapor passage 12 between the fuel tank 10 and the check valve 118. The fuel temperature change detector 116A detects whether or not a difference between the fuel temperature at the preceding engine stop and the fuel temperature at the current engine start is greater than a prescribed value. When it is detected that the fuel temperature difference is greater than the prescribed value, the discriminator 120 detects whether or not the pressure of the system sensed by the pressure detection part 119 is greater than a prescribed pressure. When the pressure of the system sensed by the pressure detection part 119 is greater than the prescribed pressure, it is determined that a malfunction occurs in the system.

Figure 26:
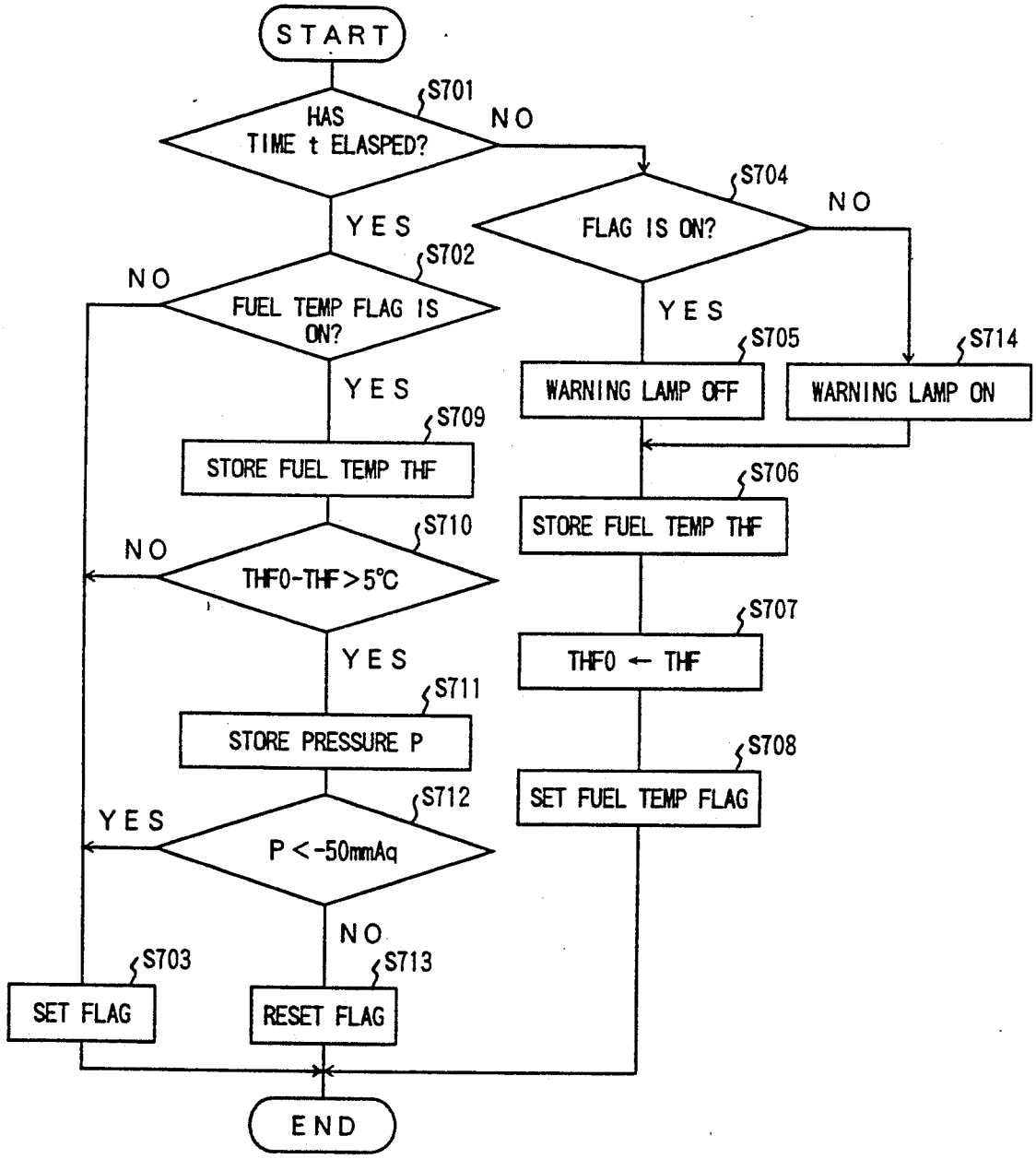
FIG. 26 is a flow chart for explaining a malfunction detecting process performed by the fifth embodiment of the apparatus shown in FIG. 25.

FIG. 26 shows a malfunction detecting process performed by the apparatus shown in FIG. 25. This process is periodically re-started at prescribed time intervals. When the process shown in FIG. 23 is started, step S701 detects whether a prescribed time t (e.g., 2 sec.) has not elapsed since the engine starts operating, in accordance with a signal from the starter to the microcomputer 83. When the time t has not elapsed, step S702 detects whether or not a fuel temperature flag is set to the value "1".

The fuel temperature flag is, initially, set to the value "0". If the flag is previously set to the value "1", it is stored in a backup RAM of the microcomputer 83. The value of the flag is retained in the backup RAM even after the engine stops operating. If the fuel temperature flag is not set, step S703 sets a detection flag to the value "1", and the process ends.

If the prescribed time t has elapsed, step S704 detects whether or not the detection flag is set to the value "1". If the detection flag is set, step S705 turns OFF the warning lamp 84. Step S706 stores a fuel temperature THF (the fuel temperature at the preceding engine stop) sensed by a fuel temperature sensor 92, in the memory of the microcomputer 21(83). Step S707 substitutes the fuel temperature THF for a variable THFO. Step S708 sets the fuel temperature flag to the value "1", and the process ends.

The process is periodically re-started at the time intervals until the engine stops operating, and the steps 701 and 704–708 are repeatedly performed. When the engine stops operating, the fuel temperature flag having the value "1" and the variable THFO having the preceding fuel temperature value before the engine operation is stopped are stored in the backup RAM.

After the above procedure is performed, the engine operation is re-started and the process shown in FIG. 26 is periodically re-started. Within the prescribed time t since the engine started operating, step S702 detects whether or not the fuel temperature flag is set to the value "1". At this time, the fuel temperature flag is set to the value "1". Step S709 stores a fuel temperature THF sensed (the fuel temperature at the current engine start) by the fuel temperature sensor 102, in the memory of the microcomputer 83.

Step S710 detects whether or not a difference between the fuel temperature THFO at the preceding engine stop and the fuel temperature THF at the current engine start is greater than 5 deg.C. If $(THFO-THF) \leqq 5$ deg.C, it is determined that the requirement for detecting a malfunction in the system is not satisfied. Step S703 sets the detection flag to the value "1", and the process ends.

If $(THFO-THF)>5$ deg.C, step S711 stores a pressure P of the system sensed by the pressure sensor 82, in the memory of the microcomputer 83. Step S712 detects whether or not the pressure P is smaller than a prescribed negative pressure (e.g., $-50$ mm $H_2O$) If $P<-50$ mm $H_2O$, it is determined that no malfunction occurs in the system. Step S703 sets the detection flag to the value "1", and the process ends.

If step S712 detects that $P \geqq -50$ mm $H_2O$, it is determined that a malfunction occurs in the system. Step S713 resets the detection flag to the value "0", and the process ends. The process is periodically re-started. When the time t has elapsed since the engine starts operating, step S704 detects that the detection flag is not set to the value "1". Step S714 turns ON the warning lamp 84 to inform a vehicle driver of the malfunction occurring in the system including the vapor passage from the fuel tank to the pressure control check valve.

Moreover, step S706 stores a fuel temperature THF sensed (the fuel temperature at the preceding engine stop) by the fuel temperature sensor 102, in the memory of the microcomputer 84. Step S707 substitutes the sensed fuel temperature THF for the variable THFO. Step S708 sets the fuel temperature flag to the value "1", and the process ends.

Figure 27:
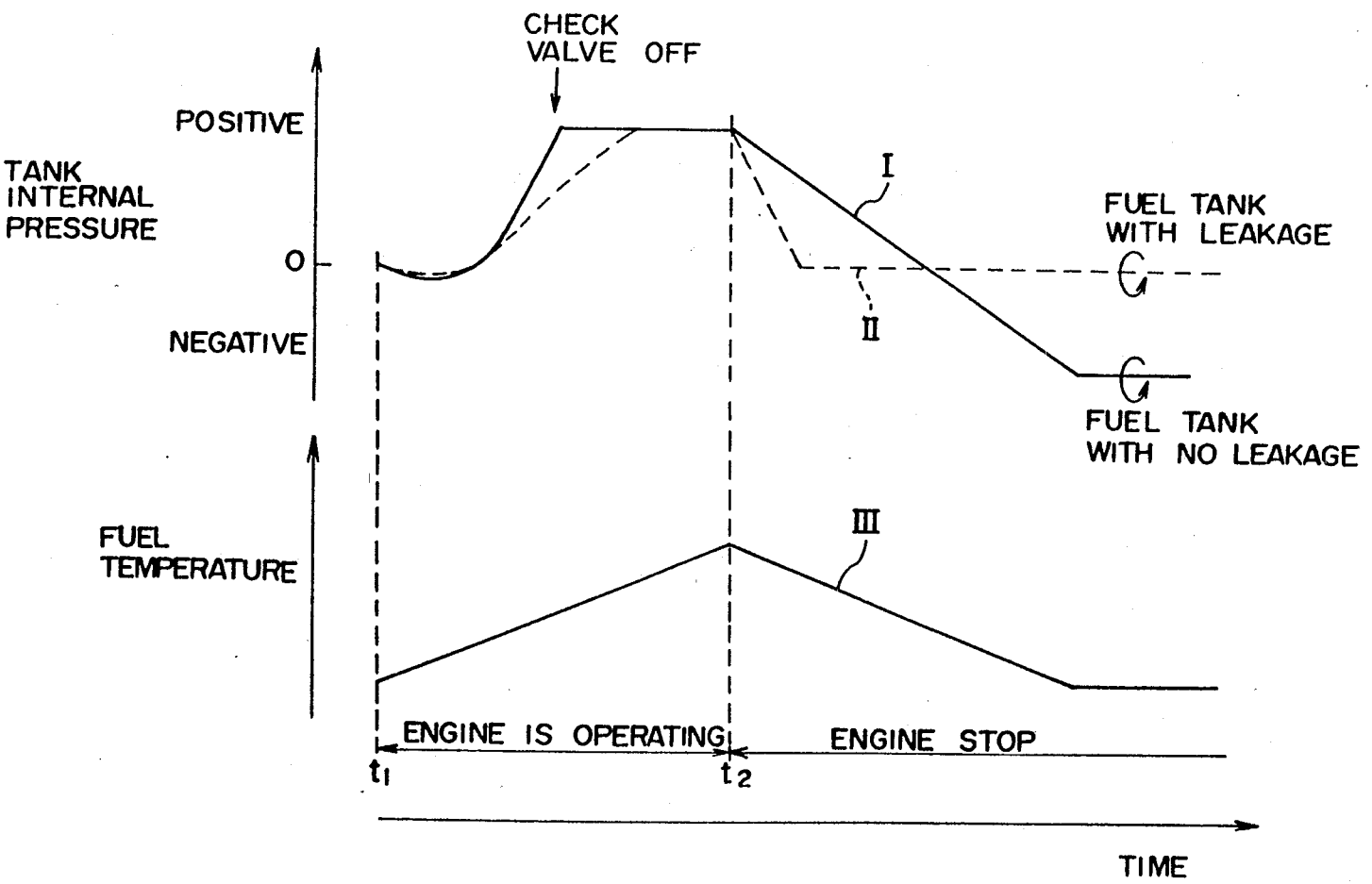
FIG. 27 is a diagram for explaining the change of the tank internal pressure and the change of the fuel temperature when the process shown in FIG. 26 is performed.

FIG. 27 shows the change of the tank internal pressure and the change of the fuel temperature when the malfunction detecting process shown in FIG. 26 is performed. At a time point t1 in FIG. 27, the engine starts operating. The temperature of fuel in the fuel tank gradually increases due to the heat of the exhaust emission, as indicated by a solid line III in FIG. 27. When the engine starts operating at the time point t1, the tank internal pressure is around the atmospheric pressure. If there is almost no fuel evaporation at the time point t1, the tank internal pressure decreases to a negative pressure due to the fuel consumption of the engine, as indicated by a solid line I in FIG. 27.

Since the fuel temperature is increasing, the tank internal pressure increases from the negative pressure to a positive pressure. However, due to the function of the pressure control check valve in the vapor passage, the tank internal pressure is maintained at the positive pressure, as indicated by the solid line in FIG. 27. At a time point t2 in FIG. 27, the engine operation is stopped, the fuel temperature decreases at a constant rate to a low temperature, as indicated by the solid line III. Since the fuel vapor in the fuel tank is liquified, the fuel internal pressure decreases to a negative pressure in accordance with the fuel consumption and the amount of fuel vapor fed to the canister, as indicated by the solid line I in FIG. 27.

However, when the fuel temperature is not decreased to the low temperature, the tank internal pressure does not reach the negative pressure. When a malfunction such as leakage occurs in the fuel tank or in the vapor passage, the tank internal pressure is not decreased to the negative pressure and remains around the atmospheric pressure even if the fuel temperature is decreased to the low temperature, as indicated by a dotted line II in FIG. 27.

When the process shown in FIG. 26 is performed, the major factor influencing the tank internal pressure is the fuel temperature, the pressure control check valve is turned OFF to close the vapor passage leading to the fuel tank. When a difference between the fuel temperature at the preceding engine stop and the fuel temperature at the current engine start is greater than the prescribed temperature (5 deg.C), the malfunction detection is performed by comparing the tank internal pressure P with the prescribed negative pressure (−50 mm $H_2O$). Therefore, according to the present invention, it is possible to reliably and correctly detect a malfunction in the system.

Next, a description will be given of a sixth embodiment of the malfunction detecting apparatus according to the present invention, with reference to FIGS. 28-30. In a malfunction detecting device for detecting a malfunction in an evaporated fuel purge system having a pressure control check valve in the vapor passage and a control vapor in the bypass passage, there is a problem in that, if the second control valve is turned ON after a malfunction such as leakage in the system is detected, a certain amount of fuel vapor escapes from the system to the atmosphere due to the negative pressure of the fuel tank.

In order to eliminate the above mentioned problem, a modified malfunction detecting process performed by the malfunction detecting apparatus is proposed. FIG. 28 shows such a malfunction detecting apparatus which is applied to the evaporated fuel purge system mentioned above. In FIG. 28, the parts which are the same as the corresponding parts in FIG. 2 are designated by the same reference numerals, and a description thereof will be omitted. The system shown in FIG. 28 includes a pressure control check valve 41 in the vapor passage from the canister to the fuel tank, and a control valve 81 (e.g., a VSV or solenoid valve) in the bypass passage. The vapor passage is divided by the check valve 41 into a first portion 32*a* and a second portion 32*d*. The bypass passage which is connected to the vapor passage and passes around the check valve 41 is divided by the control valve 81 into a first portion 32*b* and a second portion 32*c*. The pressure control check valve 41 includes a spring 41*a*, a diaphragm 41*b*, and an air inlet hole 41*c*.

Figure 28:
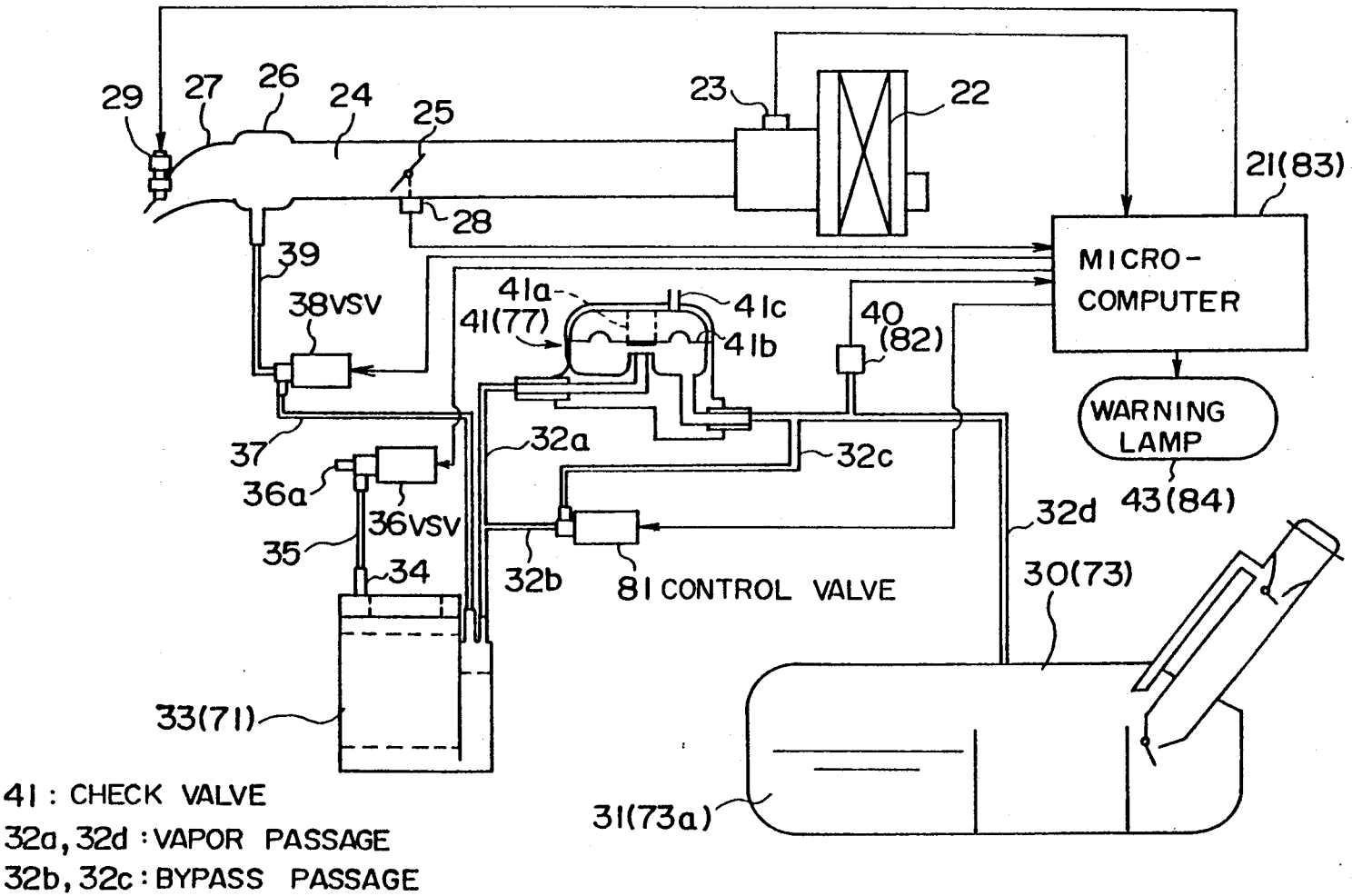
FIG. 28 is a block diagram showing a sixth embodiment of the malfunction detecting apparatus according to the present invention.

In the apparatus shown in FIG. 28, if a malfunction such as leakage is detected in the system as the result of the malfunction detecting process, the control valve 81 in the bypass passage, connected to the vapor passage from the canister to the fuel tank, is controlled in the open condition so as to subject the fuel tank to the atmospheric pressure. According to the sixth embodiment of the present invention, it is possible to remarkably reduce the amount of fuel vapor escaping from the leaking portion to the atmosphere.

Figure 29:
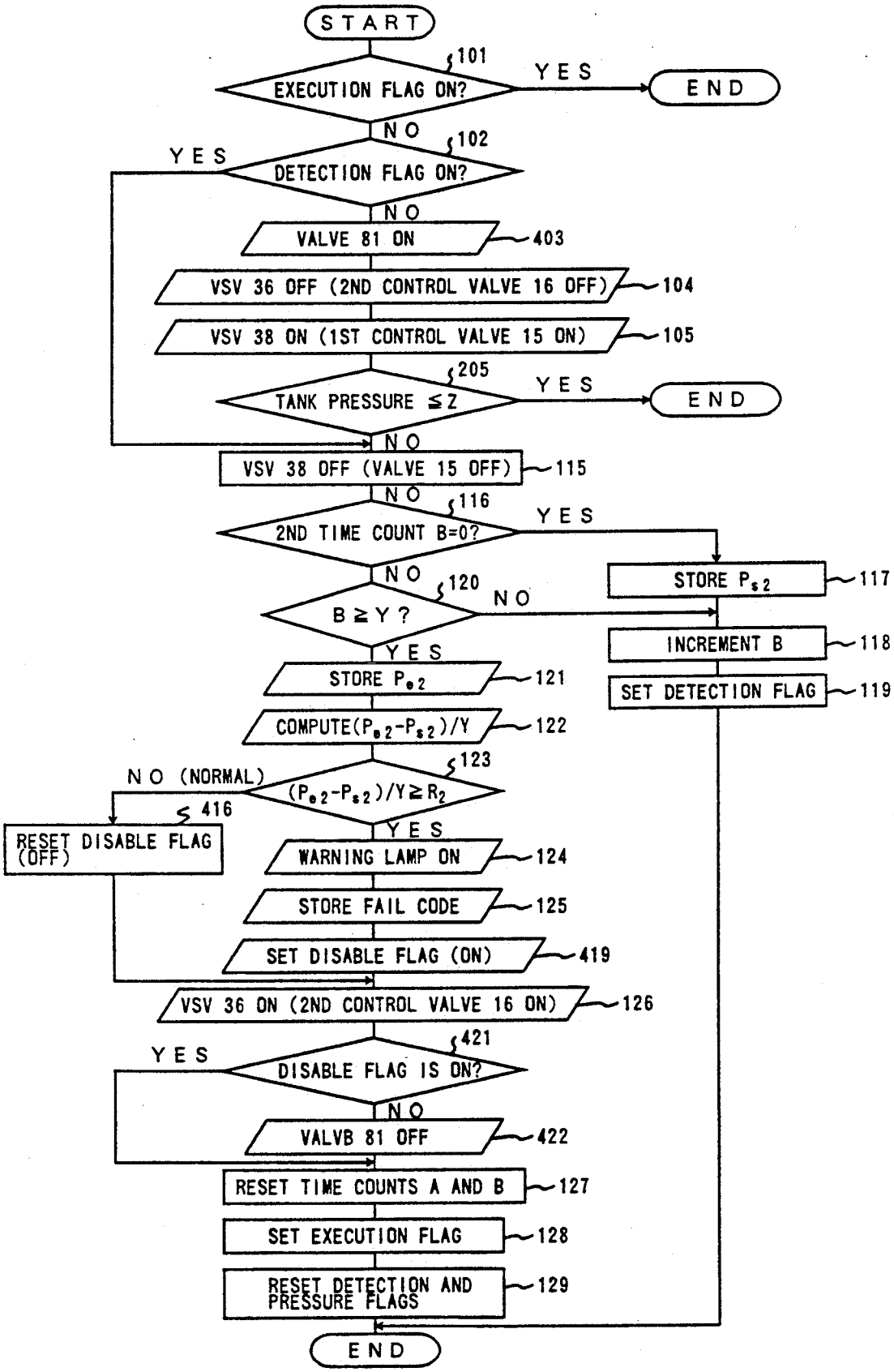
FIG. 29 is a flow chart for explaining a malfunction detecting process performed by the sixth embodiment of the apparatus of the present invention shown in FIG. 28.

FIG. 29 shows a malfunction detecting process performed by the apparatus shown in FIG. 28. In a flow chart shown in FIG. 29, the steps which are the same as the corresponding steps in FIG. 11 are designated by the same reference numerals, and a description thereof will be omitted.

In the flow chart shown in FIG. 29, step 403 turns ON the control valve 81 to open the bypass passage (32*b*, 32*c*) which is connected to the vapor passage 32 and passing around the pressure control check valve 41. After the step 403 is performed, step 104 turns OFF the VSV 36 to close the air inlet hole of the canister 33, and step 105 turns ON the VSV 38 to open the purge passage 39 from the canister 33 to the intake passage of the engine.

Figure 30:
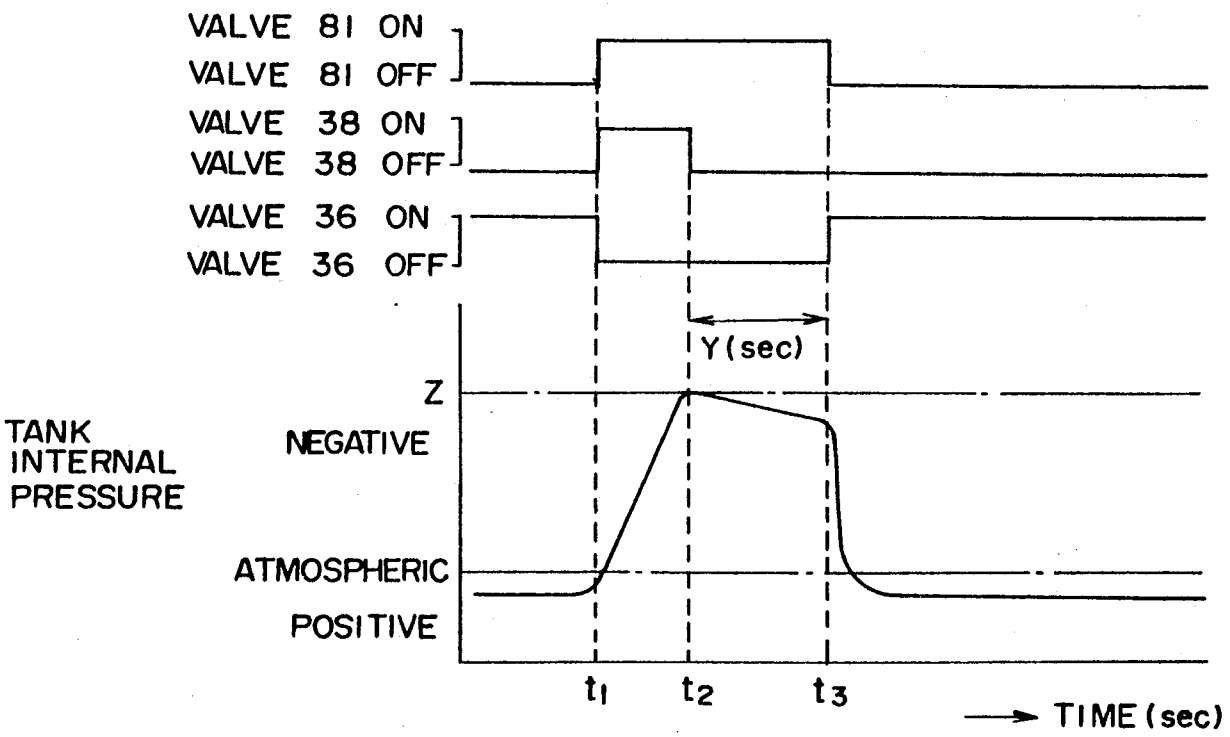
FIG. 30 is a diagram for explaining the change of the tank internal pressure when the malfunction detecting process shown in FIG. 29 is performed.

FIG. 30 shows the change of the tank internal pressure when the malfunction detecting process is performed. At a time point t1 in FIG. 30, the valve 81 is turned ON, the VSV 38 is turned ON, and the VSV 36 is turned OFF, so that the fuel tank 30 is subjected to the negative pressure of the intake passage via the VSV 38, the canister 33, the bypass passage 32*b*, the control valve 81, the bypass passage 32*c*, and the vapor passage 32*d*. The tank internal pressure rapidly changes to a negative pressure as shown in FIG. 30.

When it is detected in step 205 that the tank internal pressure (the absolute pressure) is greater than a prescribed negative pressure Z (Pa) (the absolute value), the VSV 38 is turned OFF to close the purge passage 39. At a time point t2 in FIG. 30, the VSV 38 is turned OFF. If no malfunction occurs in the system, the tank internal pressure gradually changes to the atmospheric pressure. At a time point t3 in FIG. 30, the VSV 36 is turned ON and the control valve 81 is turned OFF. The tank internal pressure rapidly changes to the atmospheric pressure, as shown in FIG. 30.

Step 123 shown in FIG. 29 detects whether or not the value of the pressure change rate (Pe2−Ps2)/Y of the system is greater than a predetermined reference value R2. If step 123 detects that the pressure change rate is greater than the reference value R2, step 124 switches ON the warning lamp 41. It is determined that a malfunction occurs in the system. At this time, the pressure change rate is too great due to the malfunction such as leakage having occurred in the system. Step 125 stores a fail code used to fix the cause of the malfunction in the system, in the memory of the microcomputer 21. Step 419 sets a control valve disable flag to the value "1" (ON). Step 126 turns ON the VSV 38 to open the air inlet hole of the canister 33.

If step 123 detects that the pressure change rate of the system is not greater than the reference value R2, the next step 416 is taken without performing the steps 124–125 and 419. At this time, it is determined that no malfunction occurs in the system. Step 416 resets the control valve disable flag to the value "0".

After the step 126 is performed, step 412 detects whether or not the control valve disable flag is set to the value "1". If a malfunction in the system is detected, step 412 detects that the flag is set to the value "1", and the next step 127 is taken without performing step 422. Therefore, if the malfunction in the system is detected, the control valve 81 in the bypass passage is not turned OFF and remains in the open condition. Since the VSV 36 is opened in step 126, the external air is fed from the canister to the fuel tank via the bypass passage, and the fuel tank is subjected to the atmospheric pressure. It is possible to efficiently reduce the amount of fuel vapor escaping from the system to the atmosphere.

Next, a modification of the malfunction detecting apparatus for eliminating a problem of the above mentioned device (disclosed in U.S. patent application Ser. No. 895,102) will be described by referring to FIGS. 31 and 32. In the above mentioned device, it is impossible to locate a specific portion of the system where the malfunction occurs. The negative pressure of the intake passage varies depending on the operating condition of the engine, and it is likely to erroneously detect a malfunction in the system due to the variation of the negative pressure of the intake passage. In order to reliably and correctly detect a malfunction in the system, it is necessary to correct pressures of the system sensed by a pressure sensor or correct a pressure change rate derived from the sensed pressures before the malfunction detection is performed.

Figure 31:
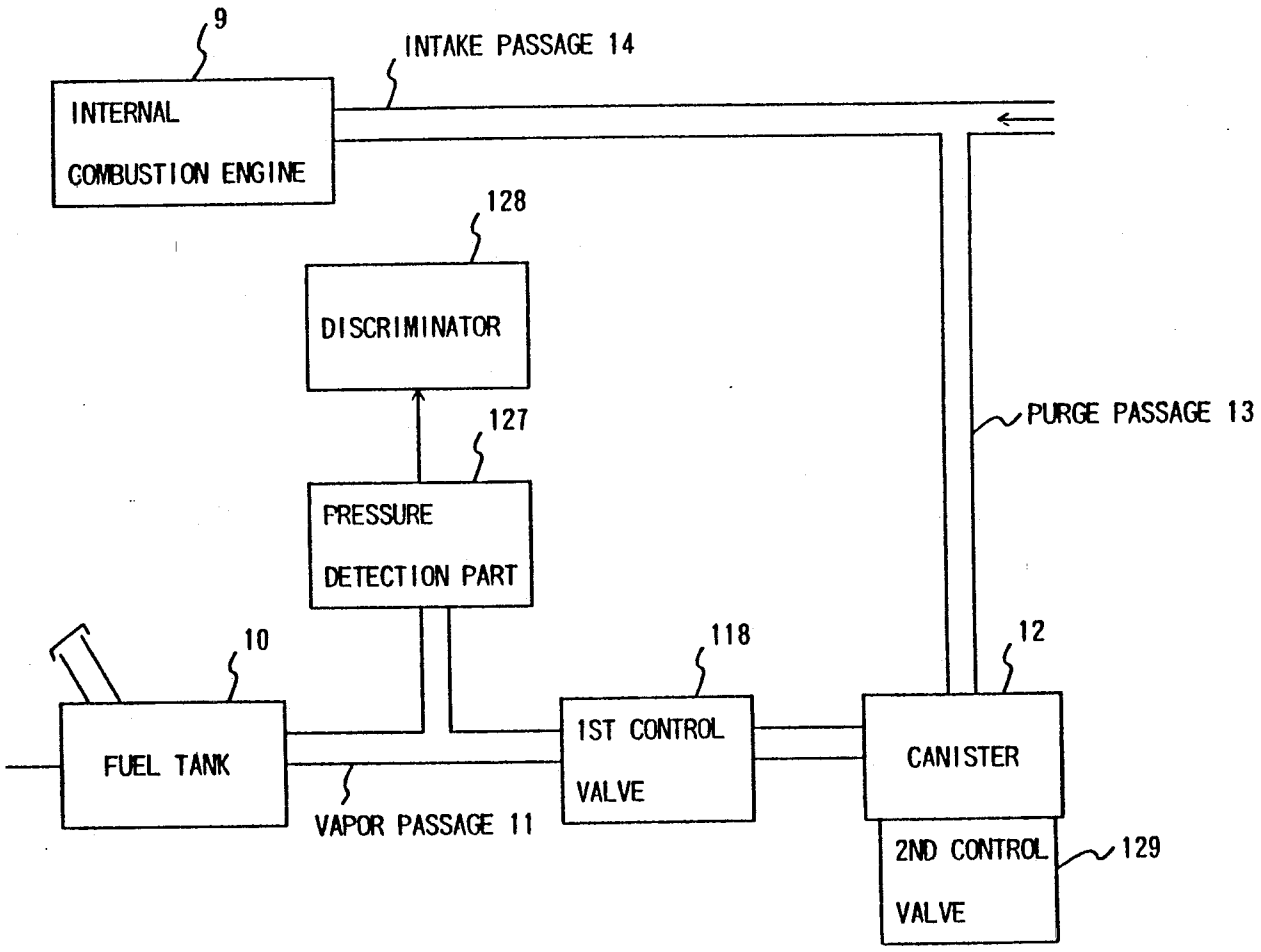
FIG. 31 is a block diagram showing a modified malfunction detecting apparatus of the present invention to eliminate a problem of a conventional device.

In the malfunction detecting apparatus shown in FIG. 31, fuel vapor from a fuel tank 10 is fed to a canister 12 via a vapor passage 11, and the fuel vapor is absorbed in an absorbent in the canister 12. When an internal combustion engine 9 is operating in a prescribed operating condition, an intake passage 14 of the engine 9 is subjected to a negative pressure. At this time, the fuel vapor, absorbed in the canister 12, is fed into the intake passage 14 via a purge passage 13 due to the negative pressure of the intake passage 14.

The apparatus shown in FIG. 31 includes a first check valve 118 for controlling a flow of fuel vapor in the vapor passage between the fuel tank 10 and the canister 12, and a second check valve 129 for controlling a flow of air between an air inlet opening of the canister 12 and the atmosphere.

The first control valve 118 allows the fuel vapor to flow from the fuel tank to the canister via the vapor passage when a difference between the atmospheric pressure and an internal pressure of the fuel tank is greater than a prescribed first value. When a difference between the tank internal pressure and an internal pressure of the canister is smaller than a prescribed second value, the first control valve 118 allows the fuel vapor to flow from the canister to the fuel tank via the vapor passage.

The second control valve 129 allows the air to flow from the atmosphere into the canister via the air inlet opening of the canister when a difference between the canister internal pressure and the atmospheric pressure is smaller than a prescribed third value. When a difference between the canister internal pressure and the atmospheric pressure is greater than a prescribed fourth value, the second control valve 129 allows the air to flow from the canister to the atmosphere via the air inlet opening.

The apparatus shown in FIG. 31 further includes a pressure detection part 127 and a discriminator 128. The pressure detection part 127 senses a pressure of the vapor passage 11, and the discriminator 128 detects whether or not a malfunction occurs in the system, in accordance with the pressure of the vapor passage sensed by the pressure detection part 127. It is possible to correctly and reliably detect a malfunction in the system with no need to correct the sensed pressure of the system, according to the malfunction detecting apparatus.

Figure 32:
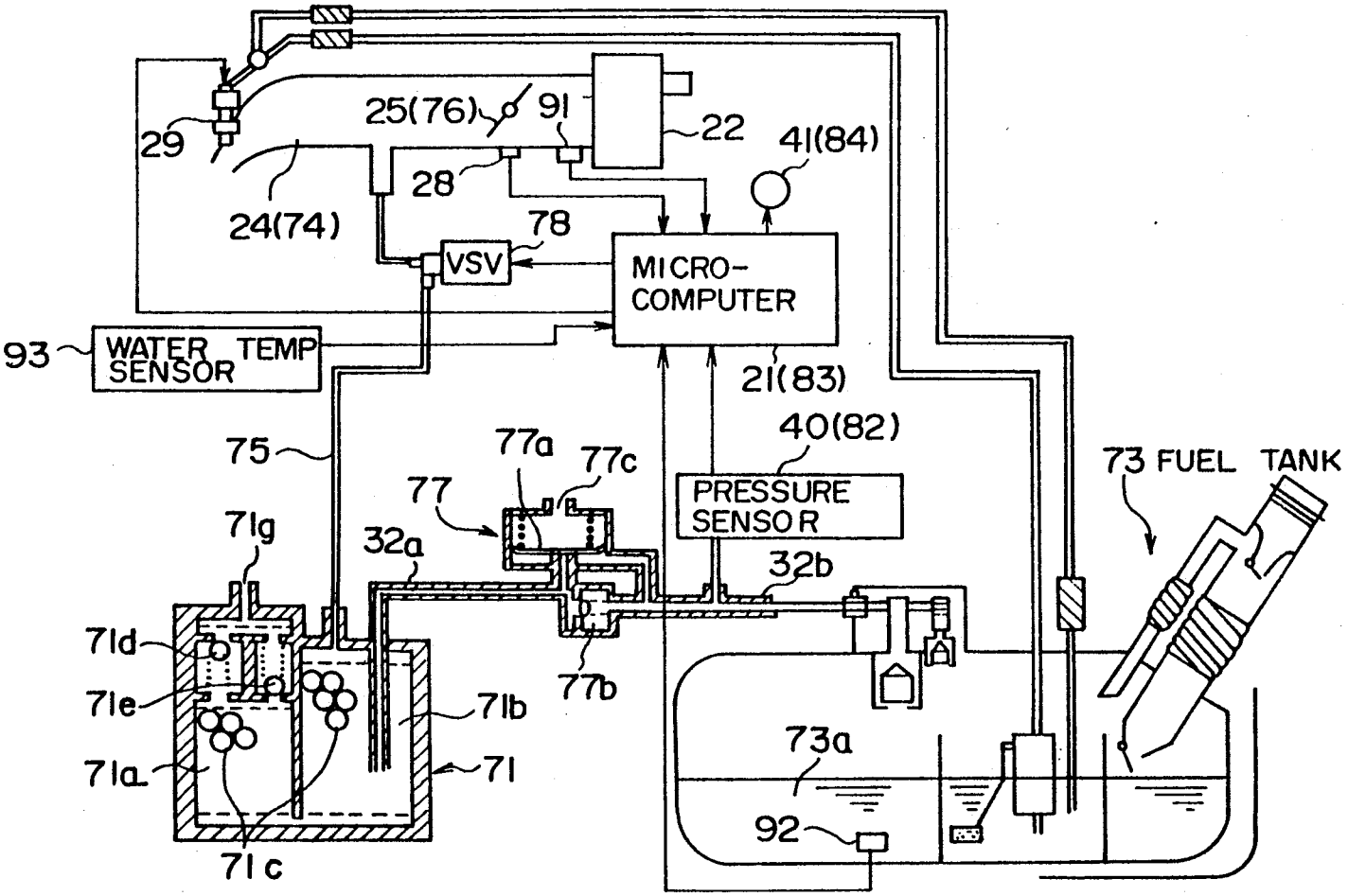
FIG. 32 is a diagram showing an evaporated fuel purge system to which the apparatus shown in FIG. 31 is applied.

FIG. 32 shows an evaporated fuel purge system to which the apparatus of the present invention shown in FIG. 31 is applied. In FIG. 32, the parts which are the same as the corresponding parts in FIGS. 2 and 15 are designated by the same reference numerals, and a description thereof will be omitted.

In the system shown in FIG. 32, the fuel tank 73 contains fuel 73*a*, and fuel evaporated in the fuel tank 73 is fed to the canister 71 via the vapor passage 32. The fuel tank 73 includes a main tank portion and a sub tank portion, and the fuel tank includes a fuel pump provided in the sub tank portion to supply fuel from the fuel tank to the fuel injection pump 29 via a fuel supply pipe connected to the fuel pump. A fuel return pipe connected to the fuel pump is provided between the fuel tank 73 and the fuel injection pump 29. An air temperature sensor 91 is provided in the intake passage to sense a temperature of intake air, and a detection signal is sent from the air temperature sensor 91 to the microcomputer 21. A fuel temperature sensor 92 is provided in the fuel tank 73 to sense a temperature of fuel of the fuel tank, and a detection signal is sent from the fuel temperature sensor 92 to the microcomputer 21. A water temperature sensor 93 is provide to sense a temperature of engine cooling water of the engine, and a detection signal is sent from the water temperature sensor 93 to the microcomputer 21.

The vapor passage 32 is divided into a first portion 32*a* and a second portion 32*b*, and the pressure control check valve 77 is provided between the first portion 32*a* and the second portion 32*b* of the vapor passage. The pressure control check valve 77 includes a first relief valve 77*a* having a diaphragm and a spring, a second check valve 77*b* having a check ball and a spring, and an air inlet hole 77*c*. The first relief valve 77*a* is opened when a difference between the atmospheric pressure and the tank internal pressure is greater than a prescribed first value A (e.g., 150 mm $H_2O$), so that the first portion 32*a* of the vapor passage is subjected to the atmospheric pressure. The second check valve 77*b* is opened when a difference between the tank internal pressure and the canister internal pressure is smaller than a prescribed second value B (e.g., −50 mm $H_2O$), so that the vapor passage between the canister 71 and the fuel tank 73 is opened.

The pressure sensor 40 is provided at an intermediate portion of the second portion 32*b* of the vapor passage to sense a pressure of the vapor passage (32*b*), and this pressure is actually measured as a difference between the atmospheric pressure and the pressure of the vapor passage.

The canister 71 shown in FIG. 32 includes a first chamber 71*a* and a second chamber 71*b* each of which contains an absorbent 71*c* (such as active carbon). The second chamber 71*b* communicates with the pressure control check valve 77 via the first portion 32*a* of the vapor passage, and communicates with the purge control valve (VSV) 78 via the purge passage 75. The first chamber 71*a* of the canister 71 includes a first change valve 71*d* having a check ball and a spring, a second check valve 71*e* having a check ball and a spring, and an air inlet hole 71*g*. The first check valve 71*d* is opened when a difference between the canister internal pressure and the atmospheric pressure is smaller than a prescribed third value C (e.g., −100 mm $H_2O$). The second check valve 71*e* is opened when a difference between the canister internal pressure and the atmospheric pressure is greater than a prescribed fourth value D (e.g., 350 mm $H_2O$).

When the system shown in FIG. 32 is normally operating and no malfunction occurs in the system, furl vapor from the fuel tank 73 is fed to the canister 71 via the vapor passage 32. However, if the tank internal pressure is smaller than the first value A, the valve 77*b* of the pressure control check valve 77 is closed not to allow the fuel vapor to flow from the fuel tank to the canister. For example, when the engine is in a cold start condition, the tank internal pressure changes from the atmospheric pressure to a negative pressure. After the engine starts operating, the fuel temperature is increasing and the tank internal pressure gradually changes to a positive pressure.

After the tank internal pressure reaches the first value A, the check valve 77*b* is opened and the fuel vapor from the fuel tank is fed to the canister via the vapor passage. The fuel vapor is absorbed in the absorbent 71*c* of the canister 71, and thereafter the tank internal pressure decreases to a negative pressure. When the tank internal pressure is smaller than the second value B, the valve 77*a* of the pressure control check valve is closed. The purge control valve 78 is closed when the engine starts operating.

When the engine is operating under a prescribed operating condition, the purge control valve 78 is turned ON to open the purge passage 75. Due to a negative pressure of the intake passage 24, the first check valve 71*d* of the canister is opened and the external air enters the canister 71 from the air inlet hole 71*g*. Thus, the fuel vapor from the canister is fed to the intake passage of the engine via the purge passage.

Further, the present invention is not limited to the above described embodiments, and variations and modifications may be made without departing the scope of the present invention.

What is claimed is:

1. An apparatus for detecting a malfunction in an evaporated fuel purge system, said evaporated fuel purge system including a vapor passage, a canister for absorbing fuel vapor fed from a fuel tank to the canister via the vapor passage, a purge passage for connecting the canister to an intake passage of an internal combustion engine, and a first control valve being opened to feed the fuel vapor from the canister to the intake passage via the purge passage when the engine is operating under a prescribed operating condition, said apparatus comprising:

pressure detection means for sensing a pressure of an evaporated fuel passage portion of said system to be diagnosed by said apparatus;

first control means for turning OFF a second control valve provided in the canister to close an air inlet opening of the canister, and for simultaneously turning ON the first control valve to open the purge passage, so that said evaporated fuel passage portion is subjected to a negative pressure of the intake passage during a first time period;

first discrimination means for detecting whether a malfunction has occurred in said system in accordance with a pressure change rate derived from the pressure of said evaporated fuel passage portion sensed by said pressure detection means at a start of a the first time period and from the pressure sensed by said pressure detection means at an end of the first time period;

second control means for detecting whether a pressure of said evaporated fuel passage portion sensed by said pressure detection means reaches a prescribed negative pressure after said first discrimination means detects that no malfunction has occurred in said system, and for turning OFF both the first control valve and the second control valve during a second time period after the prescribed negative pressure is reached in said system; and second discrimination means for detecting whether a malfunction has occurred in said system in accordance with a pressure change rate derived from the pressure of said evaporated fuel passage portion sensed by said pressure detection means at a start of the second time period and at an end of the second time period.

2. An apparatus according to claim 1, wherein, when said pressure change rate is greater than a prescribed reference value, said second discrimination means determines that a malfunction has occurred in said system, and wherein, when said pressure change rate is not greater than the reference value, said second discrimination means determines that no malfunction has occurred in said system.

3. An apparatus according to claim 1, wherein said second discrimination means stores pressures Ps2 and Pe2 sensed at the start of the second time period and at the end thereof, respectively, in a memory to calculate a pressure change rate (Pe2−Ps2)/Y derived from a difference between the stored pressures Ps2 and Pe2 and from the second time period Y.

4. An apparatus according to claim 1, wherein said first control means turns ON and OFF the first control valve for controlling a flow of fuel vapor in the purge passage between the canister and the intake passage, and said first control means turns ON and OFF the second control valve for controlling a flow of air from the atmosphere to the canister via the air inlet opening of the canister.

5. An apparatus according to claim 4, wherein said second control valve is a vacuum switching valve provided in the canister.

6. An apparatus according to claim 4, wherein said second control valve is a mechanical check valve provided in the canister.

7. An apparatus according to claim 1, wherein said evaporated fuel passage portion comprises the first control valve, the purge passage between the first control valve and the canister, and the vapor passage between the canister and the fuel tank.

8. An apparatus according to claim 7, further comprising:

the first control valve for controlling a flow of fuel vapor in the purge passage between the canister and the intake passage;

a pressure control check valve for controlling a flow of fuel vapor fed from the fuel tank to the canister via the vapor passage;

a bypass passage for connecting the fuel tank to the canister via the vapor passage, said bypass passage being connected to said vapor passage and passing around the pressure control check valve; and a bypass control valve for controlling a flow of fuel vapor fed from the fuel tank to the canister via the bypass passage, wherein said first control means turns ON said bypass control valve during the first time period, so that the purge passage between the first control valve and the canister, the canister, the bypass passage, the vapor passage between the pressure control check valve and the fuel tank, and the fuel tank are subjected to a negative pressure of the intake passage during the first time period.

9. An apparatus according to claim 1, further comprising the first control valve for controlling a flow of fuel vapor in the purge passage between the canister and the intake passage, and a pressure control check valve for controlling a flow of fuel vapor fed from the fuel tank to the canister via the vapor passage, wherein said evaporated fuel passage portion comprises the first control valve, the purge passage between the first control valve and the canister, the canister, and the vapor passage between the canister and the pressure control check valve.

10. An apparatus according to claim 1, further comprising a warning lamp that is switched ON when it is detected that a malfunction has occurred in said evaporated fuel purge system, in order to inform a vehicle driver of the occurrence of the malfunction in said system, said warning lamp being switched OFF when it is detected that no malfunction has occurred in said system.

11. An apparatus according to claim 1, wherein said purge passage of said system connects said canister to a portion of the intake passage of the engine near a throttle valve provided within the intake passage.

12. An apparatus according to claim 1, wherein said purge passage of said system connects said canister to a surge tank provided in the intake passage of the engine.

13. An apparatus according to claim 5, wherein said second control valve is turned ON to open the air inlet opening of the canister after said second discrimination means detects whether or not a malfunction has occurred in the system, so that said evaporated fuel passage portion is subjected to the atmosphere via the air inlet opening of the canister.

14. An apparatus according to claim 13, wherein said second means disallows said first control valve to be turned ON when an internal pressure of the fuel tank does not reach a prescribed positive pressure after a prescribed time period has elapsed since said second control valve was turned ON.

15. An apparatus according to claim 4, wherein it is determined that a malfunction has occurred in the first control valve, when the first control valve is in its open condition and it is detected that an internal pressure of the fuel tank has reached a first negative pressure below said prescribed negative pressure after both the first control valve and the second control valve are turned OFF.

16. An apparatus according to claim 4, wherein it is determined that a malfunction has occurred in the second control valve, when the second control valve is in its closed condition and it is detected that an internal pressure of the fuel tank has not reached a second negative pressure below the atmosphere pressure and above said prescribed negative pressure after a prescribed time period has elapsed since the second control valve was turned OFF.

17. An apparatus for detecting a malfunction in an evaporated fuel purge system, said evaporated fuel purge system including a vapor passage, a canister for absorbing fuel vapor fed from a fuel tank to the canister via the vapor passage, and a purge passage for connecting the canister to an intake passage of an internal combustion engine, the fuel vapor being fed from the canister to the intake passage via the purge passage when the engine is operating under a prescribed operating condition, said apparatus comprising:

a first control valve that is turned ON and OFF to control a flow of fuel vapor in the purge passage between the canister and the intake passage;

a second control valve that is turned ON and OFF to control a flow of air from the atmosphere to the canister via the inlet opening of the canister;

valve control means for turning OFF the second control valve and for simultaneously turning ON the first control valve so as to subject the purge passage to a negative pressure of the intake passage, and for detecting whether a pressure of the system reaches a prescribed first negative pressure, and for turning OFF the first and second control valves after said first negative pressure is reached in said system;

detection means for detecting whether a pressure of the system changes from said first negative pressure to a prescribed second negative pressure after the first and second control valves are turned OFF, so as to detect whether the pressure of the system is substantially stable; and discrimination means for sensing pressures of the system when said detection means detects said second negative pressure has been reached and when a prescribed time period has elapsed since said detection of said detection means, wherein said discrimination means operates to determine whether a malfunction has occurred in said system in accordance with a pressure change rate derived form said sensed pressures of the system.

18. An apparatus for detecting a malfunction in an evaporated fuel purge system, said evaporated fuel purge system including a vapor passage, a canister for absorbing fuel vapor fed from a fuel tank to the canister via the vapor passage, a purge passage for connecting the canister to an intake passage of an internal combustion engine, a purge control valve being opened to feed the fuel vapor from the canister to the intake passage via the purge passage when the engine is operating under a prescribed operating condition, and a pressure control check valve for controlling a flow of fuel vapor fed from the fuel tank to the canister via the vapor passage, said apparatus comprising:

a bypass passage for connecting the fuel tank to the canister, said bypass passage being connected to the vapor passage and passing around the pressure control check valve;

a bypass control valve for controlling a flow of fuel vapor fed from the fuel tank to the canister via said bypass passage;

pressure detecting means for sensing a pressure of a first portion of the system having the purge control valve, the purge passage, the canister, and the vapor passage between the canister and the pressure control check valve, and for sensing a pressure of a second portion of the system having the fuel tank, and the vapor passage between the fuel tank and the pressure control check valve;

discrimination means for detecting whether a malfunction has occurred in said first portion in accordance with the pressure of said first portion sensed by said pressure detecting means, and for detecting whether a malfunction has occurred in said second portion in accordance with the pressure of the second portion sensed by said pressure detecting means; and valve control means for selectively turning ON and OFF said purge control valve and said bypass control valve when said system having said first portion and said second portion is diagnosed, and for switching said pressure detecting means to a first condition when a pressure of the second portion of the system is sensed, and for switching said pressure detecting means to a second condition when a pressure of the first portion of the system is sensed.

19. An apparatus according to claim 18, wherein said pressure detecting means comprises a pressure sensor and a three-way valve connected to said pressure sensor, said three-way valve being switched to the first condition so that the pressure sensor is connected to the second portion of the system via the three-way valve to sense a pressure of the second portion, and said three-way valve being switched to the second condition so that the pressure sensor is connected to the first portion of the system via the three-way valve to sense a pressure of the first portion.

20. An apparatus according to claim 18, wherein, when the first portion of the system is diagnosed, said valve control means switches said pressure detecting means to the second condition so that a pressure of the first portion is sensed by said pressure detecting means, and wherein, when said sensed pressure of the first portion is not smaller than a prescribed negative pressure during a prescribed time period after the purge control valve is turned ON, it is determined by said discrimination means that a malfunction has occurred in the first portion.

21. An apparatus according to claim 18, further comprising a second control valve for controlling a flow of air from the atmosphere to the canister via an air inlet opening of the canister, wherein, when the first portion of the system is diagnosed, said valve control means switches said pressure detecting means to the second condition, said valve control means turns OFF the second control valve and turns ON the purge control valve so that the first portion of the system is subjected to a negative pressure of the intake passage, and said valve control means turning OFF the purge control valve during a prescribed time period after it is detected that a pressure of the first portion sensed by said pressure detecting means has reached a prescribed negative pressure, so that pressures of the first portion are sensed by said pressure detecting means at a start of the prescribed time period and at an end thereof respectively, and wherein, when a difference between said sensed pressures of the first portion is greater than a prescribed reference value, it is determined by said discrimination means that a malfunction has occurred in the first portion.

22. An apparatus according to claim 20, wherein, when the second portion of the system is diagnosed, said valve control means switches said pressure detecting means to the first condition so that a pressure of the second portion is sensed by said pressure detecting means, and wherein, when said sensed pressure of the second portion is not greater than a prescribed positive pressure during a prescribed time period, it is determined by said discrimination means that a malfunction has occurred in the second portion.

23. An apparatus according to claim 21, wherein, when the second portion of the system is diagnosed, said valve control means switches said pressure detecting means to the first condition so that a pressure of the second portion is sensed by said pressure detecting means, and wherein, when said sensed pressure of the second portion is not greater than a prescribed positive pressure during a prescribed time period, it is determined by said discrimination means that a malfunction has occurred in the second portion.

24. An apparatus according to claim 18, further comprising a warning lamp that is switched ON when it is detected that a malfunction has occurred in the system having the first portion and the second portion, in order to inform a vehicle driver of the occurrence of the malfunction in said system, said warning lamp being switched OFF when it is detected that no malfunction has occurred in said system.

25. An apparatus according to claim 18, wherein said evaporated fuel purge system further includes a mechanical check valve for controlling a flow of air from the atmosphere to the canister via the air inlet opening of the canister.

26. An apparatus for detecting a malfunction in an evaporated fuel purge system, said evaporated fuel purge system including a vapor passage, a canister for absorbing fuel vapor fed from a fuel tank to the canister via the vapor passage, a purge passage for connecting the canister to an intake passage of an internal combustion engine, the fuel vapor being fed from the canister to the intake passage via the purge passage when the engine is operating under a prescribed operating condition, and a check valve for controlling a flow of fuel vapor from the fuel tank to the canister via the vapor passage, said apparatus comprising:

a pressure control check valve provided in the vapor passage and mechanically opened when a pressure of the vapor passage is higher than a prescribed positive pressure;

a bypass control valve provided in a bypass passage, connected to the vapor passage and passing around said pressure control check valve, said bypass control valve being turned ON and OFF to control a flow of fuel vapor from the fuel tank to the canister;

a first control valve that is turned ON and OFF to control a flow of fuel vapor in the purge passage between the canister and the intake passage;

a second control valve which is turned ON and OFF to control a flow of air from the atmosphere into the canister via an air inlet opening of the canister;

valve control means for turning OFF the second control valve and for turning ON the first control valve so as to subject the purge passage, the canister, and the vapor passage to a negative pressure of the intake passage, for detecting whether a pressure of the system reaches a prescribed first negative pressure, and for turning OFF both the first control valve and the second control valve after said first negative pressure is reached in said system;

detection means for detecting whether or not a pressure of the system changes from said first negative pressure to a prescribed second negative pressure after the first and second control valves are turned OFF, so as to detect whether the pressure of the system is substantially stable;

discrimination means for sensing pressures of the system when said detection means detects the pressure of the system as reaching said second negative pressure and when a prescribed time period has elapsed since said detection of said detection means, and for detecting whether a malfunction has occurred in said system, in accordance with a pressure change rate derived from said sensed pressures of the system; and means for subjecting the canister, the bypass passage and the fuel tank to the atmospheric pressure via the air inlet opening of the canister, by turning ON said second control valve and said bypass control valve after said discrimination means detects that a malfunction has occurred in said system.

27. An apparatus for detecting a malfunction in an evaporated fuel purge system, said evaporated fuel purge system including a vapor passage, a canister for absorbing fuel vapor fed from a fuel tank to the canister via the vapor passage, and a purge passage for connecting the canister to an intake passage of an internal combustion engine, the fuel vapor being fed from the canister to the intake passage via the purge passage when the engine is operating under a prescribed operating condition, said apparatus comprising:

a pressure control check valve provided in the vapor passage for controlling a flow of fuel vapor from the fuel tank to the canister via the vapor passage;

cold start detection means for detecting whether the engine is in a cold start condition;

flag setting means for setting a cold start detection flag when the cold start condition of the engine is detected by said cold start detection means;

valve control means for turning OFF the pressure control check valve, when the cold start detection flag is set, so as to close the vapor passage between the fuel tank and the pressure control check valve during a prescribed time period;

pressure detection means for sensing a pressure of the vapor passage between the fuel tank and the pressure control check valve; and discrimination means for detecting whether a malfunction has occurred in said system, said discrimination means detecting that a malfunction has occurred in said system if the cold start flag is set and the pressure of the vapor passage sensed by said pressure detection means is not smaller than a prescribed negative pressure after the prescribed time period has elapsed since the vapor passage is closed by the pressure control check valve.

28. An apparatus according to claim 27, further comprising a vacuum switching valve provided in the purge passage to control a flow of fuel vapor in the purge passage from the canister to the intake passage.

29. An apparatus according to claim 27, further comprising a warning lamp that is switched ON when it is detected that a malfunction has occurred in said evaporated fuel purge system, in order to inform a vehicle driver of the occurrence of the malfunction in said system, said warning lamp being switched OFF when it is detected that no malfunction has occurred in said system.

30. An apparatus for detecting a malfunction in an evaporated fuel purge system, said evaporated fuel purge system including a vapor passage, a canister for absorbing fuel vapor fed from a fuel tank to the canister via the vapor passage, and a purge passage for connecting the canister to an intake passage of an internal combustion engine, the fuel vapor being fed from the canister to the intake passage via the purge passage when the engine is operating under a prescribed operating condition, said apparatus comprising:

a pressure control check valve provided in the vapor passage for controlling a flow of fuel vapor from the fuel tank to the canister via the vapor passage;

a fuel temperature sensor for sensing a temperature of fuel of the fuel tank;

valve control means for turning OFF the pressure control check valve to close the vapor passage between the fuel tank and the pressure control check valve during a prescribed time period;

pressure detection means for sensing a pressure of the vapor passage between the fuel tank and the pressure control check valve when the vapor passage is closed;

fuel temperature detection means for detecting whether a difference between a fuel temperature of the fuel tank sensed at a previous engine stop and a fuel temperature of the fuel tank sensed at a current engine start is greater than a prescribed value; and discrimination means for detection whether a malfunction has occurred in said system, said discrimination means detecting that a malfunction has occurred in said system if it is detected that said fuel temperature difference is greater than the prescribed value and the pressure of the vapor passage sensed by said pressure detection means is not smaller than a prescribed negative pressure.

31. An apparatus according to claim 30, further comprising a vacuum switching valve provided in the purge passage to control a flow of fuel vapor in the purge passage from the canister to the intake passage.

32. An apparatus according to claim 30, further comprising a warning lamp that is switched ON when it is detected that a malfunction has occurred in said evaporated fuel purge system in order to inform a vehicle driver of the occurrence of the malfunction in said system, said warning lamp being switched OFF when it is detected that no malfunction has occurred in said system.

* * * * *